US008928563B2

(12) United States Patent
Yamashita et al.

(10) Patent No.: US 8,928,563 B2
(45) Date of Patent: Jan. 6, 2015

(54) DISPLAY DEVICE

(71) Applicant: Sony Corporation, Tokyo (JP)

(72) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 14/446,694

(22) Filed: Jul. 30, 2014

(65) Prior Publication Data

US 2014/0340288 A1 Nov. 20, 2014

Related U.S. Application Data

(63) Continuation of application No. 13/955,671, filed on Jul. 31, 2013, now Pat. No. 8,842,060, which is a continuation of application No. 12/075,215, filed on Mar. 10, 2008, now abandoned.

(30) Foreign Application Priority Data

Mar. 16, 2007 (JP) ..... 2007-068004

(51) Int. Cl.
*G09G 3/30* (2006.01)
*G09G 3/32* (2006.01)

(52) U.S. Cl.
CPC ..... *G09G 3/3233* (2013.01); *G09G 3/3266* (2013.01); *G09G 2300/0426* (2013.01); *G09G 2300/0842* (2013.01); *G09G 2320/0223* (2013.01)
USPC ..... 345/76; 345/92; 345/98; 345/100; 345/204

(58) Field of Classification Search
None
See application file for complete search history.

(56) References Cited

U.S. PATENT DOCUMENTS

| | | | |
|---|---|---|---|
| 5,559,356 | A | 9/1996 | Yukawa |
| 5,642,127 | A | 6/1997 | Tamai |
| 6,028,580 | A | 2/2000 | Kosegawa et al. |
| 6,246,387 | B1 | 6/2001 | Yamazaki |
| 2001/0015712 | A1 | 8/2001 | Hashimoto |
| 2006/0170628 | A1 | 8/2006 | Yamashita et al. |

FOREIGN PATENT DOCUMENTS

JP 2006-215213 A 8/2006

*Primary Examiner* — Jesus Hernandez
(74) *Attorney, Agent, or Firm* — Rader, Fishman & Grauer PLLC

(57) ABSTRACT

A display device includes: a pixel array unit with pixel circuits disposed in matrix form, the pixel circuit including a driving transistor, an electro-optic element, a storage-capacitor, and a sampling transistor, with the electro-optic element emitting light by generating a driving current based on information stored in the storage-capacitor at the driving transistor to be applied to the electro-optic element; and a control unit, of which the output stage includes a buffer transistor, to output a pulse signal for driving the pixel array unit from the buffer transistor; wherein the pixel array unit and the control unit are formed with long laser beam irradiation to be scanned in the vertical direction; and with the control unit, buffer transistors for outputting a pulse signal for sampling to an input video signal to each signal line are arrayed in a column in the longitudinal direction of the laser beam irradiation.

13 Claims, 38 Drawing Sheets

DISPLAY DEVICE

CROSS REFERENCES TO RELATED APPLICATIONS

This present application is a Continuation of patent application Ser. No. 13/955,671, filed Jul. 31, 2013, which is a Continuation of patent application Ser. No. 12/075,215, filed Mar. 10, 2008, which claims priority from Japanese Patent Application JP 2007-068004 filed in the Japanese Patent Office on Mar. 16, 2007, the entire contents of which are incorporated herein by reference.

BACKGROUND OF THE INVENTION

1. Field of the Invention

The present invention relates to a display device including a pixel array unit where pixel circuits (also referred to as pixels) including an electro-optic element (also referred to as a display element or light-emitting element) are arrayed in a matrix form. More particularly, the present invention relates to an active-matrix display device wherein pixel circuits including an electro-optic element of which the brightness changes depending on the magnitude of a driving signal as a display element are disposed in a matrix form, each pixel circuit has an active element, and display driving is performed in increments of pixel by the active element thereof.

2. Description of the Related Art

As for pixel display elements, there has been a display device employing an electro-optic element of which the brightness changes due to voltage applied thereto or current flowing thereto. For example, as an electro-optic element of which the brightness changes due to voltage applied thereto a liquid crystal display element is a representative example, and as an electro-optic element of which the brightness changes due to current flowing thereto an organic electro luminescence (organic EL, organic light emitting diode (OLED); hereafter, referred to as an organic EL) element is a representative example. An organic EL display device employing an organic EL element which is the latter is a so-called light-emitting display device employing an electro-optic element which is a self-light-emitting element as a pixel display element.

An organic EL element is an electro-optic element employing a phenomenon wherein upon an electric field being applied to an organic thin film, light is emitted. An organic EL element can be driven even with relatively low applied voltage (e.g., at or above 10 V), so can be driven with low consumption power. Also, an organic EL element is a self-light-emitting element which emits light by itself, so with a liquid crystal display device, there is no need to provide an auxiliary lighting member such as a backlight or the like necessary for a liquid crystal device, and accordingly, reduction in weight and reduction in thickness can be readily performed. Further, the response speed of an organic EL element is very high speed (e.g., around several microseconds), so afterimages at the time of moving image display do not occur. According to such advantages, development of flat-self-light-emitting display devices employing an organic EL element as an electro-optic element has been performed in recent years.

With current-driven electro-optic elements including an organic EL element as a representative example, when their driving current values differ, their light-emitting brightness also differs. Accordingly, in order to emit light with stable brightness, it is important to supply a stable driving current to an electro-optic element. For example, a drive system for supplying a driving current to an organic EL element can be divided into a constant current drive system and a constant voltage drive system (no known literature is presented here since this is a well-known technique).

The voltage-current properties of an organic EL element include a property with great inclination, so upon constant voltage driving being performed, minute voltage irregularities or minute element property irregularities cause great brightness irregularities. Thus, in general, constant current driving is employed, which uses a driving transistor at a saturation area. It goes without saying that with constant current driving also, current fluctuation causes brightness irregularities, but small current irregularities cause small brightness irregularities.

Conversely, even with the constant current drive system, in order not to change the light-emitting brightness of an electro-optic element, it is important to steady a driving signal written in and held in a storage-capacitor according to an input image signal. For example, in order not to change the light-emitting brightness of an organic EL element, it is important to steady a driving current according to an input image signal.

Note however, the threshold voltage and mobility of an active element (driving transistor) for driving an electro-optic element fluctuates due to process fluctuation. Also, the property of an electro-optic element such as an organic EL element or the like fluctuates with time. Particularly, in the case of employing a low-temperature-polysilicon TFT substrate or the like, the irregularities of the threshold property and mobility property of a transistor are great. Even with the constant drive system, the property irregularities of such a driving active element or the property fluctuation of an electro-optic element affects light-emitting brightness.

Therefore, in order to control light-emitting brightness across the entire screen of a display device evenly, various types of arrangement have been studied to control light-emitting fluctuation due to the property fluctuation of the above-mentioned driving active element or electro-optic element (see Japanese Unexamined Patent Application Publication No. 2006-215213).

For example, with the arrangement described in Japanese Unexamined Patent Application Publication No. 2006-215213, as a pixel circuit for organic EL elements, there have been proposed a threshold correction function to steady a driving current even in the case of the threshold voltage of a driving transistor having irregularities or change over time, a mobility correction function to steady a driving current even in the case of the mobility of a driving transistor having irregularities or change over time, and a bootstrap function to steady a driving current even in the case of the current-voltage property of an organic EL element having change over time.

In order to realize these threshold correction function and mobility correction function and so forth, it is necessary to turn on/off a sampling transistor or each transistor added for threshold correction or mobility correction at a predetermined timing using a pulse signal.

The ON period or OFF period of each transistor determines each correction period, so it is important to manage timing for turning on/off each transistor to receive each correction effect. Upon irregularities being caused with the correction period, the threshold correction advantage and mobility correction advantage fluctuate from one pixel to another, and brightness unevenness due to such irregularities is caused, leading to image quality deterioration. For example, there is no problem in the case of the irregularities between the correction periods with leeway, such that when the correction period is long, even if there are a few irregularities regarding ON/OFF timing, there are few problems, but the shorter the correction period becomes, the smaller the leeway as to the irregularities between the correction periods becomes, and accordingly, it is important to manage so as not to cause irregularities thereof, and so as not to cause deviation regarding the ON/OFF timing of a transistor.

Now, a pulse signal (pulse signal for brightness change correction operation) for controlling each transistor is output for each scanning line from a scan circuit provided on the side edge of a pixel array unit where pixel circuits are arrayed in a two-dimensional form, and is supplied simultaneously for each scanning line to predetermined terminals of all the pixel circuits connected to each scanning line within the pixel array unit via each scanning line. Note however, a scanning line having linear resistance and distributed capacity (overlap parasitic capacitance), so there is concern that there may be difference regarding the propagation property of a pulse signal depending on whether the pixel circuit is far from or near the scan circuit, and the correction period fluctuate due to the propagation property difference thereof. Focusing attention on this point, it can be conceived to employ a technique for improving the irregularities between the correction periods from the perspective of driving timing.

SUMMARY OF THE INVENTION

Note however, with improvements from the perspective of driving timing, the pulse signal itself supplied from the scan circuit for each scanning line is assumed to have no deviation of timing (specifically, blunting of a pulse waveform). If the pulse signal itself supplied from the scan circuit has waveform blunting, and the waveform blunting thereof differs for each scanning line, there are caused irregularities between the correction periods, and brightness unevenness occurs. The waveform blunting of the pulse signal itself supplied from the scan circuit affects all of the pixel circuits connected to scanning lines similarly, and accordingly, brightness unevenness due to the irregularities regarding the waveform blunting appears for each scanning line (i.e., linearly). This point is readily recognized visibly as compared with random brightness unevenness in the case of the threshold and mobility of each pixel circuit within the pixel array unit fluctuating at random, which causes a critical problem.

Also, the deviation of such pulse timing (specifically, blunting of a pulse waveform) is not restricted to threshold correction and mobility correction, and with the other pulses for driving the pixel circuits also, there is difference of the degree of leeway as to timing deviation, but if there is deviation, the influence thereof manifested in display performance is not negligible.

There has been recognized a need to provide an arrangement whereby the irregularities of the waveform blunting of the pulse signal supplied from the scan circuit can be improved.

An embodiment of a display device according to the present invention is a display device causing an electro-optic element within a pixel circuit to emit light based on a picture signal, within a pixel circuit disposed in a pixel array unit in a matrix form, there are provided at least a driving transistor configured to generate a driving current, an electro-optic element connected to the output terminal side of the driving transistor, a storage-capacitor for storing information corresponding to the signal potential within a picture signal supplied via a picture signal line, and a sampling transistor configured to write information corresponding to the signal potential of the picture signal in the storage-capacitor. With the pixel circuit, the electro-optic element is caused to emit light by generating a driving current based on information stored in the storage-capacitor at the driving transistor to be applied to the electro-optic element. It is desirable to connect the storage-capacitor between the control input terminal and output terminal of the driving transistor.

The sampling transistor writes information corresponding to the signal potential in the storage-capacitor, so the sampling transistor inputs the signal potential to the input terminal thereof (one of the source terminal or drain terminal), and writes information corresponding to the signal potential in the storage-capacitor connected to the output terminal thereof (the other of the source terminal or drain terminal). It goes without saying that the output terminal of the sampling transistor is also connected to the control input terminal of the driving transistor.

As features according to an embodiment of a display device according to the present invention, when the perspective of a circuit pattern is taken into consideration, first, the pixel array unit and control unit are assumed to be formed by long laser beam irradiation having a predetermined wavelength to be scanned in the vertical direction.

With the control unit, of the buffer transistors, buffer transistors configured to output a pulse signal for sampling an input video signal to each signal line are assumed to be disposed by being arrayed in a column in the longitudinal direction of laser beam irradiation.

As the buffer transistors for outputting a pulse signal for sampling an input video signal to each signal line, for example, a buffer transistor for determining the start timing of predetermined (certain) operation to be realized by driving a pixel circuit, and a buffer for determining the end timing thereof are employed.

As a point of view, these buffer transistors can be applied to not only a scanning unit in the horizontal direction, but also a scanning unit in the vertical direction. When taking the common scan direction into consideration, and focusing attention on threshold correction and mobility correction, there is need to focus attention on not the scanning unit in the horizontal direction but the scanning unit in the vertical direction.

This is because in general, the sampling rate in the horizontal direction is several 100 nanoseconds with point sequential drive, several 10 microseconds with line sequential drive, and the sampling rate in the vertical direction is around 50 microseconds, so in order to suppress the irregularities between correction periods in the horizontal direction, irradiation is performed so as to direct the ELA irradiation direction to the longitudinal direction (row direction) of pixels. Mobility correction is performed with scanning in the vertical direction, but it takes several microseconds, so ELA irradiation irregularities exceed the level which can be disregarded, there is need to devise the scanning unit in the vertical direction using the above-mentioned layout.

Note however, with the line sequential driving, the sampling rate in the horizontal direction is longer than the mobility correction time, so ELA irradiation direction can be inverted 90 degrees in some cases. At this time, with the scanning unit in the horizontal direction also, irregularities are caused due to ELA, so it is desirable to devise the scanning unit in the horizontal direction using the above-mentioned layout.

It is desirable to configure the buffer transistors as an inverter buffers wherein in the case of a pulse signal making the transition from a low (L) level to a high (H) level, or conversely, in the case of the pulse signal making the transition from a high (H) level to a low (L) level, even in either case, a p-type transistor (disposed at the high voltage side) and a n-type transistor (disposed at the low voltage side) are cascade-connected so as to have sufficient driving ability.

In this case, with each of a p-type and n-type transistor pair serving as an inverter type for determining the start timing, and a p-type and n-type transistor pair serving as an inverter type for determining the end timing, any one polarity alone determines the start timing or end timing. Accordingly, in this case, there is no need to necessarily dispose all by being arrayed in a column in the longitudinal direction of laser beam irradiation, of the respective p-type transistors and n-type transistors, one pair determining the start timing and the other pair determining the end timing needs to be disposed by being arrayed in a column in the longitudinal direction of laser beam irradiation.

On the other hand, even in this case, all of a p-type and n-type transistor pair serving as an inverter type for determining the start timing, and a p-type and n-type transistor pair serving as an inverter type for determining the end timing are disposed by being arrayed in a column in the longitudinal direction of laser beam irradiation, whereby there is an advantage wherein with any driving, a state can be secured in a sure manner in which the buffer transistors for determining the start timing and the buffer transistors for determining the end timing are disposed by being arrayed in a column in the longitudinal direction of laser beam irradiation.

Also, in the event of stipulating an operation period, optimization is realized by automatically causing the operation period thereof to follow the magnitude of a signal potential in some cases. In this case, when determining the start timing and/or end timing of the driving pulse, the pulse potential gradually changed from a high level to low level or a low level to high level is supplied to the control input terminal (gate terminal) of a switch transistor, so in order to avoid a threshold voltage problem, it is desirable to provide an analog switch having a transfer gate configuration employing a combination of two switching transistors (i.e., both of n-channel type and p-channel type) of which the polarities differ as a buffer transistor.

In this case, it is desirable to dispose at least bipolar transistors making up an analog switch by arraying these in a column in the longitudinal direction of laser beam irradiation. In the case of employing an analog switch having a transfer gate configuration only regarding any one of the start timing and end timing, in addition to bipolar transistors making up an analog switch, it is desirable to dispose any one of a p-type transistor and a n-type transistor for determining the remaining one of the start timing or end timing by arraying this in a column in the longitudinal direction of laser beam irradiation.

Note that it is desirable to apply such disposing of buffer transistors, by arraying these in a column in the longitudinal direction of laser beam irradiation, to not all of the buffer transistors within the control unit, but to buffer transistors with little leeway as to the property irregularities of the pulse signal. It goes without saying that this does not mean to eliminate handling all of the buffer transistors in this way.

For example, it is desirable to apply such handling to a scanning unit for outputting a correction pulse for controlling a driving current fluctuation suppressing unit for suppressing the fluctuation of a driving current accompanying the property fluctuation of a driving transistor or electro-optic element, such as at least one of a write scanning unit and correction scanning unit relating to threshold correction or mobility correction. In particular, it is desirable to apply such handling to a unit having little leeway as to the irregularities between correction periods. For example, usually, mobility correction periods are far shorter than threshold correction periods, and the irregularities thereof appear as change in brightness, so there is a need to perform the irregularities management of mobility correction periods strictly, and accordingly, it is desirable to apply such handling to buffer transistors for correction pulse relating to mobility correction.

According to an embodiment of the present invention, an arrangement is made wherein the pixel array unit and control unit are formed with long laser beam irradiation having a predetermined wavelength to be scanned in the vertical direction, and with regard to the control unit, buffer transistors for outputting a pulse signal for sampling an input video signal to each signal line, such as each buffer transistor for determining the start or end of an operation, are disposed by being arrayed in a column in the longitudinal direction of laser beam irradiation. The predetermined buffer transistors are disposed in the longitudinal direction of laser beam irradiation, whereby the respective buffer transistors are irradiated with the same laser beam.

Thus, the levels of the property irregularities between driving pulse waveforms to be output to a pixel circuit from each buffer transistor of the control unit which are subjected to the same laser beam irradiation can be aligned. When applying such handling to the respective transistor buffers for determining the start and end of an operation, the levels of the property irregularities between driving pulse waveforms can be aligned at the start side and end side of the operation. When the change property at the start side is steep, change property at the end side is also steep, and conversely, when the change property at the start side is gentle, change property at the end side is also gentle. As a result, even if there are property irregularities between driving pulse waveforms due to laser beam irradiation intensity differing for each stage (row), the operation periods from the start to end of an operation can be generally steadied at each stage (each row). As a result thereof, deterioration in display performance due to property irregularities for each stage (row) of buffer transistors can be suppressed.

DESCRIPTION OF THE PREFERRED EMBODIMENTS

Description will be made below regarding embodiments of the present invention with reference to the drawings.

<Entire Overview of Display Device>

Figure 1A:
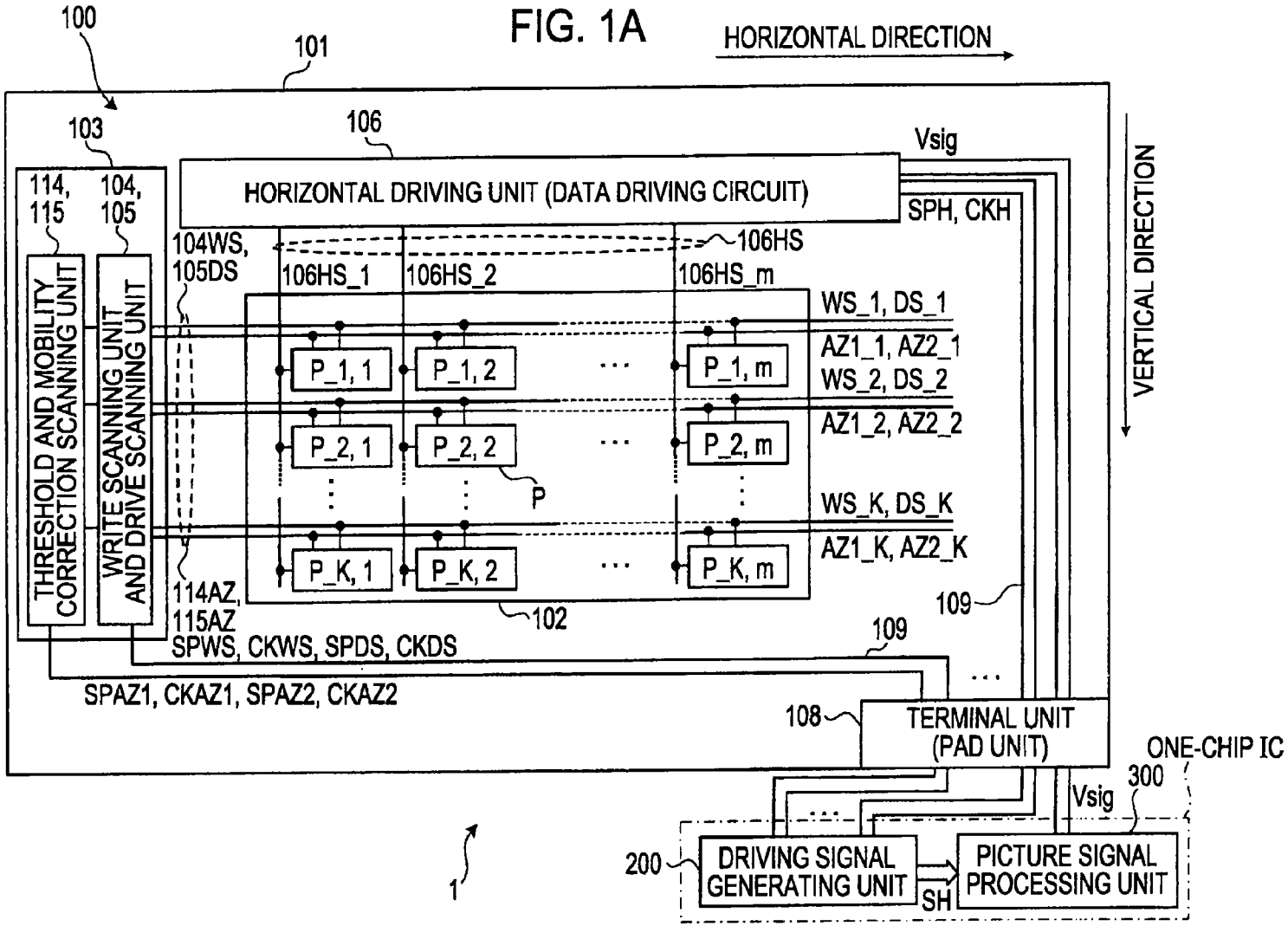
FIG. 1A is a block diagram illustrating the schematic configuration of an active-matrix display device serving as an embodiment of a display device according to the present invention.
Figure 1B:
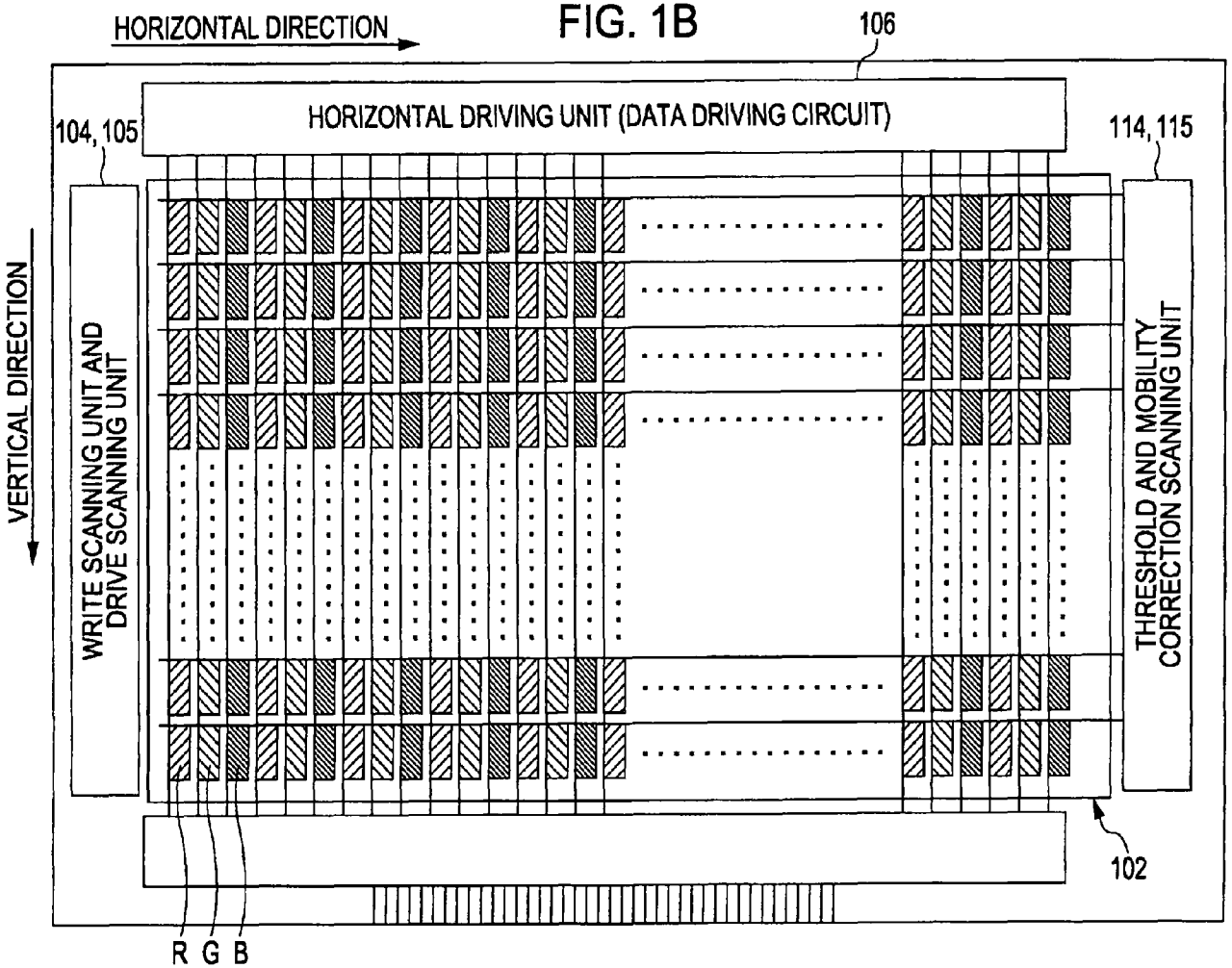
FIG. 1B is a block diagram (in the case of color display mode) illustrating the schematic configuration of an active-matrix display device serving as an embodiment of a display device according to the present invention.

FIGS. 1A and 1B are block diagrams illustrating the schematic configuration of an active matrix display device according to an embodiment of a display device according to the present invention. With the present embodiment, a case will be described as an example wherein an organic EL element as a pixel display element, and a polysilicon thin film transistor (TFT) as an active element are each employed, and the present embodiment is applied to an active matrix organic EL display (hereafter, referred to as an organic EL display device) made up of the organic EL element being formed on a semiconductor substrate where the thin film transistor are formed.

Note that description will be made specifically below with an organic EL element serving as a pixel display element as an example, and the display element to which the present embodiment is applied is not restricted to an organic EL element. In general, all of later-described embodiments can be applied to all of light-emitting elements which emit light by current drive.

As shown in FIG. 1A, an organic EL display device 1 includes a display panel unit 100 where pixel circuits (also referred to as pixels) 110 having an organic EL element (not shown) serving as multiple display elements are disposed so as to configure a valid picture area having an aspect ratio, which is a display aspect ratio of X:Y (e.g., 9:16), a driving signal generating unit 200 which is an example of a panel control unit for outputting various types of pulse signal for drive-controlling the display panel unit 200, and a picture signal processing unit 300. The driving signal generating unit 200 and picture signal processing unit 300 are built in a one-chip IC (Integral Circuit).

Note that as shown in the drawing, the product type is not restricted to being provided as the organic EL display device 1 which is a module (compound component) type including all of the display panel unit 100, driving signal generating unit 200, and picture signal processing unit 300, and rather can be provided as the organic EL display device 1 including the display panel unit 100 alone, for example. Also, such an organic EL display device 1 is employed as the display unit of a portable music player employing a recording medium such as semiconductor memory, mini disc (MD), cassette tape, or the like, and the display unit of the other electronic equipment.

With the display panel unit 100, a pixel array unit 102 where pixel circuits P are arrayed in a matrix form of n rows.times.m columns, a vertical driving unit (also referred to as a vertical scanning unit) 103 for scanning the pixel circuits P in the vertical direction, a horizontal driving unit (also referred to as a horizontal scanning unit, horizontal selector, or data line driving unit) 106 for scanning the pixel circuits P in the horizontal direction, and an external connection terminal unit (pad unit) 108 are formed on the substrate 101 in an integrated manner. That is to say, an arrangement is made wherein peripheral driving circuits such as the vertical driving unit 103, horizontal driving unit 106, and so forth are formed on the same substrate 101 as the pixel array unit 102.

The vertical driving unit 103 includes a buffer transistor at the output stage, which is an example of a control unit for outputting a pulse signal for driving each pixel circuit P of the pixel array unit 102 from the buffer transistor. The vertical driving unit 103 includes, for example, a write scanning unit (write scanner WS) 104, a drive scanning unit (drive scanner DS) 105 (both are shown integrally in the drawing), and two threshold and mobility correction scanning units 114 and 115 (both are shown integrally in the drawing).

The pixel array unit 102 is, as an example, configured to be driven by the write scanning unit 104, drive scanning unit 105, and threshold and mobility correction scan units 114 and 115 from one side of the shown left and right directions or both sides, and also driven by the horizontal driving unit 106 from one side of the shown upper and lower directions or both sides. The terminal unit 108 is configured to be supplied with various types of pulse signal from the driving signal generating unit 200. Also, similarly, the terminal unit 108 is configured to be supplied with a picture signal Vsig from the picture signal processing unit 300.

As an example, necessary pulse signals are supplied as vertical driving pulse signals, such as shift start pulses SPDS and SPWS which are an example of a write start pulse in the vertical direction, vertical scan clocks CKDS and CKWS, and so forth. Also, necessary pulse signals are supplied as pulse signals for correcting a threshold or mobility, such as shift start pulses SPAZ1 and SPAZ2 which are an example of a threshold detection start pulse in the vertical direction, vertical scan clocks CKAZ1 and CKAZ2, and so forth. Also, necessary pulse signals are supplied as horizontal driving pulse signals, such as horizontal start pulse SPH and SPWS which is an example of a write start pulse in the horizontal direction, horizontal scan clock CKH, and so forth.

Each terminal of the terminal unit 108 is configured to be connected to the vertical driving unit 103 and horizontal driving unit 106 via a wiring 109. For example, each pulse supplied to the terminal unit 108 is supplied to each unit of the vertical driving unit 103 and the horizontal driving unit 106 via a buffer following the voltage level of each pulse being internally adjusted at an unshown level shifter unit as necessary.

With the pixel array unit 102, though not shown in the drawing (details will be described later), an arrangement is made wherein the pixel circuits P where a pixel transistor is provided as to an organic EL element serving as a display element are two-dimensionally disposed in a matrix form, a scanning line is wired for each row as to the pixel array thereof, and also a signal line is wired for each column.

For example, the pixel array unit 102 is formed with scanning lines (gate lines) 104WS and 105DS, threshold and mobility correction scanning lines 114AZ and 115AZ, and a signal line (data line) 106HS. An unshown organic EL element, and a thin film transistor (TFT) for driving this element are formed at the crossing portion of both. The pixel circuit P is configured of a combination of the organic EL element and thin film transistor.

Specifically, n rows worth of write scanning lines 104WS_1 through 104WS_n driven with a write driving pulse WS by the write scanning unit 104, n rows worth of drive scanning lines 105DS_1 through 105DS-n driven with a scan driving pulse NDS by the drive scanning unit 105, n rows worth of threshold and mobility correction scanning lines 114AZ_1 through 114AZ_n driven with a threshold and mobility correction pulse AZ1 by the first threshold and mobility correction scanning unit 114, and n rows worth of threshold and mobility correction scanning lines 115AZ_1 through 115AZ_n driven with a threshold and mobility correction pulse AZ2 by the second threshold and mobility correction scanning unit 115 are wired to each pixel circuit P arrayed in a matrix form for each pixel row.

The write scanning unit 104 and drive scanning unit 105 sequentially select each of the pixel circuits P via each of the scanning lines 105DS and 104WS based on the pulse signal of the vertical driving system supplied from the driving signal generating unit 200. The horizontal driving unit 106 writes an image signal in the selected pixel circuit P via the picture signal line 106HS based on the pulse signal of the horizontal driving system supplied from the driving signal generating unit 200.

Each unit of the vertical driving unit 103 scans the pixel array unit 102 in order of lines, and also in sync with this, the horizontal driving unit 106 writes one horizontal line worth of an image signal in order in the horizontal direction (i.e., for each pixel), or one horizontal line worth of an image signal simultaneously in the pixel array unit 102. The former is point sequence drive as a whole, and the latter is line sequence drive as a whole.

In the case of corresponding to the point sequential drive, the horizontal driving unit 106 is configured of a shift register, a sampling switch (horizontal switch), and so forth, and writes the pixel signal input from the picture signal processing unit 300 in each of the pixel circuits P of the row selected by each unit of the vertical driving unit 103 in increments of pixel. That is to say, the horizontal driving unit 106 performs the point sequential drive for writing a picture signal in each of the pixel circuits P of the selected row by vertical scanning in increments of pixel.

On the other hand, in the case of corresponding to the line sequential drive, the horizontal driving unit 106 is configured so as to include a driver circuit for simultaneously turning on unshown switches provided on the picture signal line 106HS of all columns, and simultaneously turns on the unshown switches provided on the picture signal line 106HS of all columns to simultaneously write the pixel signal input from the picture signal processing unit 300 in one row worth of all the pixel circuits P of the row selected by the vertical driving unit 103.

Each unit of the vertical driving unit 103 is configured of a combination of logic gates (including latch), and selects each of the pixel circuits P of the pixel array unit 102 in increments of row. Note that in FIG. 1A, an arrangement is shown wherein the vertical driving unit 103 is disposed only at one side of the pixel array unit 102, but an arrangement may be employed wherein the vertical driving unit 103 is disposed at both sides so as to sandwich the pixel array unit 102.

Similarly, in FIG. 1A, an arrangement is shown wherein the horizontal driving unit 106 is disposed only at one side of the pixel array unit 102, but an arrangement may be employed wherein the horizontal driving unit 106 is disposed at both sides so as to sandwich the pixel array unit 102.

Note that in order to correspond to color image display, with the pixel array unit 102, as shown in FIG. 1B for example, sub pixels G, R, and B wherein one pixel has charge of any of red, green, and blue are arrayed in a stripe form.

Pixel Circuit

First Embodiment

Figure 2:
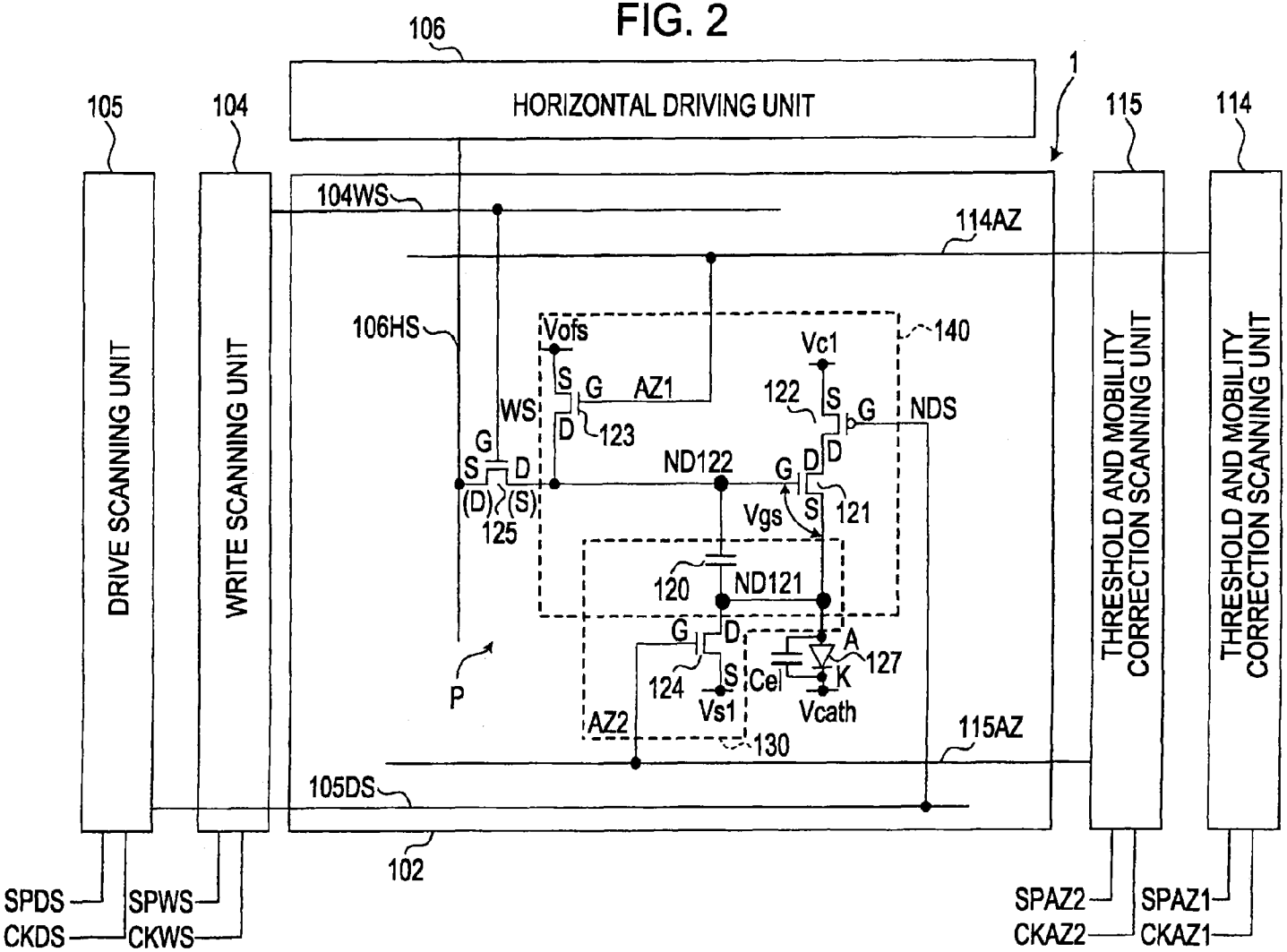
FIG. 2 is a diagram illustrating a first embodiment of a pixel circuit making up an organic EL display device.

FIG. 2 is a diagram illustrating a first embodiment of the pixel circuits P making up the organic EL display device 1 shown in FIGS. 1A and 1B. Note that FIG. 2 also illustrates the vertical driving unit 103 and horizontal driving unit 106 provided on the peripheral portion of the pixel circuits P on the substrate 101 of the display panel unit 100.

Figure 3A:
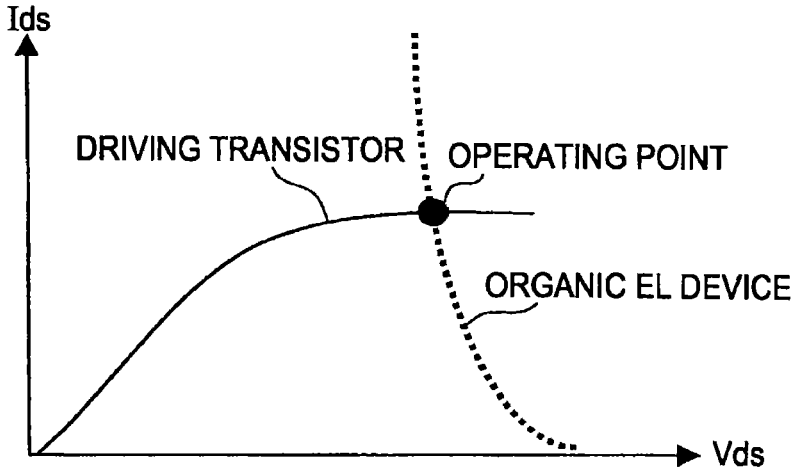
FIG. 3A is a diagram describing operating points of an organic EL device and a driving transistor.
Figure 3B:
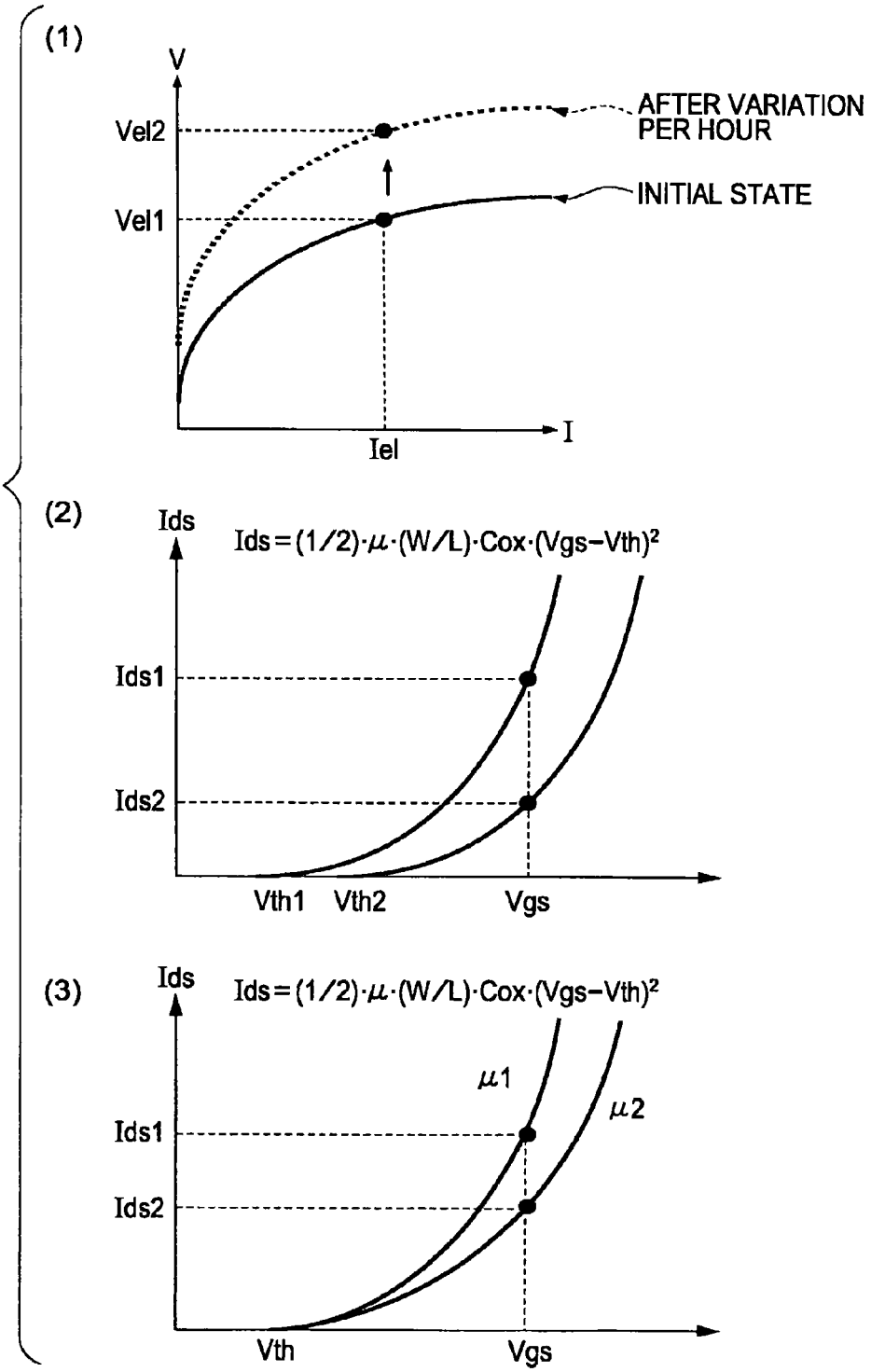
FIG. 3B is a diagram describing influence of the property irregularities of an organic EL device and a driving transistor on a driving current.
Figure 3C:
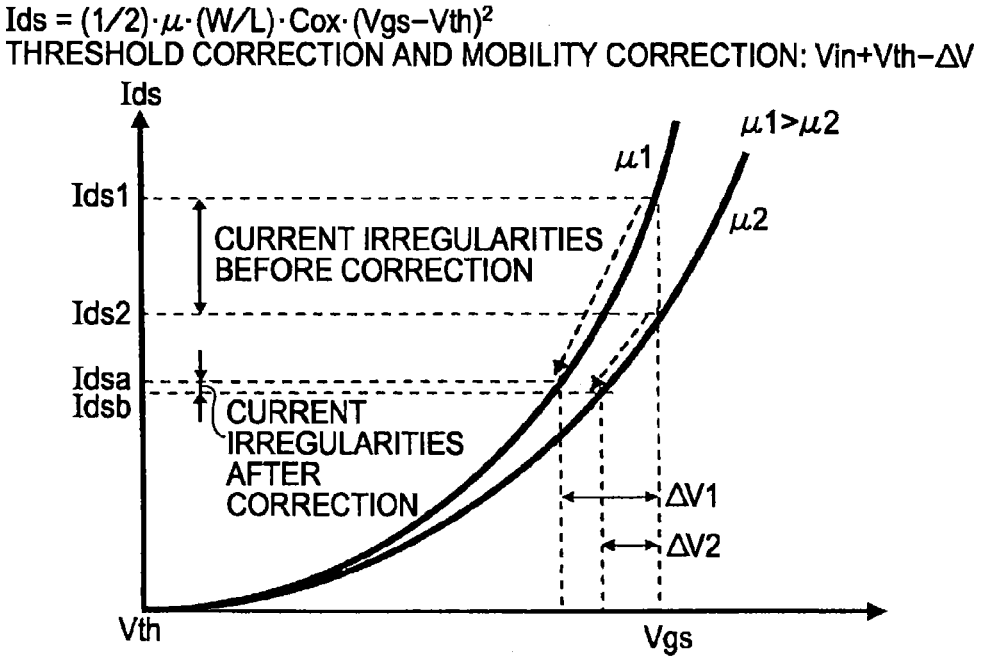
FIG. 3C is a diagram (Part 1) describing the concept of a technique for improving influence of the property irregularities of an organic EL device and a driving transistor on a driving current.
Figure 3D:
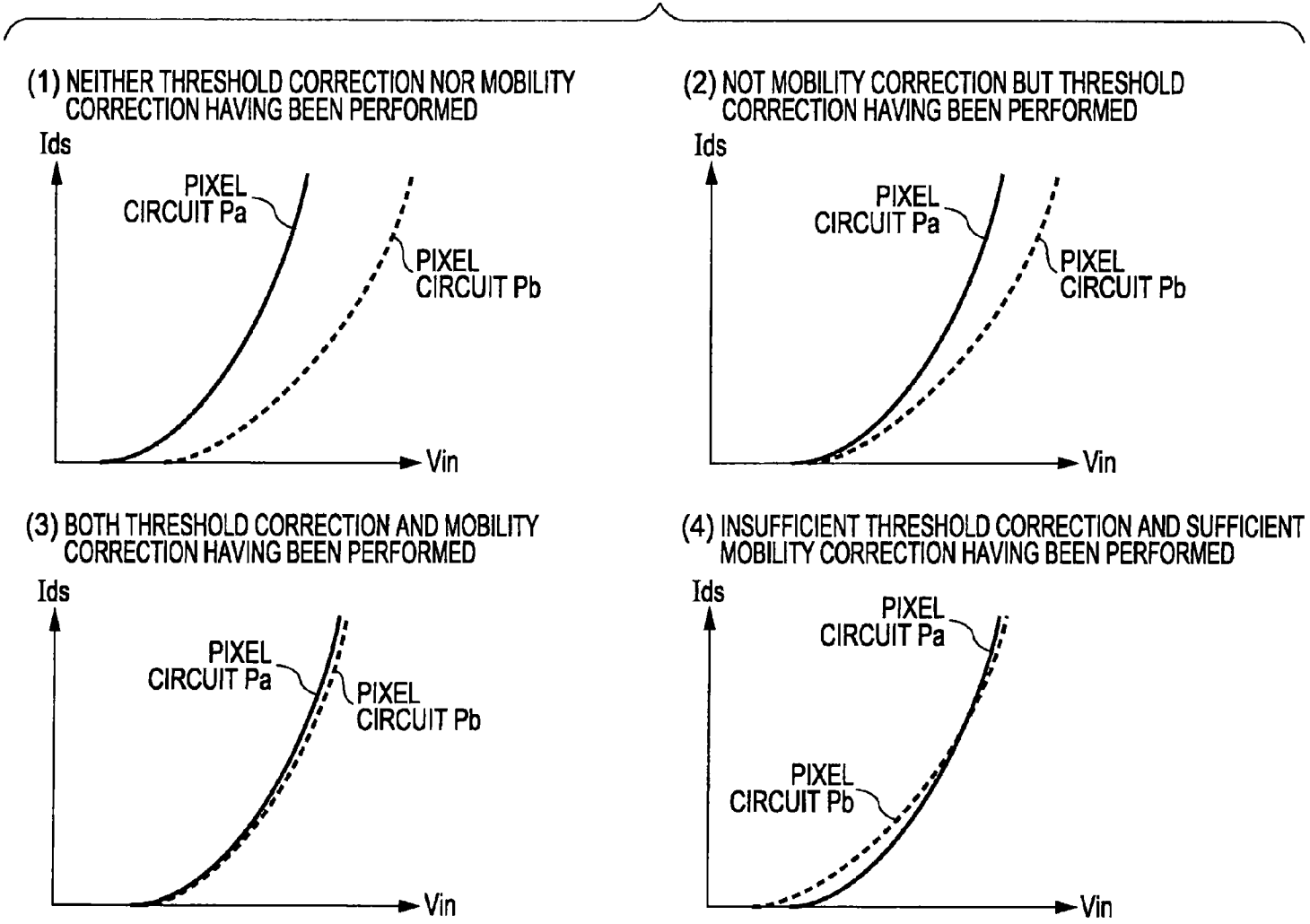
FIG. 3D is a diagram (Part 1) describing the concept of the technique for improving influence of the property irregularities of an organic EL device and a driving transistor on a driving current.

FIG. 3A is a diagram describing the operating points of the organic EL element and driving transistor. FIG. 3B is a diagram describing influence due to the property irregularities of the organic EL device and driving transistor given to a driving current Ids. FIG. 3C and FIG. 3D are diagrams describing the concept of improvement technique thereof.

The pixel circuits P according to the first embodiment shown in FIG. 2 have features in that a driving transistor is basically configured of an n-channel type thin film field-effect transistor, and also in that there are provided a circuit for suppressing fluctuation of the driving current Ids to the organic EL element due to deterioration over time of the organic EL element, i.e., a driving signal stabilizing circuit (Part 1) for realizing a threshold correction function and a mobility correction function for correcting change in current-voltage property of the organic EL element which is an example of an electro-optic element to maintain the driving current Ids constant uniformly. Additionally, there are features in that there is provided a driving signal stabilizing circuit (Part 1) for realizing a bootstrap function for stabilizing a driving current even in the case of the current-voltage property of the organic EL element having change over time.

Note that with the pixel circuits P according to the first embodiment, a p-channel type transistor is employed as a light-emitting control transistor, but such as a later-described second embodiment, an arrangement can be made wherein the p-channel type transistor is changed to a n-channel type transistor so as to drive using the active-high scan driving pulse DS. In this case, all of the switch transistors can be configured of n-channel type transistors, whereby an existing amorphous silicon (a-Si) process can be employed at the time of creating a transistor. Thus, reduction in cost of a transistor substrate can be realized. In this point, with the pixel circuits P according to the first embodiment, a p-channel type is employed as a light-emitting control transistor, which does have disadvantageous aspects.

MOS transistors are employed as the respective transistors including driving transistors. In this case, the gate terminal is taken as the control input terminal, and one of the source terminal and drain terminal is taken as the output terminal, and the other is taken as the output terminal.

The pixel circuits P include a storage-capacitor (also referred to as a pixel capacitor) 120, an n-channel type driving transistor 121, a p-channel type light-emitting control transistor 122 wherein an active-low driving pulse (scan driving pulse NDS) is supplied to the gate terminal G which is the control input terminal, an n-channel type sampling transistor 125 wherein an active-high driving pulse (write driving pulse WS) is supplied to the gate terminal G which is the control input terminal, and an organic EL element 127 which is an example of an electro-optic element (light-emitting element) for emitting light by a current being applied thereto.

The sampling transistor 125 is a switching transistor provided at the gate terminal G (control input terminal) of the driving transistor 121, and the light-emitting control transistor 122 is also a switching transistor.

In general, the organic EL element 127 is represented with the symbol of diode since this rectifying properties. Note that the organic EL element 127 includes a parasitic capacitor (equivalent capacitor) Cel. In the drawing, this parasitic capacitor Cel is shown in parallel with the organic EL element 127.

The pixel circuits P have features in that the light-emitting control transistor 122 is disposed at the drain terminal D side of the driving transistor 121, the storage-capacitor 120 is connected between the gate and source of the driving transistor 121, and also a bootstrap circuit 130 and a threshold and mobility correction circuit 140 are provided. The bootstrap circuit 130 and the threshold and mobility correction circuit 140 are both examples of a driving current fluctuation suppressing unit for suppressing fluctuation of the driving current Ids accompanied with the property fluctuation of the driving transistor 121 or the organic EL element 127 which is an example of an electro-optic element.

The organic EL element 127 is a current light-emitting element, so the gradation of coloring is obtained by controlling the current amount to be applied to the organic EL element 127. Therefore, the current amount to be applied to the organic EL element 127 is controlled by changing the voltage applied to the gate terminal G of the driving transistor 121.

At this time, the bootstrap circuit 130 and the threshold and mobility correction circuit 140 are provided so as not to be influenced due to change over time of the organic EL element 127, and the property irregularities of the driving transistor 121. Thus, the vertical driving unit 103 for driving the pixel circuits P includes two threshold and mobility correction scanning units 114 and 115 in addition to the write scanning unit 104 and drive scanning unit 105.

In the drawing, only one pixel circuit P is illustrated, but as described with FIG. 1A, the pixel circuits P having the same configuration are arrayed in a matrix form. Here, n rows worth of write scanning lines 104WS_1 through 104WS_n driven with a write driving pulse WS by the write scanning unit 104, n rows worth of drive scanning lines 105DS_1 through 105DS_n driven with a scan driving pulse NDS by the drive scanning unit 105, n rows worth of threshold and mobility correction scanning lines 114AZ_1 through 114AZ_n driven with a threshold and mobility correction pulse AZ1 by the first threshold and mobility correction scanning unit 114, and n rows worth of threshold and mobility correction scanning lines 115AZ_1 through 115AZ_n driven with a threshold and mobility correction pulse AZ2 by the second threshold and mobility correction scanning unit 115 are wired to each pixel circuit P arrayed in a matrix form for each pixel row.

The bootstrap circuit 130 includes an n-channel type detecting transistor 124 to which the active-high threshold and mobility correction pulse AZ2 connected to the organic EL element 127 in parallel is supplied, and is configured of the detecting transistor 124 and the storage-capacitor 120 connected between the gate and source of the driving transistor 121. The storage-capacitor 120 is configured so as to also serve as a bootstrap capacitor.

The threshold and mobility correction circuit 140 includes an n-channel type detecting transistor 123 to which the active-high threshold and mobility correction pulse AZ1 is supplied between the gate terminal G of the driving transistor 121 and second power potential Vc2, and is configured of the detecting transistor 123, driving transistor 121, light-emitting transistor 122, and the storage-capacitor 120 connected between the gate and source of the driving transistor 121. The storage-capacitor 120 is configured so as to also serve as a threshold voltage storage-capacitor for holding detected threshold voltage Vth.

With the driving transistor 121, the drain terminal D is first connected to the drain terminal D of the light-emitting control transistor 122. The source terminal S of the light-emitting control transistor 122 is connected to first power potential Vc1. Also, with the driving transistor 121, the source terminal S is directly connected to the anode terminal A of the organic EL element 127. The connection point thereof is assumed to be node ND121. The cathode terminal K of the organic EL element 127 is connected to a ground wiring Vcath (GND)

common to all the pixels for supplying a reference potential, thereby supplying the cathode potential Vcath thereto.

With the sampling transistor 125, the gate terminal G is connected to the write scanning line 104WS from the write scanning unit 104, the source terminal S is connected to the picture signal line 106HS, and the drain terminal D is connected to the gate terminal G of the driving transistor 121. The connection point thereof is assumed to be node ND122. The storage-capacitor 120 is connected between the node ND121 and node ND122. The active-high write driving pulse WS from the write scanning unit 104 is supplied to the gate terminal G of the sampling transistor 125. With the sampling transistor 125, as shown in parenthesis writing in the drawing, the source terminal S and drain terminal D can be inverted, the drain terminal D can be connected to the picture signal line 106HS as the signal input terminal, and the source terminal S can be connected to the gate terminal G of the driving transistor 121 as the signal output terminal.

The detecting transistor 123 is a switching transistor provided at the gate G (control input terminal) side of the driving transistor 121, wherein the source terminal S is connected to a ground potential Vofs which is an example of offset voltage, the drain terminal D is connected to the gate terminal G (node ND122) of the driving transistor 121, and the gate terminal G which is the control input terminal is connected to the threshold and mobility correction scanning line 114AZ. An arrangement is made wherein the potential of the gate terminal G of the driving transistor 121 is connected to the ground potential Vofs which is a fixed potential via the detecting transistor 123 by the detecting transistor 123 being turned on.

The detecting transistor 124 is a switching transistor, wherein the drain terminal D is connected to the node ND121 which is the connection point between the source terminal S of the driving transistor 121 and the anode terminal A of the organic EL element 127, the source terminal S is connected to a ground potential Vs1 which is an example of a reference potential, and the gate terminal G which is the control input terminal is connected to the threshold and mobility correction scanning line 115AZ.

An arrangement is made wherein the storage-capacitor 120 is connected between the gate and source of the driving transistor 121, and the detecting transistor 124 is turned on, whereby the potential of the source terminal S of the driving transistor 121 is connected to the ground potential Vs1 which is a fixed potential via the detecting transistor 124.

The sampling transistor 125 operates at the time of being selected by the write scanning line 104WS, samples (the signal potential Vin of) an image signal Vsig from the picture signal line 106HS, and holds the voltage of the magnitude corresponding to the signal potential Vin in the storage-capacitor 120 via the node ND112. The potential held in the storage-capacitor 120 has ideally the same magnitude as the signal potential Vin, but is actually smaller than that.

The driving transistor 121 current-drives the organic EL element 127 according to the driving potential (voltage Vgs between the gate and source of the driving transistor 121 at that point) held in the storage-capacitor 120 when the light-emitting control transistor 122 is ON, which is caused by the scan driving pulse NDS. The light-emitting control transistor 122 is electrically conducted at the time of being selected by the drive scanning line 105DS to supply a current to the driving transistor 121 from the first power potential Vc1.

Thus, the drain terminal D side which is the power supply terminal of the driving transistor 121 is connected to the first power potential Vc1 via the light-emitting control transistor 122, and the ON period of the light-emitting control transistor 122 is controlled, thereby enabling the light-emitting period and non-light-emitting period of the organic EL element 127 to be adjusted, and enabling duty driving to be performed.

The detecting transistors 123 and 124 operate at the time of both being selected by supplying the active-high threshold and mobility correction pulses AZ1 and AZ2 from the threshold and mobility correction scanning units 114 and 115 to the threshold and mobility correction scanning lines 114AZ and 115AZ, and performs a predetermined correction operation (operation for correcting the irregularities of the threshold voltage Vth or mobility μ).

For example, in order to detect the threshold voltage Vth of the driving transistor 121 before current driving of the organic EL element 127 to cancel the influence thereof beforehand, the detected potential is held in the storage-capacitor 120.

As a condition for assuring the normal operation of the pixel circuit P having such a configuration, the ground potential Vs1 is set lower than the level wherein the threshold voltage Vth of the driving transistor 121 is subtracted from the ground potential Vofs. That is to say, "Vs1<Vofs−Vth" holds. Also, the level wherein the threshold voltage VthEL of the organic EL element 127 is added to the potential Vcath of the cathode terminal K of the organic EL element 127 is set higher than the level wherein the threshold voltage Vth of the driving transistor 121 is subtracted from the ground potential Vs1. That is to say, "Vcath+VthEL>Vs1−Vth" holds. It is desirable to set the level of the ground potential Vofs to close to the lowest level of the pixel signal Vsig supplied from the picture signal line 106HS (range at or below the lowest level).

With the pixel circuit P having such a configuration, the sampling transistor 125 is electrically conducted according to the write driving pulse WS supplied from the write scanning line 104WS during a predetermined signal write period (sampling period), and samples the picture signal Vsig supplied from the picture signal line 106HS to the storage-capacitor 120. The storage-capacitor 120 applies the input voltage (voltage Vgs between the gate and source) between the source and gate of the driving transistor 121 according to the sampled picture signal Vsig.

The driving transistor 121 supplies the output current according to the voltage Vgs between the gate and source to the organic EL element 127 as the driving current Ids during a predetermined light-emitting period. Note that this driving current Ids has dependency as to the carrier mobility μ and threshold voltage Vth of the channel area of the driving transistor 121. The organic EL element 127 is driven to emit light with the brightness corresponding to the picture signal Vsig (particularly, signal potential Vin) by the driving current Ids supplied from the driving transistor 121.

This pixel circuit P includes a correcting unit configured of switching transistors (light-emitting control transistor 122 and detecting transistors 123 and 124), which corrects the voltage Vgs between the gate and source held in the storage-capacitor 120 at the top of a light-emitting period beforehand to eliminate the dependency as to the carrier mobility μ of the driving current Ids.

Specifically, the correcting unit (switching transistors 122, 123, and 124) operates at a part (e.g., later half side) of a signal write period according to the write driving pulse WS and scan driving pulse NDS supplied from the write scanning line 104WS and drive scanning line 105DS, extracts the driving current Ids from the driving transistor 121 in a state in which the picture signal Vsig is sampled, and subjects this to negative feedback to correct the voltage Vgs between the gate and source. Further, in order to eliminate the dependency as to the threshold voltage Vth of the driving current Ids, this correcting unit (switching transistors 122, 123, and 124) detects the threshold voltage Vth of the driving transistor 121 beforehand prior to a signal write period, and also adds the detected threshold voltage Vth to the voltage Vgs between the gate and source.

In particular, with the pixel circuit P according to the present example, the driving transistor 121 is an n-channel type transistor, wherein while the drain is connected to the positive power supply side, the source is connected to the organic EL element 127 side. In this case, the above-mentioned correcting unit extracts the driving current Ids from the driving transistor 121 at the top portion of a light-emitting period overlapped with a later portion of the signal write period, and subjects this to negative feedback to the storage-capacitor 120 side.

At that time, the correcting unit P is configured such that the driving current Ids extracted from the source terminal S side of the driving transistor 121 at the top portion of the light-emitting period flows to the parasitic capacitor Cel included in the organic EL element 127. Specifically, the organic EL element 127 is a diode-type light-emitting element including an anode terminal A and cathode terminal K, wherein while the anode terminal A side is connected to the source terminal S of the driving transistor 121, the cathode terminal K side is connected to the ground side (cathode potential Vcath, in the present example).

According to this arrangement, with the correcting unit (switching transistors 122, 123, and 124), between the anode and cathode of the organic EL element 127 is set to a reverse bias state beforehand, and when the driving current Ids extracted from the source terminal S side of the driving transistor 121 flows to the organic EL element 127, the diode-type organic EL element 127 is served as a capacitive element.

Note that with the correcting unit, time width t necessary for extracting the driving current Ids from the driving transistor 121 within the signal write period can be adjusted, and it is desirable to optimize the negative feedback amount of the driving current Ids as to the storage-capacitor 120.

Now, the terms "optimize the negative feedback amount" means to suitably set the phase difference between the write driving pulse WS and scan driving pulse NDS, and further preferably, enable mobility correction to be suitably performed even in any level within a range from a black level to a white level of a picture signal potential. The negative feedback amount applied to the voltage Vgs between the gate and source depends on the extraction time of the driving current Ids, so the longer the extraction time is, the greater the negative feedback amount is.

With regard to the pixel circuit and driving timing, there are various types of techniques, and various types of techniques can be taken as the technique at the time of "optimizing the negative feedback amount" according to those. For example, the voltage change property of the picture signal line 106HS which is a picture line signal potential, or the voltage change property of the write scanning line 104WS (i.e., transition property of the write driving pulse WS) is inclined, whereby the mobility correction period is caused to automatically follow the magnitude of the picture line signal potential, and the optimization thereof is realized. According to those, the mobility correction period can be determined even with the potential of the picture signal line 106HS, and a mobility correction parameter ΔV can be represented with ΔV=IdsCel/t.

As can be clearly understood from the expression of the mobility correction parameter ΔV, the greater the driving current Ids which is the current between the drain and source of the driving transistor 121, the greater the mobility correction parameter ΔV is. Conversely, the smaller the driving current Ids which is the current between the drain and source of the driving transistor 121, the smaller the mobility correction parameter ΔV is. Thus, the mobility correction parameter ΔV is determined according to the driving current Ids. At this time, the mobility correction period is not necessarily steady, and conversely, it is desirable to adjust the mobility correction period depending on the driving current Ids in some cases. For example, in the case of the driving current Ids being great, the mobility correction period is desired to be shortened, and conversely in the case of the driving current Ids being small, the mobility correction period is desired to be lengthened.

For example, the leading or trailing of the picture signal line potential (potential of the picture signal line 106HS) is inclined, or the change property of the write scanning line potential (particularly, the side for turning off the sampling transistor) is inclined, whereby a correction period t is automatically adjusted so as to be shortened when the potential of the picture signal line 106HS is high (when the driving current Ids is great), or so as to be lengthened when the potential of the picture signal line 106HS is low (when the driving current Ids is small). Thus, a suitable correction period can be automatically set by following the picture signal potential (signal potential Vin of the picture signal Vsig), whereby optimal mobility correction can be performed regardless of the brightness and pattern of an image. Both can be used together depending on the pixel circuit P or driving timing.

<Basic Operation>

First, as a comparative example to describe the features of the pixel circuit P according to the first embodiment, description will be made regarding an operation in the case wherein the light-emitting control transistor 122, detecting transistor 123, and detecting transistor 124 are not provided, and with the storage-capacitor 120, one of the terminals is connected to the node ND122, and the other terminal is connected to the ground wiring Vcath (GND) common to all pixels. Hereafter, such a pixel circuit P is referred to as the pixel circuit P according to the comparative example.

With the pixel circuit P according to the comparative example, the potential of the source terminal S (source potential Vs) of the driving transistor 121 is determined with the operating point between the driving transistor 121 and organic EL element 127, and the voltage value thereof differs depending on the gate potential Vg of the driving transistor 121.

In general, as shown in FIG. 3A, the driving transistor 121 is driven in a saturation area. Accordingly, if we say that the current flowing between the drain terminal and source terminal of a transistor which operates in a saturation area is Ids, mobility is μ, channel width (gate width) is W, channel length (gate length) is L, gate capacity (gate oxide capacity per unit area) is Cox, and the threshold voltage of the transistor is Vth, the driving transistor 121 is a constant current source having the value shown in the following Expression (1). Note that " " denotes exponentiation. As can be clearly understood from Expression (1), with a saturation area, the drain current Ids of a transistor is controlled by the voltage Vgs between the gate and source, and is operated as a constant current source.

$$Ids = \frac{1}{2}\mu\frac{W}{L}Cox(Vgs - Vth)\text{^}2 \quad (1)$$

<Iel-Vel Property and I-V Property of Light-Emitting Element>

With the current-voltage (Iel-Vel) property of a current-driven light-emitting element represented with the organic EL element shown in (1) in FIG. 3B, a curve shown in a solid line indicates the property at the time of an initial state, and a curve shown in a dashed line indicates the property after change over time. In general, the I-V property of a current-driven light-emitting element including an organic EL element deteriorates over time, as shown in the graph.

For example, when a light-emitting current Iel flows to the organic EL element 127 which is an example of light-emitting elements, the voltage Vel between the anode and cathode thereof is uniquely determined. As shown in (1) in FIG. 3B, during a light-emitting period, the light-emitting current Iel determined by the current Ids between the drain and source (=driving current Ids) of the driving transistor 121 flows to the anode terminal A of the organic EL element 127, which increases the voltage between the anode and cathode by the voltage Vel between the anode and cathode.

With the pixel circuit P according to the comparative example, the voltage Vel between the anode and cathode as to the same light-emitting current Iel changes from Vel1 to Vel2 according to change over time of the I-V property of the organic EL element 127, which causes the operating point of the driving transistor 121 to change, causes the sour potential Vs of the driving transistor 121 to change even if the same gate potential Vg is applied thereto, and consequently, causes the voltage Vgs between the gate and source of the driving transistor 121 to change.

With a simple circuit employing an n-channel type as the driving transistor 121, the source terminal S is connected to the organic EL element 127 side, which causes the I-V property of the organic EL element 127 to be influenced by change over time, which causes the current amount (light-emitting current Iel) flowing to the organic EL element 127 to change, and consequently, light-emitting brightness changes.

Specifically, with the pixel circuit P according to the comparative example, the operating point changes due to change over time of the I-V property of the organic EL element 127, and the source potential Vs of the driving transistor 121 changes even if the same gate potential Vg is applied thereto. Thus, the voltage Vgs between the gate and source of the driving transistor 121 changes. As can be clearly understood from property Expression (1), upon the voltage Vgs between the gate and source fluctuating, the driving current Ids fluctuates even if the gate potential Vg is steady, and the value of a current flowing to the organic EL element 127 changes simultaneously. Thus, upon the I-V property of the organic EL element 127 changing, the light-emitting brightness of the organic EL element 127 changes over time with the pixel circuit P according to the comparative example.

With a simple circuit employing an n-channel type as the driving transistor 121, the source terminal S is connected to the organic EL element 127 side, which causes the voltage Vgs between the gate and source to change over time of the organic EL element 127, which causes the current amount flowing to the organic EL element 127 to change, and consequently, light-emitting brightness changes.

The anode potential fluctuation of the organic EL element 127 due to the property fluctuation over time of the organic EL element 127 which is an example of light-emitting elements appears as fluctuation of the voltage Vgs between the gate and source of the driving transistor 121, which causes fluctuation of the drain current (driving current Ids). Fluctuation of the driving current due to this cause appears as the irregularities of light-emitting brightness for each pixel circuit P, which causes image quality deterioration.

On the other hand, the details will be described later, at a point where the information corresponding to the signal potential Vin is written in the storage-capacitor 120 (continuously during the light-emitting period of the organic EL element 127 thereafter), a bootstrap operation is activated, which drives a circuit configuration for realizing a bootstrap function for linking between fluctuation of the potential Vs of the source terminal S of the driving transistor 121 and potential Vg of the gate terminal G thereof by setting the sampling transistor 125 to a non-electroconductive state.

Thus, even if there is anode potential fluctuation (i.e., source potential fluctuation) of the organic EL element 127 due to the property fluctuation over time of the organic EL element 127, the gate potential Vg fluctuate so as to cancel the fluctuation thereof, whereby the uniformity of screen brightness can be ensured. According to the bootstrap function, the fluctuation over time correction performance of a current-driven light-emitting element with an organic EL element as a representative can be improved.

This bootstrap function can be started at a light-emitting start point where the write driving pulse WS is switched to an inactive-low state, and the sampling transistor 125 is turned off, thereafter the light-emitting current Iel begins to flow to the organic EL element 127, and during a process where the voltage Vel between the anode and cathode increases until the voltage Vel between the anode and cathode stabilizes, this function works even in the case of the source potential Vs of the driving transistor 121 fluctuating due to fluctuation of the voltage Vel between the anode and cathode.

<Vgs-Ids Property of Driving Transistor>

Also, according to the manufacturing process irregularities of the driving transistor 121, there is caused property fluctuation such as threshold voltage and mobility and so forth for each pixel circuit P. In the case of driving the driving transistor 121 in a saturation area also, according to this property fluctuation, even if the same gate potential is applied to the driving transistor 121, the drain current (driving current Ids) fluctuates for each pixel circuit P, which appears as light-emitting brightness irregularities.

For example, (2) in FIG. 3B illustrates voltage-current (Vgs-Ids) property focusing attention on the threshold irregularities of the driving transistor 121. Property curves are shown in the drawing regarding the two driving transistors 121 of which the threshold voltage differs, such as Vth1 and Vth2.

As described above, the drain current Ids when the driving transistor 121 operates in a saturation area is represented with property Expression (1). As can be clearly understood from property Expression (1), upon the threshold voltage Vth fluctuating, the drain current Ids fluctuates even if the voltage Vgs between the gate and source is steady. That is to say, if the irregularities of the threshold voltage Vth is left as it is, as shown in (2) in FIG. 3B, while the driving current corresponding to the Vgs is Ids1 when the threshold voltage is Vth1, the driving current corresponding to the same gate voltage Vgs is Ids2 when the threshold voltage is Vth2, which differs from Ids1.

Also, (3) in FIG. 3B illustrates voltage-current (Vgs-Ids) property focusing attention on the mobility irregularities of the driving transistor 121. Property curves are shown in the drawing regarding the two driving transistors 121 of which the mobility differs, such as $\mu 1$ and $\mu 2$.

As can be clearly understood from property Expression (1), upon the mobility $\mu$ fluctuating, the drain current Ids fluctuates even if the voltage Vgs between the gate and source is steady. That is to say, if the irregularity of the mobility $\mu$ is left as it is, as shown in (3) in FIG. 3B, while the driving current corresponding to the Vgs is Ids1 when the mobility is $\mu 1$, the driving current corresponding to the same gate voltage Vgs is Ids2 when the mobility is $\mu 2$, which differs from Ids1.

As shown in (2) and (3) in FIG. 3B, if there is a great difference regarding the Vin-Ids property due to the difference of the threshold voltage Vth or mobility μ, the driving current Ids, i.e., light-emitting brightness differs even if the same signal potential Vin is applied to the transistors, and accordingly, uniformity of screen brightness cannot be obtained.

<Concept of Threshold Correction and Mobility Correction>

On the other hand, driving timing for realizing the threshold correction function and mobility correction function (details will be described later) is employed, whereby influence of such fluctuation can be suppressed, and uniformity of screen brightness can be ensured.

With the threshold correction operation and mobility correction operation of the present embodiment, though the details will be described later, the voltage Vgs between the gate and source at the time of emitting light is arranged to be represented with "Vin+Vth−ΔV", thereby preventing the current Ids between the drain and source from depending on the irregularities and fluctuation of the threshold voltage Vth, and also from depending on the irregularities and fluctuation of the mobility μ. Consequently, even if the threshold voltage Vth or mobility μ fluctuates due to a manufacturing process or over time, the driving current Ids does not fluctuate, and the light-emitting brightness of the organic EL element 127 does not fluctuate.

For example, FIG. 3C is a graph describing the operating point of the driving transistor 121 at the time of the mobility correction. If the irregularities of the mobility μ1 and μ2 at the time of a manufacturing process or over time are subjected to threshold correction or mobility correction which enables the voltage Vgs between the gate and source at the time of emitting light to be represented with "Vin+Vth−ΔV", first from the perspective of mobility, a mobility correction parameter ΔV1 is determined as to the mobility μ1, and a mobility correction parameter ΔV2 is determined as to the mobility μ2.

Thus, a suitable mobility correction parameter is determined as to any mobility, so the driving current Idsa at the time of the mobility μ1 and the riving current Idsb at the time of the mobility μ2 of the driving transistor 121 are determined. Though there are great current irregularities before the mobility correction, the current irregularities become small due to mobility correction, and the difference of the mobility μ is suppressed. In an optimal state, "Idsa=Idsb" can be held, and the difference of the mobility μ can be eliminated (cancelled out).

If the current irregularities are not subjected to the mobility correction, as shown in (3) in FIG. 3A, when the mobility differs, such as μ1 and μ2, as to the voltage Vgs between the gate and source, the driving current Ids also greatly differs according to this, such as Ids1 and Ids2. In order to handle this, suitable mobility correction parameters ΔV1 and ΔV2 are applied to the mobility μ1 and μ2 respectively, whereby the driving current Ids becomes Idsa and Idsb, and each of the mobility correction parameters ΔV1 and ΔV2 are optimized, whereby the driving current Idsa and Idsb after the mobility correction can be approximated, and can be set to the same level in the optimal state.

At the time of the mobility correction, as can be clearly seen from the graph in FIG. 3C, while the great mobility μ1 is subjected to negative feedback so as to increase the mobility correction parameter ΔV1, the small mobility μ2 is subjected to negative feedback so as to decrease the mobility correction parameter ΔV2. In this sense, the mobility correction parameter ΔV is also referred to as negative feedback amount ΔV.

Also, each drawing in FIG. 3D illustrates the relations between the signal potential Vin and driving current Ids from the perspective of the threshold correction. For example, in each drawing in FIG. 3D, the signal potential Vin is taken as the horizontal axis, and the driving current Ids is taken as the vertical axis, and the current-voltage property of the driving transistor 121 is illustrated regarding a pixel circuit Pa (solid line curve) configured of the driving transistor 121 wherein the threshold voltage Vth is relatively low, and the mobility μ is relatively great, and a pixel circuit Pb (dotted line curve) configured of the driving transistor 121 wherein the threshold voltage Vth is relatively high, and the mobility μ is relatively small, which are illustrated as property curves.

(1) in FIG. 3D is a case wherein neither the threshold correction nor the mobility correction is executed. In this case, the correction regarding the threshold voltage Vth and mobility μ is not executed at the pixel circuit Pa and pixel circuit Pb at all, so the difference regarding the threshold voltage Vth and mobility μ causes great difference in the Vin-Ids property. Accordingly, even if the same signal potential Vin is applied to both circuits, the driving current Ids, i.e., light-emitting brightness differs, and consequently, uniformity of screen brightness cannot be obtained.

(2) in FIG. 3D is a case wherein while the threshold correction is executed, the mobility correction is not executed. In this case, the difference of the threshold voltage Vth is cancelled at the pixel circuit Pa and pixel circuit Pb. Note however, the difference of the mobility μ appears as is. Accordingly, with an area where the signal potential Vin is high (i.e., an area where brightness is high), the difference of mobility μ appears markedly, the brightness differs even with the same gradation. Specifically, with the same gradation (same signal potential Vin), the brightness (driving current Ids) of the pixel circuit Pa of which the mobility μ is great is high, and the brightness of the pixel circuit Pb of which the mobility μ is small is low.

(3) in FIG. 3D is a case wherein both the threshold correction and the mobility correction are executed. In this case, the difference regarding the threshold voltage Vth and mobility μ is completely corrected, and as a result thereof the Vin-Ids properties of the pixel circuit Pa and pixel circuit Pb are matched. Accordingly, the brightness (Ids) becomes the same level at all of gradations (signal potential Vin), so uniformity of screen brightness is markedly improved.

(4) in FIG. 3D is a case wherein both the threshold correction and the mobility correction are executed, but the correction of the threshold voltage Vth is insufficient. For example, an example thereof is a case wherein the voltage equivalent to the threshold voltage Vth of the driving transistor 121 cannot be held in the storage-capacitor 120 with one-time threshold correction operation. At this time, the difference of the threshold voltage Vth is not eliminated, so the difference appears on the brightness (driving current Ids) at a low-gradation area of the pixel circuit Pa and pixel circuit Pb. Accordingly, in the case of the correction of the threshold voltage Vth being insufficient, unevenness of brightness appears at a low gradation, which impairs image quality.

Operation of Pixel Circuit

First Embodiment

Figure 4:
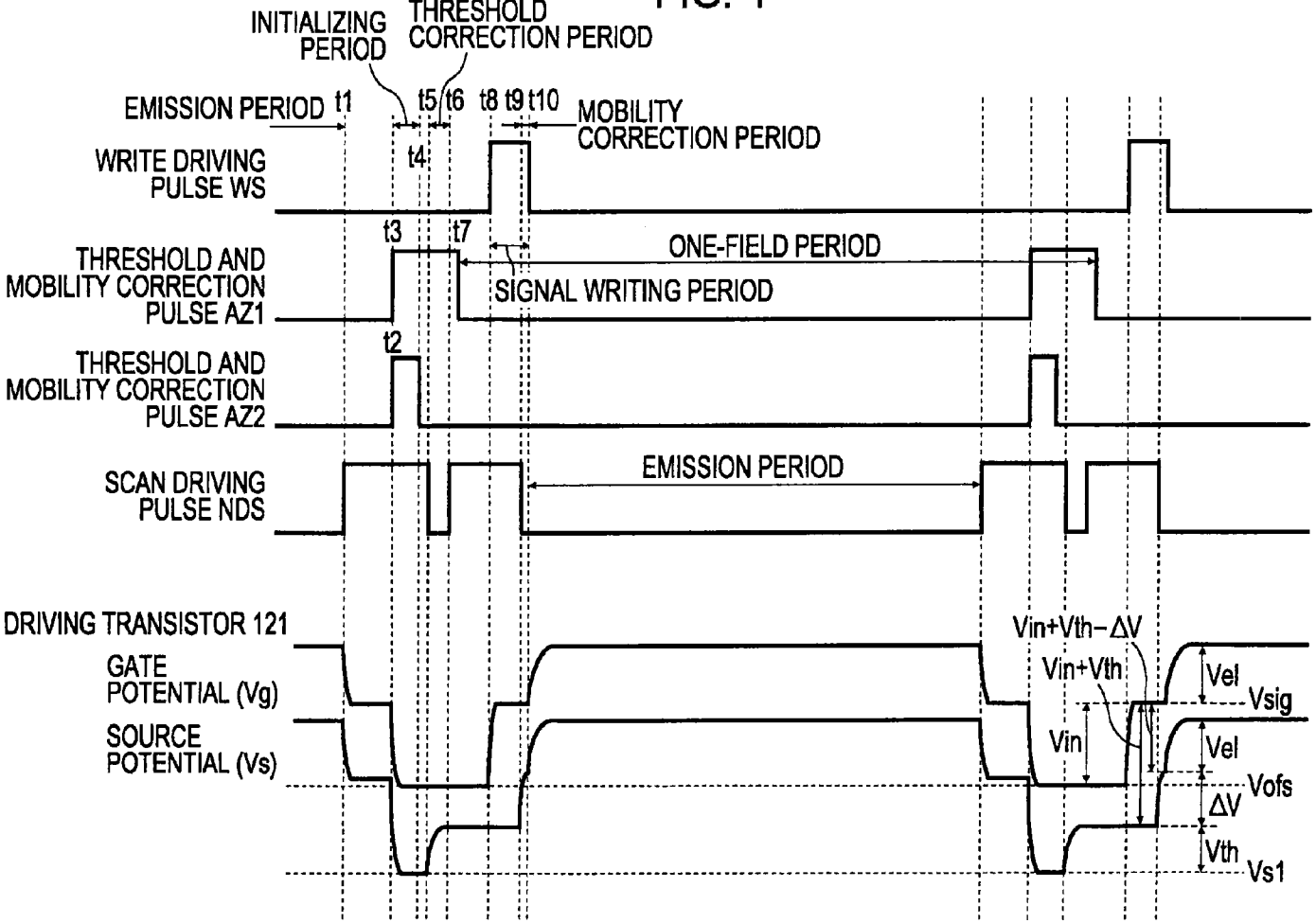
FIG. 4 is a timing chart describing the operation of a pixel circuit according to a first embodiment.

FIG. 4 is a timing chart describing the operation of the pixel circuit P according to the first embodiment. In FIG. 4, the waveforms of the write driving pulse WS, threshold and mobility correction pulses AZ1 and AZ2, and scan driving pulse NDS are represented along a time axis t. As can be understood from the above description, the switching transistors 123, 124, and 125 are n-channel types, so are turned on when the respective pulses WS, AZ1, and AZ2 are in a high-level state, and turned off when the pulses are in a low-level state. On the other hand, the light-emitting control transistor 122 is a p-channel type, so is turned off when the scan driving pulse NDS is in a high-level state, and turned on when the pulse is in a low-level state. Note that this timing chart also represents the potential change of the gate terminal G and the potential change of the source terminal S of the driving transistor 121 as well as the waveforms of the respective pulses WS, AZ1, AZ2, and DS.

With the pixel circuit P, in a usual light-emitting state, the scan driving pulse NDS alone output from the drive scanning unit 105 is in an active-low state, and the write driving pulse WS and threshold and mobility correction pulses AZ1 and AZ2 each output from the write scanning unit 104 and threshold and mobility correction scanning units 114 and 115 are in an inactive-low state, which is a state wherein the light-emitting control transistor 122 alone is turned on.

Each row of the pixel array unit 102 is sequentially scanned one during one field. At the previous period before this field starts all of the pulses WS, AZ1, AZ2, and DS are in a low-level state. Accordingly, while the n-channel type switching transistors 123, 124, and 125 are in an OFF state, the p-channel type light-emitting control transistor 122 alone is in an ON state.

Accordingly, the driving transistor 121 is connected to the first power potential Vc1 via the light-emitting control transistor 122 which is in an ON state, so supplies the driving current Ids to the organic EL element 127 according to the predetermined voltage Vgs between the gate and source. Accordingly, the organic EL element 127 emits light at or before timing t1. At this time, the voltage Vgs between the gate and source applied to the driving transistor 121 is represented with the difference between the gate potential Vg and source potential Vs.

At this time, the driving transistor 121 is set so as to be operated in a saturation area, so if we say that the current flowing between the drain terminal and source terminal of the transistor which operates in a saturation area is Ids, mobility is μ, channel width is W, channel length is L, gate capacity is Cox, the threshold voltage of the transistor is Vth, in principle, the driving transistor 121 is a constant supply source having the value shown in Expression (1).

At timing t1 wherein a new field begins, the scan driving pulse NDS is switched from in a low-level state to high-level state (t1). Accordingly, upon entering timing t1, all of the switching transistors 122 through 125 are turned off. Thus, the light-emitting control transistor 122 is turned off, and the driving transistor 121 is isolated from the first power supply potential Vc1, so the gate voltage Vg and source voltage Vs drop, and light emitting of the organic EL element 127 stops and enters a non-light-emitting period.

Next, the detecting transistors 123 and 124 are turned on by setting the threshold and mobility correction pulses AZ1 and AZ2 to an active-high state in order (t2), following which the detecting transistor 123 side alone is turned off by setting the threshold and mobility correction pulse AZ2 to an inactive-low state while keeping the threshold and mobility correction pulse AZ2 in an active-high state (t4). Note that either of the detecting transistors 123 and 124 may be turned on first. Thus, current is prevented from flowing to the organic EL element 127, and the organic EL element 127 is set to a non-light-emitting state. The example shown in the drawing illustrates a state wherein both are turned on almost simultaneously.

At this time, with the driving transistor 121, the source potential Vs of the driving transistor 121 is initialized by the ground potential Vs1 being supplied to the source terminal S via the detecting transistor 124, and further, the gate potential Vg of the driving transistor 121 is initialized by the ground potential Vofs being supplied to the gate terminal G via the detecting transistor 123 (t2 through t4).

Thus, the potential difference of both terminals of the storage-capacitor 120 connected between the gate and source of the driving transistor 121 is set to be at or above the threshold voltage Vth of the driving transistor 121. At this time, the voltage Vgs between the gate and source of the driving transistor 121 takes a value "Vofs−Vs1", but the condition "Vs1<Vofs−Vth" has been set, so the driving transistor 121 maintains the ON state, and the current Ids1 according thereto is applied thereto.

Now, in order to cause the organic EL element 127 to be in a non-light-emitting state, it is necessary to realize the relation of Vcath+VthEL>Vs2−Vth, i.e., to set the voltage of the ground potentials Vofs and Vs1 such that the voltage Vel (=Vs1−Vth) applied to the anode terminal A of the organic EL element 127 is smaller than the sum of the threshold voltage VthEL and cathode voltage Vcath of the organic EL element 127. Thus, the organic EL element 127 goes to a reverse bias state, which is smaller than the current of the driving transistor 121, and goes to a non-light-emitting state.

Accordingly, the drain current Ids1 of the driving transistor 121 flows to the ground potential Vs1 from the first power supply potential Vc1 via the detecting transistor 124 which is in an ON state. Also, a condition "Vofs−Vs1=Vgs>Vth" is set, thereby performing the preparation for the irregularities correction of the threshold voltage Vth to be performed at timing t5 thereafter. In other words, the periods t2 through t5 are equivalent to the reset period (initializing period) of the driving transistor 121 or the preparation period for the mobility correction.

Also, with regard to the threshold voltage VthEL of the organic EL element 127, VthEL>Vs1 has been set. Thus, minus bias is applied to the organic EL element 127, and the organic EL element 127 goes to a so-called reverse bias state. This reverse bias state is necessary for operating the later-performed irregularities correction of the threshold voltage Vth and the later-performed irregularities correction of the carrier mobility μ normally.

Next, the threshold and mobility correction pulse AZ2 is set to an inactive-low state (t4), almost simultaneous therewith (delayed somewhat) the scan driving pulse NDS is set to an active-low state (t5). Thus, while the detecting transistor 124 is turned off, the light-emitting control transistor 122 is turned on. As a result thereof, the driving current Ids flows to the storage-capacitor 120, and the stage enters a threshold correction period for correcting (canceling) the threshold voltage Vth of the driving transistor 121.

The gate terminal G of the driving transistor 121 is held in the ground potential Vofs, and the driving current Ids flows until the source potential Vs of the driving transistor 121 increases up to cutoff. Upon the driving transistor 121 cutting off, the source potential Vs of the driving transistor 121 becomes "Vofs−Vth".

That is to say, the equivalent circuit of the organic EL element 127 is represented with a parallel circuit of a diode and the parasitic capacitor Cel, so as long as "Vel.ltoreq.Vcath+VthEL" holds, i.e., as long as the leak current of the organic EL element 127 is considerably smaller than the current flowing to the driving transistor 121, the current of the driving transistor 121 is employed for charging the storage-capacitor 120 and parasitic capacitor Cel.

As a result thereof, upon the current path of the drain current Ids flowing to the driving transistor 121 being cut off, the voltage Vel of the anode terminal A of the organic EL element 127, i.e., the potential of the node ND121 increases over time. Subsequently, upon the potential difference between the potential (source voltage Vs) of the node ND121 and the voltage (gate voltage Vg) of the node ND122 just reaching the threshold voltage Vth, the driving transistor 121 is changed to an OFF state from an ON state, the drain current stops flowing, and thus, the threshold correction period ends. That is to say, following fixed time elapsing, the voltage Vgs between the gate and source of the driving transistor 121 takes a value such as the threshold voltage Vth.

At this time, the condition "Vel=Vofs−Vth.ltoreq.Vcath+VthEL" has been set. That is to say, the potential difference appeared between the node ND121 and node ND122=threshold voltage Vth is held in the storage-capacitor 120. Thus, the respective detecting transistors 123 and 124 operate at the time of being selected at suitable timing by the threshold and mobility correction scanning lines 114AZ and 115AZ respectively, detect the threshold voltage Vth of the driving transistor 121, and hold this in the storage-capacitor 120.

The scan driving pulse NDS is switched to an inactive-high state (t6), and further the threshold and mobility correction pulse AZ1 is switched to an inactive-low state (t7) in this order, whereby the light-emitting control transistor 122 and detecting transistor 123 are turned off in order, whereby the threshold cancel operation ends. The light-emitting control transistor 122 is turned off prior to the detecting transistor 123, whereby fluctuation of the voltage Vg of the gate terminal G of the driving transistor 121 can be suppressed.

Note that even after threshold cancel (Vth correction period) elapses, the detected threshold voltage Vth of the driving transistor 121 is held in the storage-capacitor 120 as a potential for correction. Thus, the timing t5 through t6 are periods for detecting the threshold voltage Vth of the driving transistor 121. Here, the detection periods t5 through t6 are referred to as a threshold correction period.

Here, a case wherein the threshold correction operation is performed once alone is illustrated, but this is not indispensable. For example, an arrangement may be made wherein one horizontal period is taken as a processing cycle, and the threshold correction operation is repeatedly performed multiple times. Usually, a threshold correction period is shorter than one horizontal period. Accordingly, a case may be caused due to various causes wherein the correct voltage corresponding to the threshold voltage Vth cannot be held in the storage-capacitor 120 during this short one-time threshold correction operation period. In order to eliminate this problem, it is desirable to repeat the threshold correction operation multiple times. Though drawing regarding the timing thereof will be omitted here, the threshold correction operation is performed repeatedly with multiple horizontal cycles prior to sampling (signal writing) of the signal potential Vin to the storage-capacitor 120, whereby the voltage equivalent to the threshold voltage Vth of the driving transistor 121 is held in the storage-capacitor 120 in a sure manner.

Next, the write driving pulse WS is set to an active-high state, the sampling transistor 125 is turned on, and the pixel signal Vsig for the storage-capacitor 120 is written therein (also referred to as "sampling period") (t8 through t10). Such sampling of the picture signal Vsig is performed until timing t10 wherein the write driving pulse WS returns to an inactive-low state. That is to say, timing t8 through t10 are referred to as a signal write period (hereafter, also referred to as a sampling period). Usually, a sampling period is set to one horizontal period (1H).

With this sampling period (t8 through t10), the signal potential Vin of the pixel signal Vsig is supplied to the gate terminal G of the driving transistor 121, whereby the gate voltage Vg is taken as the driving potential corresponding to the signal potential Vin. The ratio of the magnitude of information to be written in the storage-capacitor 120, corresponding to the signal potential Vin is referred to as a write gain Ginput. At this time, the pixel signal Vsig is held in a manner of being added to the threshold voltage Vth of the driving transistor 121. As a result thereof, fluctuation of the threshold voltage Vth of the driving transistor 121 is constantly cancelled, which is equivalent to performing threshold correction.

The voltage Vgs between the gate and source of the driving transistor 121, i.e., the driving potential to be written in the storage-capacitor 120 is determined by the storage-capacitor 120 (capacity value Cs), the parasitic capacitor Cel (capacity value Cel) of the organic EL element 127, and the parasitic capacitor (capacity value Cgs) between the gate and source, such as shown in Expression (2). The driving current Ids is basically determined with the signal potential Vin of the picture signal Vsig. In other words, the organic EL element 127 emits light with brightness according to the signal potential Vin.

$$Vgs = \frac{Cel}{Cel + Cs + Cgs}(Vsig - Vofs) + Vth \tag{2}$$

Note however, in general, the parasitic capacitor Cel is far greater than the capacity value Cs of the storage-capacitor 120 and the parasitic capacity value Cgs, i.e., the storage-capacitor 120 is sufficiently small as compared with the parasitic capacitor (equivalent capacitor) Cel of the organic EL element 127. As a result thereof, almost most of the picture signal Vsig is written in the storage-capacitor 120. In accuracy, the difference of the Vsig as to the Vofs, "Vsig-Vofs", is written in the storage-capacitor 120.

Accordingly, the voltage Vgs between the gate and source of the driving transistor 121 is equal to "Vsig−Vofs+Vth" wherein the threshold voltage Vth previously detected and held, and "Vsig−Vofs" subjected to sampling this time are added. At this time, if the ground potential Vofs is set to around the black level of the pixel signal Vsig, Vofs=0V can be held, and consequently, the voltage Vgs between the gate and source (=driving potential) is equal to "Vsig+Vth (=Vin+Vth)".

The scan driving pulse NDS is set to an active-low state before timing t10 wherein the signal write period ends, and the light-emitting control transistor 122 is turned on (t9). Thus, the drain terminal D of the driving transistor 121 is connected to the first power supply potential Vc1 via the light-emitting control transistor 122, so the pixel circuit P advances from the non-light-emitting period to a light-emitting period.

Thus, at the periods t9 and t10 wherein the sampling transistor 125 is still in an ON state, and also the light-emitting control transistor 122 enters an ON state, the mobility correction of the driving transistor 121 is performed. The overlapped period (referred to a mobility correction period) of the active periods of the write driving pulse WS and scan driving pulse NDS is adjusted, thereby optimizing the correction of mobility of the driving transistor 121 of each pixel. That is to say, mobility correction is suitably performed at the periods t9 and t10 wherein the rear portion of the signal write period and the top portion of the light-emitting period are overlapped.

Also, at this time, the change property of the write scanning line potential at the side for turning off the sampling transistor 125 is inclined, whereby the mobility correction period is automatically adjusted so as to be shortened when the potential of the picture signal line 106HS is high (when the driving current Ids is great), or so as to be lengthened when the potential of the picture signal line 106HS is low (when the driving current Ids is small). Thus, the mobility correction period can be set to an optimal state by following the picture signal potential (signal potential Vin of the picture signal Vsig). Thus, optimal mobility correction can be performed regardless of the brightness and pattern of an image.

Note that at the top of the light-emitting period where this mobility correction is performed, the organic EL element 127 is actually in a reverse bias state, and accordingly does not emit light. At the mobility correction periods t9 and t10, the driving current Ids flows to the driving transistor 121 in a state wherein the gate terminal G of the driving transistor 121 is fixed to the potential corresponding to the picture signal Vsig (signal potential Vin, in detail).

Now, "Vofs−Vth<VthEL" has been set, whereby the organic EL element 127 is set to a reverse bias state, and accordingly this indicates not diode property but simple capacity property. Accordingly, the driving current Ids flowing to the driving transistor 121 is written with the capacity "C=Cs+Cel" where both of the capacity value Cs of the storage-capacitor 120 and the capacity value Cel of the parasitic capacitor (equivalent capacitor) Cel of the organic EL element 127 are combined. Thus, the source potential Vs of the driving transistor 121 increases.

With the timing chart shown in FIG. 4, this increase is represented with ΔV. This increase, i.e., the negative feedback amount ΔV which is a mobility correction parameter is ultimately subtracted from the voltage Vgs between the gate and source held in the storage-capacitor 120, which is equivalent to applying negative feedback thereto. Thus, the driving current Ids of the driving transistor 121 is subjected to negative feedback to the voltage Vgs between the gate and source of the same driving transistor 121, whereby mobility μ can be corrected. Note that the negative feedback amount ΔV can be optimized by adjusting the time width t of the mobility correction periods t9 and t10.

In the present example case, the higher the picture signal Vsig is, the greater the driving current Ids is, and also the greater the absolute value of the ΔV is. Accordingly, mobility correction depending on a light-emitting brightness level can be performed. Also, in the case of taking a high-mobility driving transistor 121 and a low-mobility driving transistor 121 into consideration, if we say that the picture signal Vsig is constant, the greater the mobility μ of the driving transistor 121 is, the greater the absolute value of the ΔV is.

In other words, the driving transistor 121 of which the mobility is high at the mobility correction period, the source potential greatly increases as to the low-mobility driving transistor 121. Also, the greater the source potential increases, the smaller the potential difference between the gate and source becomes, and consequently, negative feedback is applied so as to make it difficult to apply a current. The greater the mobility μ is, the greater the negative feedback amount μV is, whereby the irregularities of the mobility μ for each pixel can be eliminated. Even with the driving transistors 121 having different mobility, the same driving current Ids can be applied to the organic EL element 127. The mobility correction periods are adjusted, whereby the magnitude of the negative feedback amount ΔV can be set to the optimal state.

Next, the write scanning unit 104 switches the write driving pulse WS to an inactive-low state (t10). Thus, the sampling transistor 125 goes to a non-electroconductive (OFF) state, and the stage proceeds to a light-emitting period. Subsequently, the stage proceeds to the next frame (or field), where the threshold correction preparation operation, threshold correction operation, mobility correction operation, and light-emitting operation are repeated again.

As a result thereof, the gate terminal G of the driving transistor 121 is isolated from the picture signal line 106HS. Applying of the signal potential Vin to the gate terminal G of the driving transistor 121 is cancelled, so the gate potential Vg of the driving transistor 121 can increase.

At this time, the driving current Ids flowing to the driving transistor 121 flows to the organic EL element 127, and the anode potential of the organic EL element 127 increases according to the driving current Ids. This increase is assumed to be Vel. At this time, the voltage Vgs between the gate and source of the driving transistor 121 is steady according to the effects by the storage-capacitor 120, so the driving transistor 121 flows a constant current (driving current Ids) to the organic EL element 127. As a result thereof, voltage drop occurs, and the potential Vel of the anode terminal A of the organic EL element 127 (=the potential of the node ND121) increases up to the voltage wherein a current such as the driving current Ids can flow to the organic EL element 127. During that time, the voltage Vgs between the gate and source held in the storage-capacitor 120 maintains the value of "Vsig+Vth−ΔV (=Vin+Vth−ΔV)".

Eventually, the reverse bias state of the organic EL element 127 is cancelled along with increase of the source potential Vs, so the organic EL element 127 actually starts emitting of light according to inflow of the driving current Ids. The increase of the anode potential of the organic EL element 127 at this time (Vel) is exactly increase of the source potential Vs of the driving transistor 121, and the source potential Vs of the driving transistor 121 becomes "−Vth+ΔV+Vel".

The relations between the driving current Ids at the time of emitting light and the gate voltage Vgs can be represented such as shown in Expression (3) by substituting "Vsig+Vth−ΔV (=Vin+Vth−ΔV)" for the Vgs of Expression (1) which represents the previous transistor property.

$$\begin{aligned} Ids &= k\mu(Vgs - Vth)\hat{}2 \\ &= k\mu(Vsig - \Delta V)\hat{}2 \\ &= k\mu(Vin - \Delta V)\hat{}2 \end{aligned} \tag{3}$$

In Expression (3), k=(½) (W/L) Cox holds. From this Expression (3), it can be found that the term of the threshold voltage Vth is cancelled, and the driving current Ids supplied to the organic EL element 127 does not depend on the threshold voltage Vth of the driving transistor 121. The driving current Ids is basically determined with the signal voltage Vin of the picture signal Vsig. In other words, the organic EL element 127 emits light with the brightness corresponding to the picture signal Vsig.

At this time, the signal potential Vin is corrected with the feedback amount ΔV. This correction amount ΔV serves so as to cancel the effects of the mobility μ positioned at the coefficient portion of Expression (3). Note that though the detailed description will be omitted, the mobility correction terms shown in Expression (3) is subjected to numerical analysis, whereby the driving current Ids as to the mobility correction time can be represented such as shown in Expression (4).

$$Ids = k\mu\left(\frac{Vsig}{1 + Vsig\frac{k\mu}{C}t}\right)^2 = k\mu\left(\frac{Vin}{1 + Vin\frac{k\mu}{C}t}\right)^2 \quad (4)$$

Accordingly, the driving current Ids substantially depends on the signal potential Vin alone. The driving current Ids does not depend on the threshold voltage Vth, so even if the threshold voltage Vth is changed by a manufacturing process, the driving current Ids between the drain and source does not fluctuate, and the light-emitting brightness of the organic EL element 127 does not fluctuate.

Also, the storage-capacitor 120 is connected between the gate terminal G and source terminal S of the driving transistor 121, the bootstrap operation is performed at the beginning of the light-emitting period due to the effects by the storage-capacitor 120 thereof, while the voltage between the gate and source of the driving transistor 121 "Vsig=Vin−ΔV+Vth" is kept steady, the gate potential Vg and source potential Vs of the driving transistor 121 increase. Upon the source potential Vs of the driving transistor 121 becoming "−Vth+ΔV+Vel", the gate potential Vg becomes "Vin+Vel".

Here, with the organic EL element 127, if the light-emitting time is lengthened, the I-V property thereof is changed. Therefore, the potential of the node ND121 is also changed. Note however, according to the effects by the storage-capacitor 120, the potential of the node ND122 also increases linked with increase in the potential of the node ND121, so the voltage Vgs between the gate and source of the driving transistor 121 is constantly kept in almost "Vsig+Vth−ΔV" regardless of increase in the potential of the node ND121, and accordingly, the current flowing to the organic EL element 127 does not change. Accordingly, even if the I-V property of the organic EL element 127 deteriorates, the constant current Ids always continues flowing, so the organic EL element 127 continues to emit light with the brightness corresponding to the pixel signal Vsig, and accordingly, the brightness never changes.

Thereafter, upon reaching the timing t1 of the next field, the scan driving pulse NDS is set to an inactive-high state, the light-emitting control transistor 122 is turned off, light emitting ends, and also this filed ends. Thereafter, in the same way as with the above description, the stage proceeds to the operation of the next field, the threshold voltage correction operation, mobility correction operation, and light-emitting operation are repeated.

Thus, with the pixel circuit P according to the present embodiment, the bootstrap circuit 130 is configured to serve as a driving signal stabilizing circuit for correcting change in the current-voltage property of the organic EL element 127 which is an example of electro-optic elements to keep the driving current steady.

Also, with the pixel circuit P according to the present embodiment, the threshold and mobility correction circuit 140 is provided, and according to the operations of the detecting transistors 123 and 124 during the threshold correction period, the constant current Ids which is not influenced by the irregularities of the threshold voltage Vth by canceling the threshold voltage Vth of the driving transistor 121, whereby an image can be displayed with a stable gradation corresponding to an input pixel signal, and accordingly, a high quality image can be obtained.

Additionally, according to the operation during the mobility correction period by the light-emitting control transistor 122 liked with the write operation of the picture signal Vsig by the sampling transistor 125, the constant current Ids which is not influenced by the irregularities of the carrier mobility μ can be applied as the potential Vgs between the gate and source where the carrier mobility μ of the driving transistor 121 is reflected, whereby an image can be displayed with a stable gradation corresponding to an input pixel signal, and accordingly, a high quality image can be obtained.

That is to say, in order to prevent influence on the driving current Ids due to the property irregularities of the driving transistor 121 (the irregularities of the threshold voltage Vth and carrier mobility μ, in the present example), the threshold and mobility correction circuit 140 is configured to serve as a driving signal stabilizing circuit for correcting influence due to the threshold voltage Vth and carrier mobility μ to keep the driving current steady.

The circuit configurations of the bootstrap circuit 130 and threshold and mobility correction circuit 140 shown in the present embodiment are but an example of the driving signal stabilizing circuit for keeping the driving signal for driving the organic EL element 127 using an n-channel type as the driving transistor 121 steady, and accordingly, as a driving signal stabilizing circuit for preventing influence on the driving current Ids due to the deterioration over time of the organic EL element 127 and the property fluctuation of the n-channel type driving transistor 121 (e.g., irregularities and fluctuation such as threshold voltage and mobility and so forth), other well-known various types of circuit can be employed.

Now, with the driving timing according to the present embodiment, the threshold correction period is determined with the overlapped period wherein the detecting transistor 123 and light-emitting control transistor 122 are both turned on based on each of the threshold and mobility correction pulse AZ1 supplied by the threshold and mobility correction scanning unit 114 and the scan driving pulse NDS supplied by the drive scanning unit 105, and in reality, the period itself wherein the light-emitting control transistor 122 is turned on determines the threshold correction period. On the other hand, the mobility correction period is determined with the overlapped period wherein the sampling transistor 125 and light-emitting control transistor 122 are both turned on based on each of the write driving pulse WS supplied by the write scanning unit 104 and the scan driving pulse NDS supplied by the drive scanning unit 105, the mobility correction period is determined with the period after the light-emitting control transistor 122 is turned on until the sampling transistor 125 is turned off, so in reality, the phase difference between the write driving pulse WS and scan driving pulse NDS determines the mobility correction period.

Therefore, even if there is no property irregularities regarding the detecting transistor 123, sampling transistor 125, and light-emitting control transistor 122 within the pixel circuit P, and influence of distance dependency of the wiring resistance and wiring capacitance of the threshold and mobility correction scanning line 114AZ, write scanning line 104WS, and drive scanning line 105DS can be ignored (hereafter, referred to as prerequisites), there is a possibility that the difference of the waveform property due to the property of the output circuit (in general, referred to as the output buffer) provided at the final stage of the write scanning unit 104, drive scanning unit 105, and threshold and mobility correction scanning unit 114 influences the threshold correction period and mobility correction period.

In particular, with the above-mentioned driving timing, the mobility correction period is shorter than the threshold correction period, with regard to the threshold correction period, there are few problems even if there are some irregularities regarding the ON period of the detecting transistor 123, but with regard to the mobility correction period, influence of irregularities is great, so it is important to manage so as not to cause irregularities regarding the phase difference between the write driving pulse WS and scan driving pulse NDS.

The sampling transistor 125 and light-emitting control transistor 122 are both switching transistors of a vertical-scanning system, so the irregularities of the phase difference between the write driving pulse WS and scan driving pulse NDS are caused in increments of row with the above-mentioned prerequisites, and there is concern that the irregularities thereof will be visually recognized as lateral stripe noise. These problems and the improvement techniques thereof will be described below in detail.

Output Circuit of Vertical Scanning System

First Example

Figure 5:
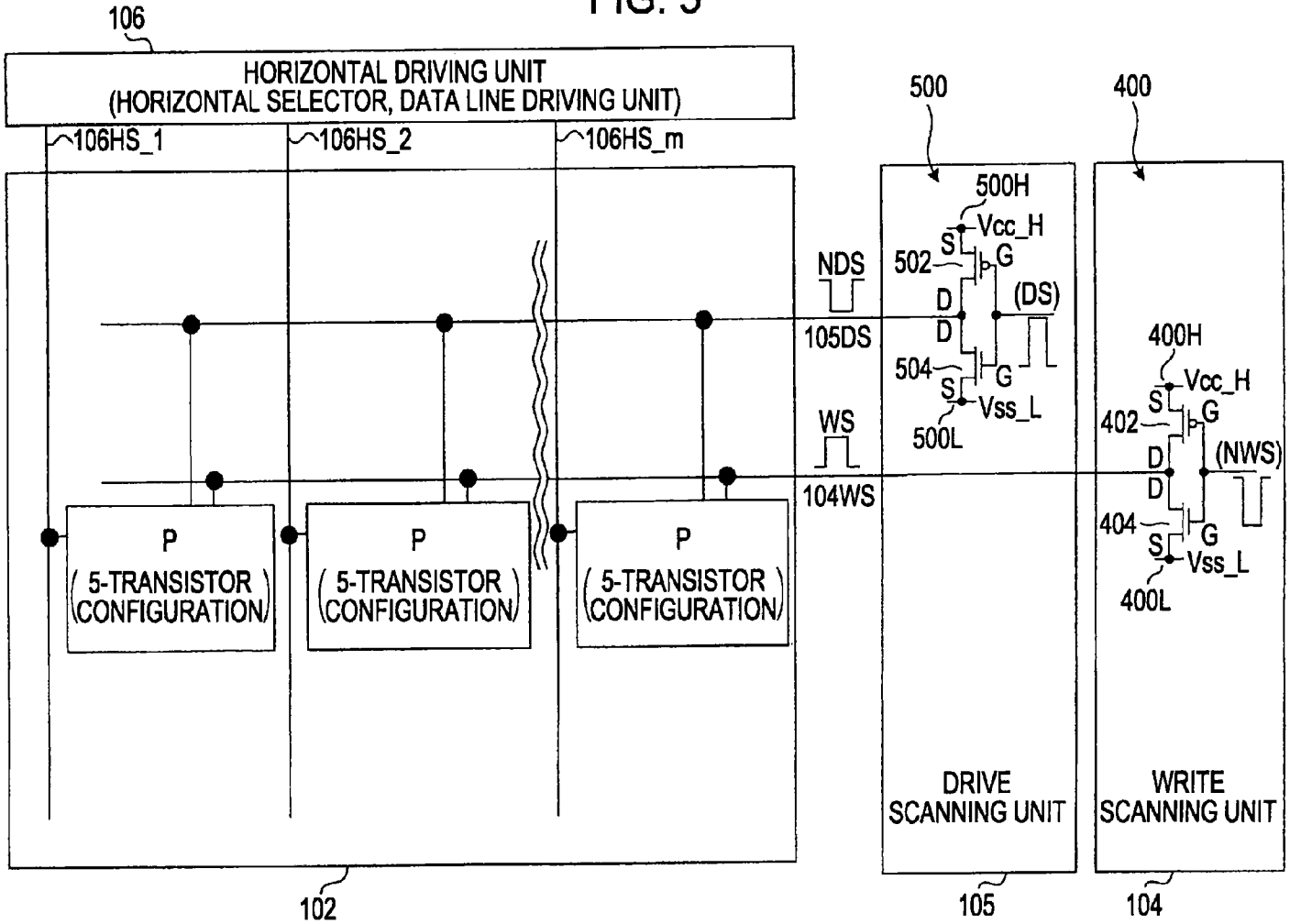
FIG. 5 is a diagram describing a first example of the output circuits of a write scanning unit and a drive scanning unit.

FIG. 5 is a diagram describing a first example of the output circuits of the write scanning unit 104 and drive scanning unit 105. As shown in the drawing, the write scanning unit 104 and drive scanning unit 105 are both configured to switch the write scanning line 104WS and drive scanning line 105DS of each row to a high-level state or low-level state to control the respective gate terminals G of one row worth of all the sampling transistors 125 or all the light-emitting transistors 122 all at once. Therefore, at the portions connected to the write scanning line 104WS or drive scanning line 105DS output circuits 400 and 500 having sufficient driving ability are provided. In the drawing, one row worth of the output circuits 400 and 500 alone are illustrated, but the output circuits 400 and 500 are provided as to the write scanning line 104WS and drive scanning line 105DS of each row. The write scanning unit 104 and drive scanning unit 105 are provided at the outer edge (so-called frame portion) of the pixel array unit 102, and though not shown in the drawing, a first potential Vcc_H and second potential Vss_L (Vcc_H>Vss_L) are supplied from a power supply circuit, of which the output impedance is sufficiently small, provided at the outside of the display panel unit 100.

The output circuits 400 and 500 according to the first example have the same configuration, so description will be made below regarding the output circuit 400 serving as a representative. The output circuit 400 at the write scanning unit 104 side has a configuration wherein a p-channel transistor (p-type transistor) 402, an n-channel transistor (n-type transistor) 404 are serially disposed between a supply terminal 400H for the first potential Vcc_H and a supply terminal 400L for the second potential Vss_L, as an example. The source terminal S of the p-type transistor 402 is connected to the supply terminal 400H for the first potential Vcc_H, and the source terminal S of the n-type transistor 404 is connected to the supply terminal 400L for the second potential Vcc_L. The respective drain terminals D of the p-type transistor 402 and n-type transistor 404 are connected in common, and the connection point thereof is connected to the write scanning line 104WS. A CMOS inverter is configured as a whole.

The respective gate terminals G of the p-type transistor 402 and n-type transistor 404 are connected in common, and the write driving pulse NWS which is in an active-low state is supplied to the connection point thereof. When the write driving pulse NWS is in an active-low state, the n-type transistor 404 is turned off, and also the p-type transistor 402 is turned on, so the first potential Vcc_H is supplied to the write scanning line 104WS, and on the other hand, when the write driving pulse NWS is in an inactive-high state, the p-type transistor 402 is turned off, and also the n-type transistor 404 is turned on, so the second potential Vss_L is supplied to the write scanning line 104WS. On the other hand, with the output circuit 500 at the drive scanning unit 105 side, the respective gate terminals G of the p-type transistor 502 and n-type transistor 504 are connected in common, and the scan driving pulse DS which is in an active-high state is supplied to the connection point thereof. When the scan driving pulse DS is in an inactive-low state, the n-type transistor 504 is turned off, and also the p-type transistor 502 is turned on, so the first potential Vcc_H is supplied to the drive scanning line 105DS, and on the other hand, when the scan driving pulse DS is in an active-high state, the p-type transistor 502 is turned off, and also the n-type transistor 504 is turned on, so the second potential Vss_L is supplied to the drive scanning line 105DS. As can be understood from those operations, the output circuits 400 and 500 serve as inverter-type buffers.

<Mobility Correction Period and Influence of Property Irregularities of Transistor of Output Circuit>

Figure 6:
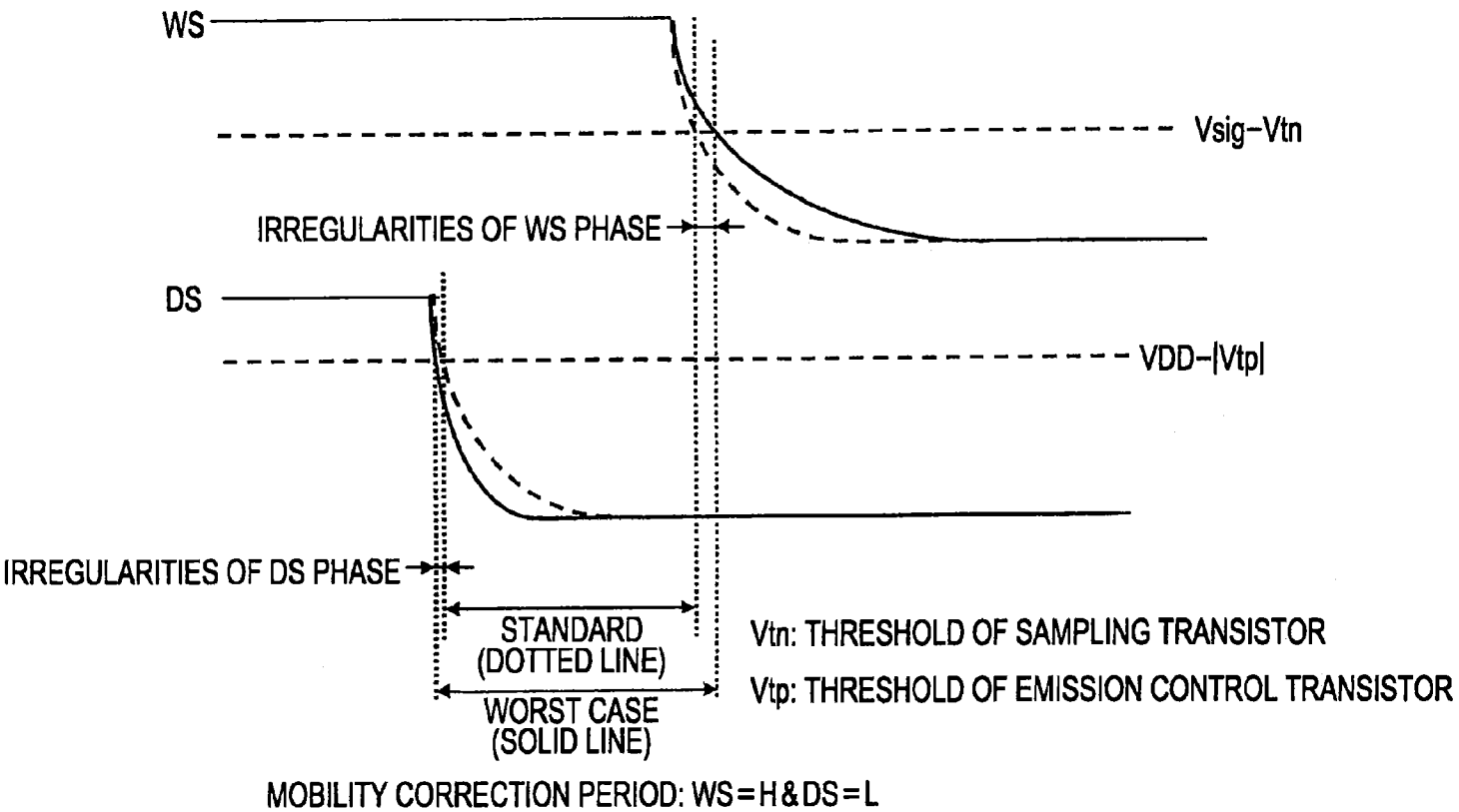
FIG. 6 is a diagram illustrating a first example of the waveform blunting of a correction pulse close to a mobility correction period.
Figure 7:
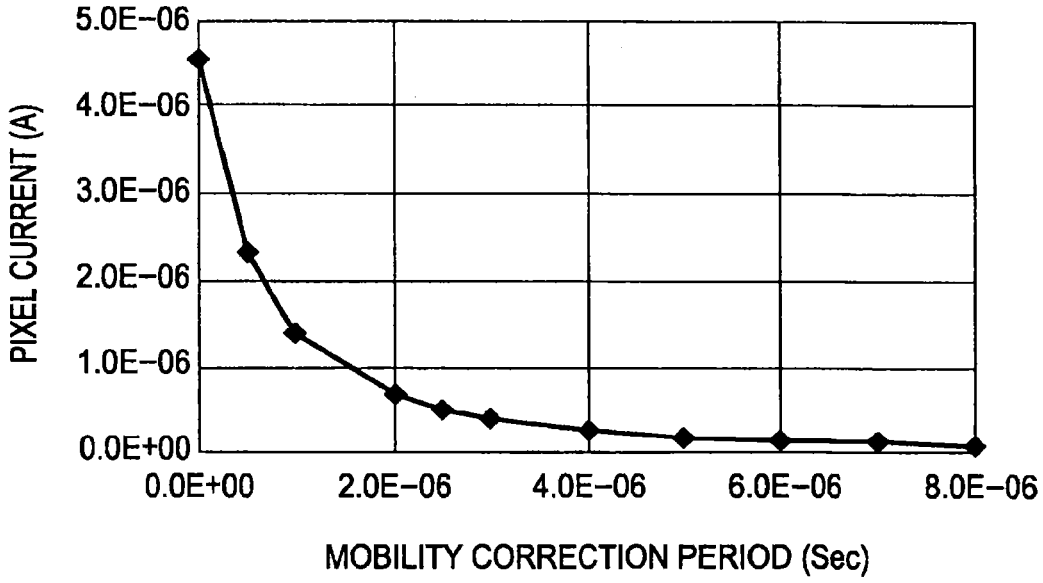
FIG. 7 is a property diagram illustrating the relations between a mobility correction period and a pixel current (driving current)
Figure 8:
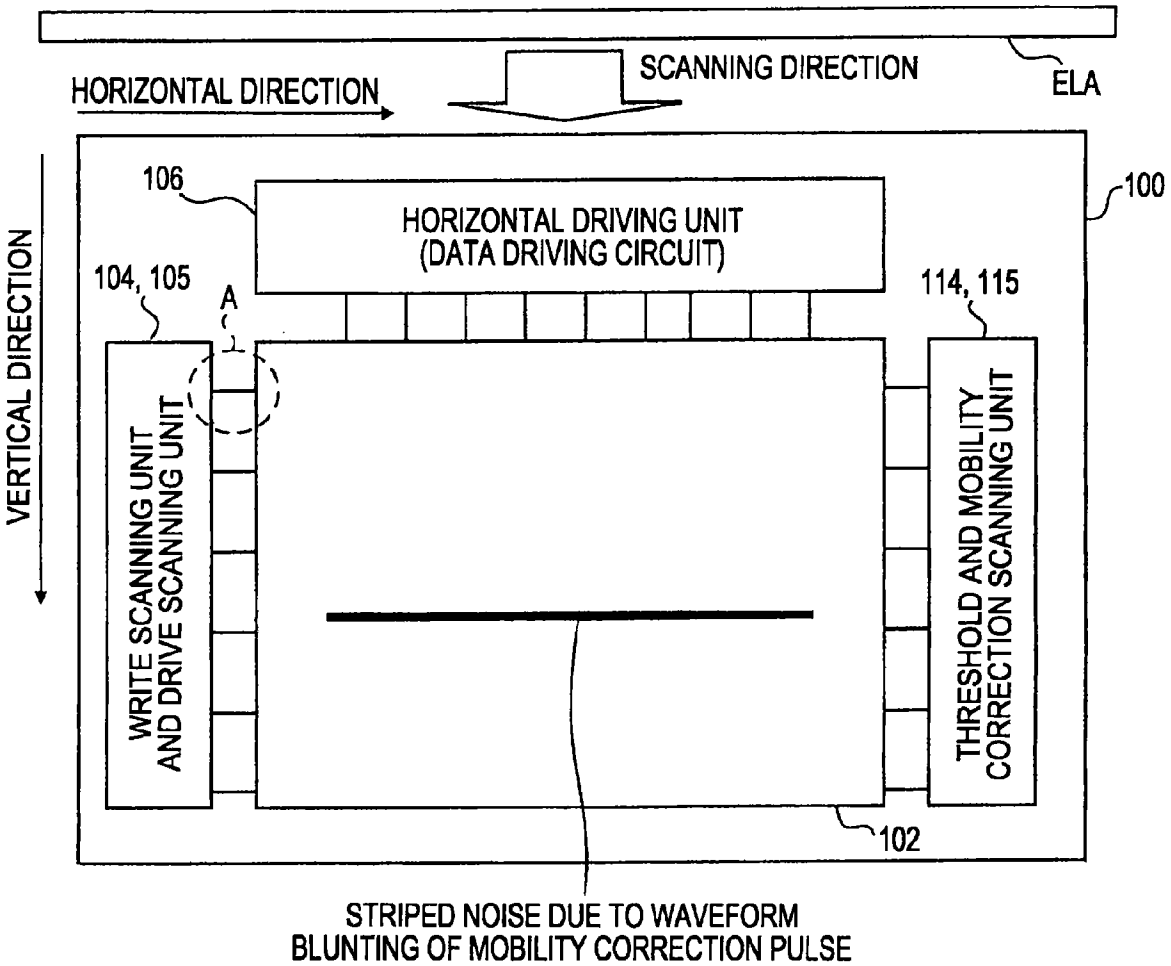
FIG. 8 is a diagram illustrating brightness unevenness due to the irregularities of mobility correction periods due to the irregularities of waveform blunting.
Figure 9:
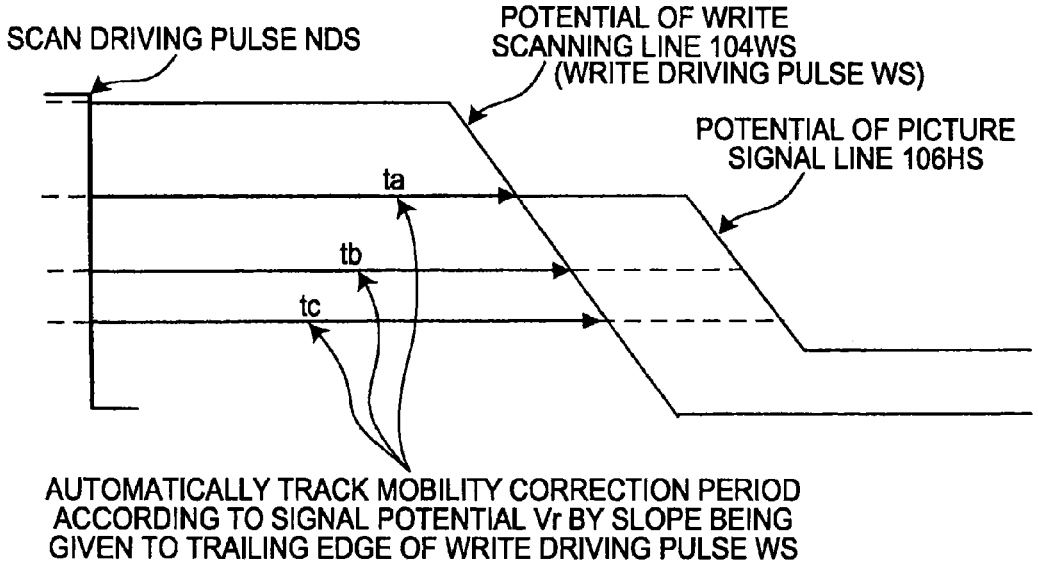
FIG. 9 is a diagram illustrating a second example of the waveform blunting of a correction pulse close to a mobility correction period.
Figure 10:
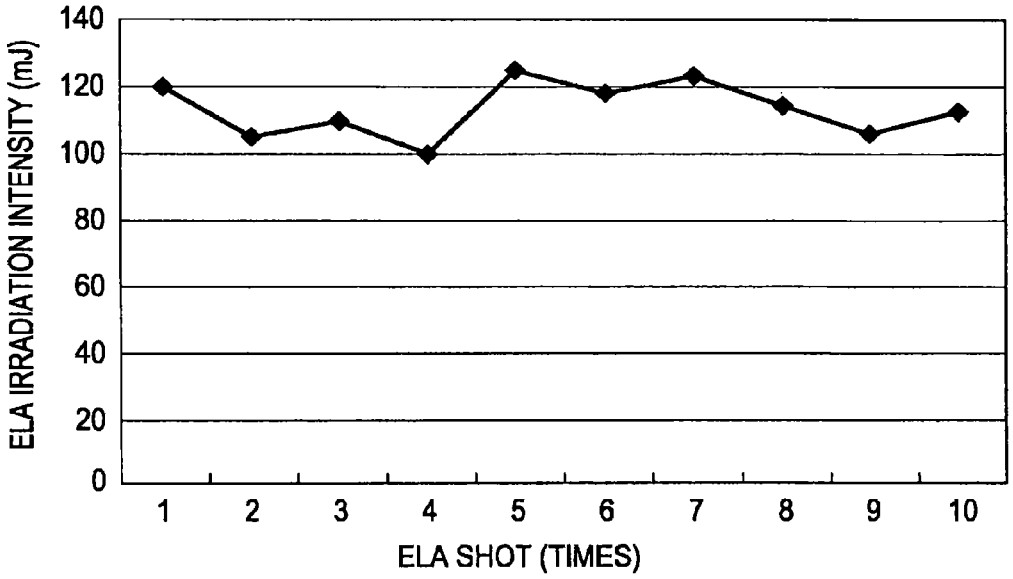
FIG. 10 is a diagram illustrating an example of irradiation intensity irregularities at each time at the time of ELA irradiation.

FIGS. 6 through 10 are diagrams describing an example of waveform blunting of the write driving pulse WS and scan driving pulse NDS around the mobility correction period, and influence due to waveform blunting irregularities given to the mobility correction period. FIG. 6 is a diagram illustrating a first example of waveform blunting of correction pulses (write driving pulse WS and scan driving pulse NDS) around the mobility correction period. FIG. 7 is a property diagram illustrating the relations between the mobility correction period and pixel current (driving current Ids). FIG. 8 is a diagram illustrating an example of brightness unevenness due to mobility correction period irregularities due to the irregularities of waveform blunting. FIG. 9 is a diagram illustrating a second example of waveform blunting of a correction pulse (write driving pulse WS) around the mobility correction period. FIG. 10 is a diagram illustrating an example of irradiation intensity irregularities of each time of ELA irradiation.

As described with FIG. 4, with the pixel circuit P according to the present embodiment and the driving timing thereof, a mobility correction operation is performed at a later half portion of a sampling period. With the driving timing shown in FIG. 4, with a process wherein the light-emitting control transistor 122 is turned on, and the voltage information corresponding to the picture signal Vsig is written in the storage-capacitor 120, the mobility correction period is determined with a period after the light-emitting control transistor 122 is turned on until the sampling transistor 125 is turned off, so in reality, the phase difference between the write driving pulse WS and scan driving pulse NDS determines the mobility correction period.

A wire having a high resistance value such as molybdenum Mo or the like is employed for the write scanning line 104WS for the write driving pulse WS, and the drive scanning line 105 DS for the scan driving pulse NDS, and also the overlapped parasitic capacitance thereof is great, so those pulses blunt such as shown in FIG. 6. The waveform blunting of the pulses strongly depends on the buffer property of the output circuits 400 and 500 provided at the final stage of each of the scanning units 104 and 105. Upon the property of each of the transistors 402, 404, 502, and 504 (collectively referred to as "buffer transistor") making up the output circuits 400 and 500 fluctuating, the waveform property of the pulses also fluctuates, and the mobility correction period also fluctuates due to the influence thereof. For example, FIG. 7 illustrates the relations between the mobility correction time and pixel current values, but as can be understood from this drawing, upon mobility correction fluctuating, difference is caused between pixel currents, and brightness irregularities are caused for each row. The longer the mobility correction time is, the weaker and darker the pixel current is, and on the other hand, the shorter the mobility correction time is, the stronger and brighter the pixel current is.

For example, with the relations between the write driving pulse WS and scan driving pulse NDS shown in FIG. 6, the mobility correction time becomes the longest when the trailing edge of the scan driving pulse NDS is the steepest, and also the trailing edge of the write driving pulse WS is the most moderate, and the mobility correction time becomes the shortest when the trailing edge of the scan driving pulse NDS is the most moderate, and also the trailing edge of the write driving pulse WS is the steepest. The former is a worst-case scenario from the perspective of light-emitting brightness.

The lines (horizontal lines) of such a worst case appear as dark stages as compared with the surrounding thereof as shown in FIG. 8 for example, which exhibit lateral stripe noise, and accordingly, the yield falls. A panel having high brightness is expected, and in order to realize this, a short mobility correction period is needed. If the correction period is shortened, stripes due to the correction period irregularities become more marked.

Also, as shown in FIG. 9, the above-mentioned problem is also caused in a case wherein the change property of the write scanning line potential at the side for turning off the sampling transistor 125 is inclined, whereby the mobility correction period automatically follows the picture signal potential (the signal potential Vin of the picture signal Vsig), i.e., if property irregularities of the buffer transistors making up the output circuits 400 and 500 occur, change property irregularities of the write scanning line potential are also caused, and due to the influence thereof irregularities are also caused with the mobility correction periods.

With the threshold correction, the correction period thereof is longer than the mobility correction period, and moreover, the threshold correction can be performed multiple times, so the irregularities management of the threshold correction period can be performed in a relatively moderate manner. On the other hand, with the mobility correction, the correction period is far shorter than the threshold correction period, and the irregularities thereof appear as change in brightness, so it is necessary to strictly enforce irregularity management of the mobility correction period thereof.

Now, the cause for the property irregularities of the buffer transistors is the output intensity irregularities at the excimer laser annealing (ELA) processing. That is to say, with an active-matrix-type organic EL panel, a low temperature process employing a polysilicon (poly-Si) substrate is used, and driving circuits such as a TFT and so forth are integrated on a glass substrate. The polysilicon substrate is formed by irradiating the high output pulses of an excimer laser (wavelength is 308 nm), and subjecting an amorphous silicon film to melting, cooling, and solidification. This method is referred to as excimer laser annealing, and high-quality polysilicon across a great area can be obtained at a low temperature.

With the ELA process, scanning is performed with a predetermined irradiation pitch (e.g., in increments of several 10 μam) in one direction on the polysilicon substrate where the display panel unit 100 is formed, on which the pixel array unit 102, and at the outer edge portion thereof the vertical driving unit 103 and horizontal driving unit 106 are mounted, using an excimer laser having predetermined irradiation width.

Note however, as shown in FIG. 10, in general, ELA output irregularities are caused for each irradiation, irradiation intensity irregularities are caused in the scanning direction, and not only the TFTs of the pixel circuits P within the pixel array unit 102 but also the buffer transistors of the output circuits 400 and 500 are readily influenced by ELA irradiation intensity irregularities (the details will be described later). This is because the irregularities of crystal grain diameter sizes to be generated are caused due to the output irregularities of the excimer laser.

If ELA irradiation intensity irregularities are caused on the semiconductor substrate in increments of irradiation pitch, there is property difference at each buffer transistor arrayed in the scanning direction, and due to influence of the property difference thereof irregularities in the scanning direction are also caused between the mobility correction periods, and consequently, this brings about a disadvantage wherein such irregularities are readily recognized visually as stripe noise.

That is to say, the irregularities between the mobility correction periods due to the property irregularities of the buffer transistors appear as brightness unevenness. In particular, with low-temperature polysilicon, the excimer laser annealing processing is performed wherein, while irradiating a linear laser (line light) on the semiconductor substrate, scanning is performed in the direction orthogonal to the longitudinal direction of the laser thereof to crystallize, so due to influence of the scanning unevenness (fluctuation such as irradiation width, scanning pitch, scanning speed, irradiation intensity, etc.) at the time of the annealing processing, the property (linear) of a laser beam employed as a light source appears not only as the property irregularities of the respective pixel circuits P of the display panel unit 100 but also as the property irregularities of the scanning units 103 and 106 provided at the outer edge of the pixel array unit 102.

Specifically, at certain scanning times (scanning positions), the semiconductor substrate is irradiated linearly generally with constant and even irradiation intensity, the properties of the buffer transistors making up the respective scanning units 103 and 106 become overall even in the longitudinal direction of the laser beam (line light), but on the other hand, irregularities occur in the scanning direction at the time of the annealing processing. As a result thereof, on the display screen brightness unevenness occurs linearly, which has a constant relation with the scanning direction at the time of the annealing processing, and visually, this is observed as stripe noise. As shown in FIG. 1B, handling for color image display leads to a disadvantage wherein unnecessary coloring (stripped color noise) for each row is visually recognized.

The annealing processing is performed by using a linear laser beam to scan the semiconductor, so there is a feature wherein the property irregularities of the buffer transistors readily appear substantially with a linear correlation, and also there is a tendency wherein even if the level of the property irregularities of the respective buffer transistors is small, this appears on an image as stripe noise, which is readily sensed visually.

Even if the levels of the property irregularities of the transistors are the same, the way a human senses this differs greatly between a case of the irregularities being accumulated linearly and recognized as a stripe pattern, and a case of the irregularities being distributed randomly, and consequently, the case of irregularities being distributed randomly can be naturally accepted as compared with the former case. This is due to human cognitive psychology nature to focus attention on any geometric patterns which can be recognized.

In order to eliminate such a problem, it can be conceived as a first technique to reduce irregularities factors at the time of the annealing processing as much as possible, such as the irradiation width, scanning pitch, scanning speed, irradiation intensity, and so forth of a linear laser beam. Note however, it goes without saying that such measures are limited.

Therefore, with the present embodiment, focusing attention on that the cause of brightness unevenness appeared in stripes on the display screen is the annealing processing for scanning a linear laser beam, the layout configuration (pattern design) of the buffer transistors at the time of forming a semiconductor circuit is devised in light of the irradiation width and scanning pitch at the time of the annealing processing. The present embodiment is the same as an existing method from the perspective of circuits, but takes measures from the perspective of manufacturing.

Specifically, with the scanning direction at the time of the annealing processing, the sizes (particularly, channel width) of the buffer transistors are set to generally the same as the pixel pitch. Note that with regard to the sizes of the buffer transistors, the channel sizes thereof actually have a meaning, so the size of a valid channel width excluding an area which cannot be used as a channel such as electrode wiring or the like is set so as to be generally the same size as the pixel pitch. Hereafter, such a relation is referred to as setting the channel width of the buffer transistors to the same size as the pixel pitch in the scanning direction at the time of the anneal processing. That is to say, the layout configuration is devised from the perspective of channel width such that the buffer transistors for driving one line worth of all the switching transistors are disposed to the maximum extent in the relation with the pixel pitch, whereby influence which the cause of the irregularities at the time of the annealing processing gives to the display screen is alleviated. Description will be made below specifically regarding the pattern design at the time of forming a semiconductor circuit and the aspect of a manufacturing process.

<Determining Conditions of Operation Period>

Figure 11A:
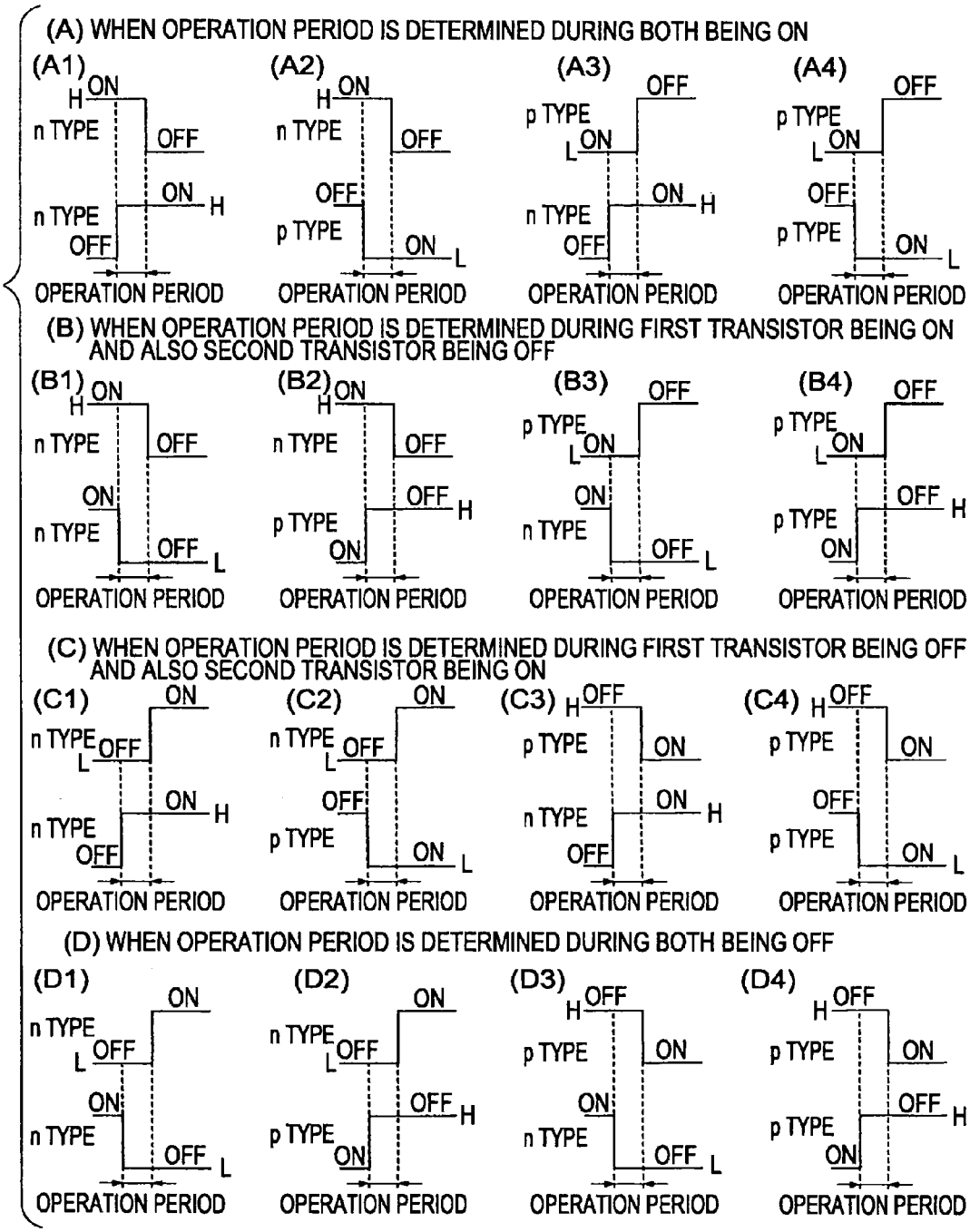
FIG. 11A is a diagram (Part 1) summarizing conditions for determining an operation period.
Figure 11B:
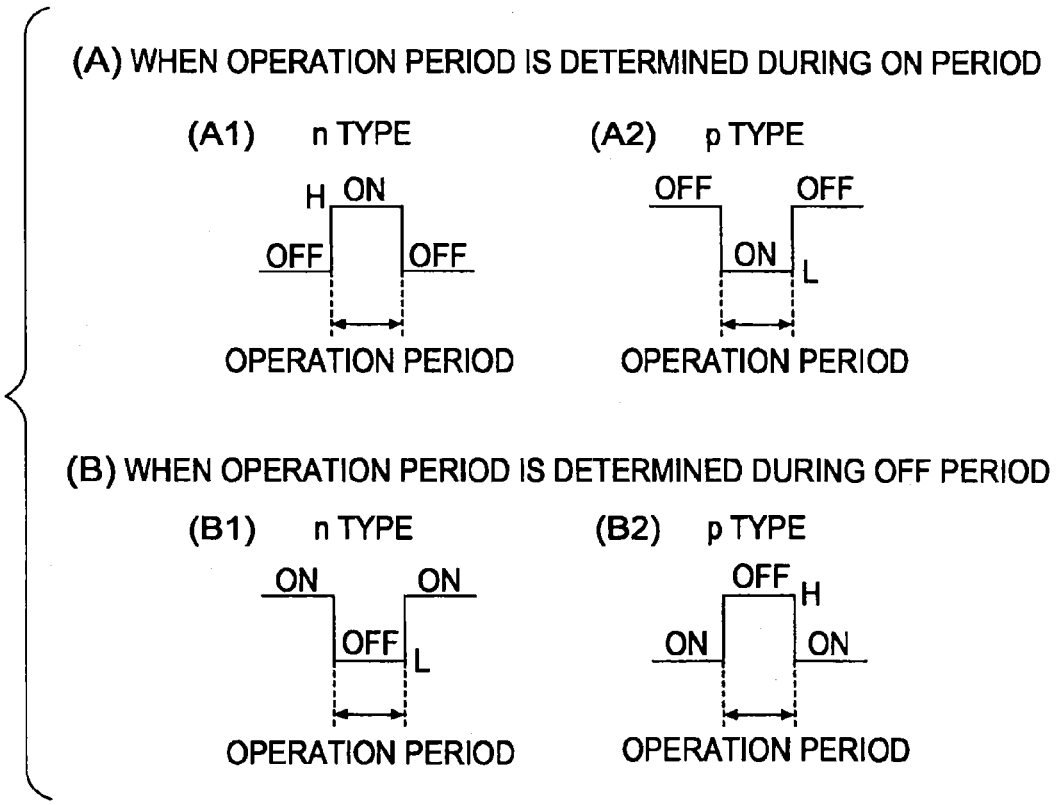
FIG. 11B is a diagram (Part 1) summarizing the conditions for determining an operation period.

FIGS. 11A and 11B are diagrams summarizing conditions for determining an operation period. Here, a first example shown in FIG. 11A is a case wherein the start timing and end timing of an operation is determined with ON/OFF timing of two types of driving pulses, and a second example shown in FIG. 11B is a case wherein the start timing and end timing of an operation is determined with ON/OFF timing of a single driving pulse.

As described above, in the event of realizing various types of operation, various types of arrangement can be conceived as the configuration of pixel circuits and driving timing. For example, the start timing and end timing of a certain operation is determined with ON/OFF timing of two types of driving pulses in some cases. As a specific example, such as the case of driving the pixel circuit P having a five-transistor configuration which can realize the threshold correction operation and mobility correction operation shown in FIG. 2, there is a case wherein the start timing and end timing of a certain operation is determined with the ON periods, the OFF periods, or each overlapped period of an ON period and OFF period of the respective driving pulses for controlling two transistors in some cases.

At this time, in order to turn on a p-type transistor, it is necessary to supply an active-low driving pulse to the gate terminal G which is the control input terminal, and in order to turn on a n-type transistor, it is necessary to supply an active-high driving pulse to the gate terminal G which is the control input terminal. When an output circuit is configured as an inverter buffer wherein a p-type transistor (disposed at high-voltage side) and an n-type transistor (disposed at low-voltage side) are cascade-connected, the p-type transistor is turned on by turning on the n-type transistor of the output circuit to set to an active-low state, and the n-type transistor is turned on by turning on the p-type transistor of the output circuit to set to an active-high state.

Specifically, in the case of a second transistor (lower side in the drawing) stipulating the start timing of an operation period, and a first transistor (upper side in the drawing) stipulating the end timing of the operation period, the following sixteen timing patterns can be taken. For example, as shown in each drawing under (A) in FIG. 11A, there is a case wherein a period in which both are ON is an operation period. In FIG. 11A, (A1) is a case wherein the first transistor (upper side in the drawing) is an n-type transistor, and the second transistor (lower side in the drawing) is also an n-type transistor, and an operation period is determined when a driving pulse for the first transistor (upper side in the drawing) and a driving pulse for the second transistor (lower side in the drawing) are both in a high-level state. In FIG. 11A, (A2) is a case wherein the first transistor (upper side in the drawing) is an n-type transistor, and the second transistor (lower side in the drawing) is a p-type transistor, and an operation period is determined when a driving pulse for the first transistor (upper side in the drawing) is in a high-level state and a driving pulse for the second transistor (lower side in the drawing) is in a low-level state.

In FIG. 11A, (A3) is a case wherein the first transistor (upper side in the drawing) is a p-type transistor, and the second transistor (lower side in the drawing) is an n-type transistor, and an operation period is determined when a driving pulse for the first transistor (upper side in the drawing) is in a low-level state and a driving pulse for the second transistor (lower side in the drawing) is in a high-level state. In FIG. 11A, (A4) is a case wherein the first transistor (upper side in the drawing) is a p-type transistor, and the second transistor (lower side in the drawing) is also a p-type transistor, and an operation period is determined when a driving pulse for the first transistor (upper side in the drawing) and a driving pulse for the second transistor (lower side in the drawing) are both in a low-level state.

As shown in each drawing under (B) in FIG. 11A, there is a case wherein a period in which the first transistor (upper side in the drawing) is ON, and also the second transistor (lower side in the drawing) is OFF is an operation period. In FIG. 11A, (B1) is a case wherein the first transistor (upper side in the drawing) is an n-type transistor, and the second transistor (lower side in the drawing) is also an n-type transistor, and an operation period is determined when a driving pulse for the first transistor (upper side in the drawing) is in a high-level state and a driving pulse for the second transistor (lower side in the drawing) is in a low-level state. In FIG. 11A, (B2) is a case wherein the first transistor (upper side in the drawing) is an n-type transistor, and the second transistor (lower side in the drawing) is a p-type transistor, and an operation period is determined when a driving pulse for the first transistor (upper side in the drawing) and a driving pulse for the second transistor (lower side in the drawing) are both in a high-level state.

In FIG. 11A, (B3) is a case wherein the first transistor (upper side in the drawing) is a p-type transistor, and the second transistor (lower side in the drawing) is an n-type transistor, and an operation period is determined when a driving pulse for the first transistor (upper side in the drawing) and a driving pulse for the second transistor (lower side in the drawing) are both in a low-level state. In FIG. 11A, (B4) is a case wherein the first transistor (upper side in the drawing) is a p-type transistor, and the second transistor (lower side in the drawing) is also a p-type transistor, and an operation period is determined when a driving pulse for the first transistor (upper side in the drawing) is in a low-level state and a driving pulse for the second transistor (lower side in the drawing) is in a high-level state.

As shown in each drawing under (C) in FIG. 11A, there is a case wherein a period in which the first transistor (upper side in the drawing) is OFF, and also the second transistor (lower side in the drawing) is ON is an operation period. In FIG. 11A, (C1) is a case wherein the first transistor (upper side in the drawing) is an n-type transistor, and the second transistor (lower side in the drawing) is also an n-type transistor, and an operation period is determined when a driving pulse for the first transistor (upper side in the drawing) is in a low-level state and a driving pulse for the second transistor (lower side in the drawing) is in a high-level state. In FIG. 11A, (C2) is a case wherein the first transistor (upper side in the drawing) is an n-type transistor, and the second transistor (lower side in the drawing) is a p-type transistor, and an operation period is determined when a driving pulse for the first transistor (upper side in the drawing) and a driving pulse for the second transistor (lower side in the drawing) are both in a low-level state.

In FIG. 11A, (C3) is a case wherein the first transistor (upper side in the drawing) is a p-type transistor, and the second transistor (lower side in the drawing) is an n-type transistor, and an operation period is determined when a driving pulse for the first transistor (upper side in the drawing) and a driving pulse for the second transistor (lower side in the drawing) are both in a high-level state. In FIG. 11A, (C4) is a case wherein the first transistor (upper side in the drawing) is a p-type transistor, and the second transistor (lower side in the drawing) is also a p-type transistor, and an operation period is determined when a driving pulse for the first transistor (upper side in the drawing) is in a high-level state and a driving pulse for the second transistor (lower side in the drawing) is in a low-level state.

As shown in each drawing under (D) in FIG. 11A, there is a case wherein a period in which both are OFF is an operation period. In FIG. 11A, (D1) is a case wherein the first transistor (upper side in the drawing) is an n-type transistor, and the second transistor (lower side in the drawing) is also an n-type transistor, and an operation period is determined when a driving pulse for the first transistor (upper side in the drawing) and a driving pulse for the second transistor (lower side in the drawing) are both in a low-level state. In FIG. 11A, (D2) is a case wherein the first transistor (upper side in the drawing) is an n-type transistor, and the second transistor (lower side in the drawing) is a p-type transistor, and an operation period is determined when a driving pulse for the first transistor (upper side in the drawing) is in a low-level state and a driving pulse for the second transistor (lower side in the drawing) is in a high-level state.

In FIG. 11A, (D3) is a case wherein the first transistor (upper side in the drawing) is a p-type transistor, and the second transistor (lower side in the drawing) is an n-type transistor, and an operation period is determined when a driving pulse for the first transistor (upper side in the drawing) is in a high-level state and a driving pulse for the second transistor (lower side in the drawing) is in a low-level state. In FIG. 11A, (D4) is a case wherein the first transistor (upper side in the drawing) is a p-type transistor, and the second transistor (lower side in the drawing) is also a p-type transistor, and an operation period is determined when a driving pulse for the first transistor (upper side in the drawing) and a driving pulse for the second transistor (lower side in the drawing) are both in a high-level state.

Also, there is a case wherein an operation period is determined with the ON period or OFF period alone of a single transistor. At this time as well, in order to turn on a p-type transistor, it is necessary to supply an active-low driving pulse to the gate terminal G which is the control input terminal, and in order to turn on a n-type transistor, it is necessary to supply an active-high driving pulse to the gate terminal G which is the control input terminal. When an output circuit is configured as an inverter buffer wherein a p-type transistor (disposed at high-voltage side) and an n-type transistor (disposed at low-voltage side) are cascade-connected, the p-type transistor is turned on by turning on the n-type transistor of the output circuit to set to an active-low state, and the n-type transistor is turned on by turning on the p-type transistor of the output circuit to set an active-high state.

In this case, the following four timing patterns can be taken. For example, as shown in each drawing under (A) in FIG. 11B, there is a case wherein a period in which a single transistor is ON is an operation period. In FIG. 11B, (A1) is a case wherein the transistor is an n-type transistor, and an operation period is determined when a driving pulse for the n-type transistor is in a high-level state. In FIG. 11B, (A2) is a case wherein the transistor is a p-type transistor, and an operation period is determined when a driving pulse for the p-type transistor is in a low-level state. Each drawing under (B) in FIG. 11B is a case wherein a period in which a single transistor is OFF is an operation period. In FIG. 11B, (B1) is a case wherein the transistor is an n-type transistor, and an operation period is determined when a driving pulse for the n-type transistor is in a low-level state. In FIG. 11B, (B2) is a case wherein the transistor is a p-type transistor, and an operation period is determined when a driving pulse for the p-type transistor is in a high-level state.

Improvement Technique

First Basic Example

Figure 12:
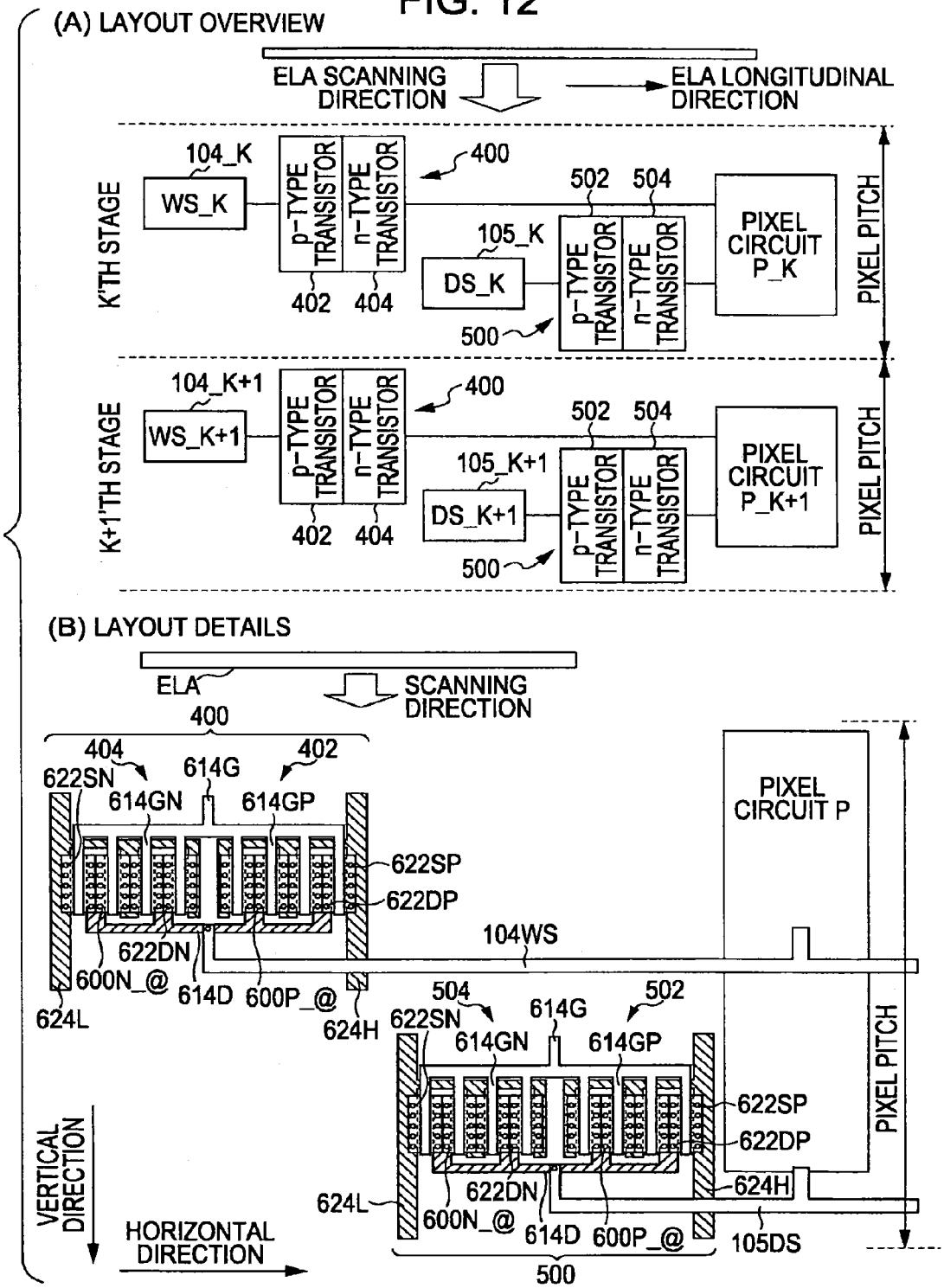
FIG. 12 is a diagram illustrating a comparative example as to the driving circuit placement according to the present embodiment.
Figure 13A:
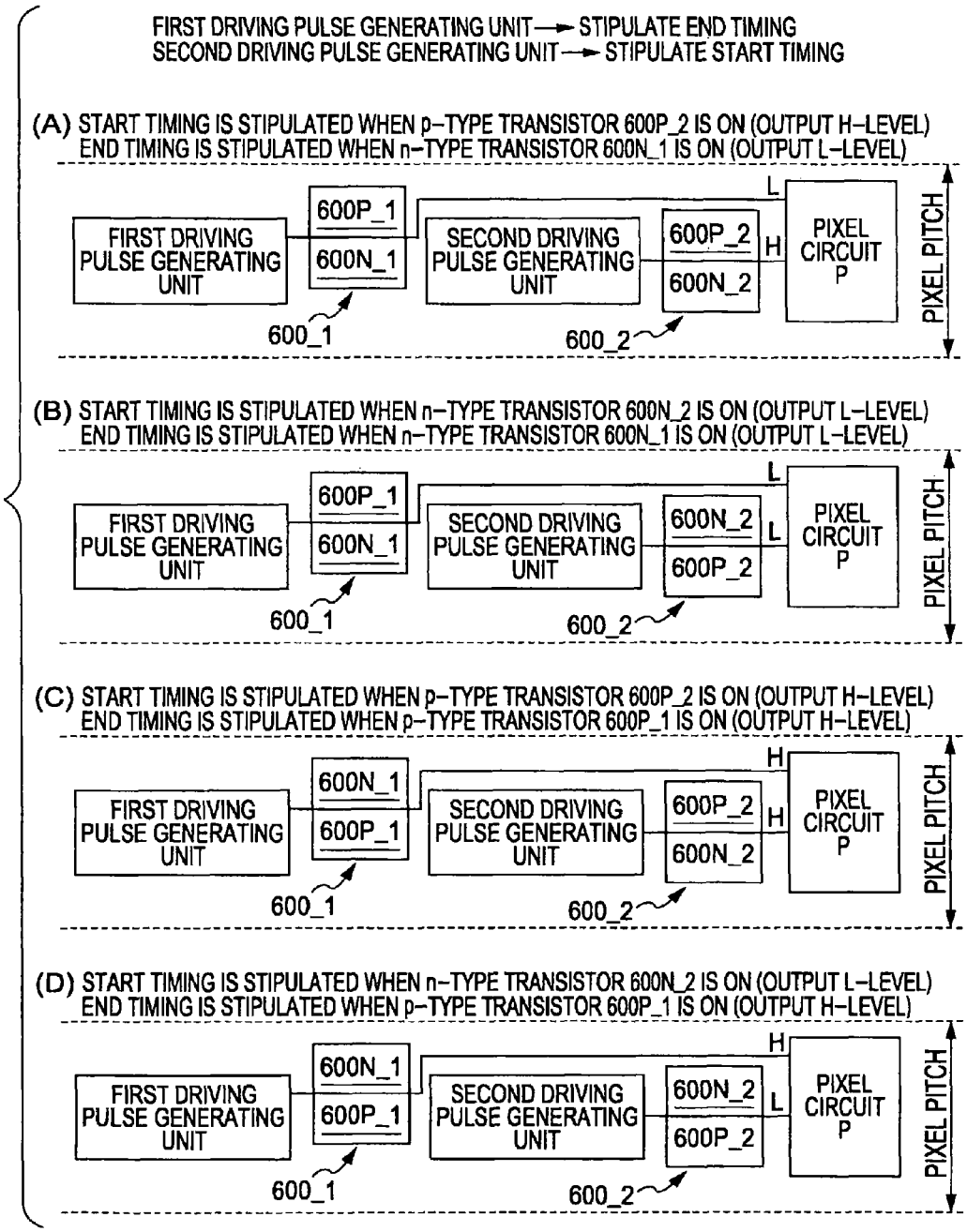
FIG. 13A is a diagram illustrating a first basic example of the driving circuit placement according to the present embodiment.

FIG. 12 is a diagram illustrating a comparative example as to the driving circuit placement (layout) according to the present embodiment whereby brightness irregularities on the display screen due to the irregularities cause at the time of the annealing processing can be alleviated. FIG. 13A is a diagram illustrating a first basic example of the driving circuit placement (layout) according to the present embodiment. Both are diagrams focusing attention on the connection portion between the write scanning unit 104, drive scanning unit 105, and pixel circuit P of the portion A in FIG. 8, for example. This can be applied to later-described basic examples and embodiments.

Transition property irregularities at the time of switching the driving pulse from a low-level state to a high-level state, or from a high-level state to a low-level state influences an operation period regardless of the operation period being determined with a single transistor alone or two transistors. As described above, the transition property thereof is influenced by the property irregularities of the buffer transistor of the final stage of the output circuit.

For example, with the comparative example shown in (A) in FIG. 12, a first buffer transistor TR1 for a first driving pulse P1 which is in an active-high state (or NP1 which is in an active-low state) and a second buffer transistor TR2 for a second driving pulse P2 which is in an active-high state (or NP2 which is in an active-low state) of the same row (same stage) are not laid out in a column (same column) in the ELA irradiation longitudinal direction.

In FIG. 12, (B) illustrates a detailed configuration example of (A) in FIG. 12. Each of the buffer transistors TR1 and TR2 is configured as an inverter buffer wherein a p-type transistor 600P disposed at high-voltage side and an n-type transistor 600N disposed at low-voltage side are cascade-connected. The p-type transistor 600P and n-type transistor 600N making up the buffer transistors TR1 and TR2 respectively are collectively referred to a buffer transistor 600.

With the p-type transistor 600P, multiple (four, in the present example) gate electrodes 614GP extending in one direction on an unshown n-type substrate are provided mutually in parallel, and the area immediately beneath a gate electrode 614GN provided on the surface of the n-type substrate is a channel area 616P. The areas between the channel areas 616P on the surface of the n-type substrate are source areas 618P or drain areas 620P, and the source areas 618P and drain areas 620P are arrayed alternately. Thus, multiple p-type transistors 600P_@ (@ is 1 through 4; each is also referred to a divided p-type transistor) are formed, the source areas 618P or drain areas 620P are shared between the p-type transistors 600P_1 through _k which are adjacent to each other. Multiple contacts 622SP and 622DP are arrayed in a column in the longitudinal direction of the gate electrode 614GP on the surfaces of the source areas 618P and drain areas 620P, and each contact 622SP of the source areas 618P is connected in common to an electrode 624H for the first potential Vcc_H.

With the n-type transistor 600N having the same configuration also, multiple (four, in the present example) gate electrodes 614GN extending in one direction on an unshown p-type substrate are provided mutually in parallel, and the area immediately beneath a gate electrode 614GP provided on the surface of the p-type substrate is a channel area 616N. The areas between the channel areas 616N on the surface of the p-type substrate are source areas 618N or drain areas 620N, and the source areas 618N and drain areas 620N are arrayed alternately. Thus, multiple n-type transistors 600N_@ (wherein @ is 1 through 4; each also referred to as a divided n-type transistor) are formed, the source areas 618N or drain areas 620N are shared between the n-type transistors 600N_1 through _k which are adjacent to each other. Multiple contacts 622SN and 622DN are arrayed in a column in the longitudinal direction of the gate electrode 614GN on the surfaces of the source areas 618N and drain areas 620N, and each contact 622SN of the source areas 618N is connected in common to an electrode 624L for the second potential Vss_L.

The gate electrodes 614GP of the p-type transistor 600P, and the gate electrodes 614GN of the n-type transistor 600N are connected in common to a gate electrode 614G, and also the contacts 622DP of the drain areas 620P of the p-type transistor 600P, and the contacts 622DP of the drain areas 620P of the p-type transistor 600P are connected in common to a drain electrode 614D.

In the case of the layout of such a comparative example, as shown in FIG. 10, if there are ELA irradiation output intensity irregularities from one shot to another, during a process for scanning in one direction with an irradiation pitch (e.g., in increments of several lam), the buffer transistors TR1 and TR2 of the same stage are not irradiated with the same ELA irradiation output pulse. As a result thereof, the properties of the buffer transistors TR1 and TR2 of the same stage differ, and the levels of the transition property irregularities between the first driving pulse P1 (NP1) for determining the end timing and the second driving pulse P2 (NP2) for determining the start timing differ, causing irregularities among each row of operation periods.

The levels of the property irregularities of driving pulse waveforms differ between the start side and end side of the operation. There is also a case wherein when the change property at the start side is steep and the change property at the end side is moderate, and conversely, a case wherein when the change property at the start side is moderate and the change property at the end side is steep. Consequently, if the property irregularities of driving pulse waveforms are caused due to laser beam irradiation intensity differing for each stage (row), the operation period from the start to end of an operation differs for each stage (each row), which leads to deterioration in display performance due to the property irregularities for each stage (row) of the buffer transistors.

For example, if description is made by replacing the present example with the organic EL display device 1 according to the first embodiment, the above mentioned case corresponds to a case wherein the buffer transistor (indicated with DS in the drawing) for the scan driving pulse NDS (or DS which is in an active-high state) supplied to the light-emitting control transistor 122, and the buffer transistor (indicated with WS in the drawing) for the write driving pulse WS (or NWS which is in an active-low state) supplied to the sampling transistor 125, of the same row (same stage) are not laid out in a column in the longitudinal direction of ELA irradiation. In this case, if there are ELA irradiation output intensity irregularities among shots, the buffer transistors WS and DS of the same stage are not irradiated with the same ELA irradiation output pulse, the properties of the buffer transistors WS and DS of the same stage differ, and the transition property irregularities between the write driving pulses WS and NWS, and the scan driving pulses DS and NDS occur, which causes mobility correction period irregularities. Irregularities differing from one row to another leads to brightness unevenness among rows.

With the first basic example of the present embodiment, an attention is focused on this point, an arrangement is made wherein the first buffer transistor TR1 for the first driving pulse P1 (NP1), and the second buffer transistor TR2 for the second driving pulse P2 (NP2), of the same row (same stage) are laid out in a column (i.e., disposed in the same row in the longitudinal direction of ELA irradiation), whereby the buffer transistors TR1 and TR2 of the same stage are irradiated with the same ELA irradiation output pulse, even in the case of ELA irradiation output intensity irregularities being caused for each shot. Thus, the properties of the buffer transistors TR1 and TR2 of the same stage can be aligned, and the transition properties of the first driving pulse P1 (NP1) and second driving pulse P2 (NP2) can be made the same at the start and end thereof, and as a result thereof, operation period irregularities for each row (stage) can be suppressed.

Now, in the case of the buffer transistors TR1 and TR2 making up the output circuits, in detail, wherein the p-type transistor 600P and n-type transistor 600N are cascade-connected, being configured as an inverter buffer, there is no need to necessarily lay out all of the transistors 600P_1, 600P_2, 600N_1, and 600N_2 in a column in the longitudinal direction of ELA irradiation, and it is desirable to lay out at least the transistor for determining the transition direction for stipulating the start timing of an operation period, and the transistor for determining the transition direction for stipulating the end timing of the operation period, in a column in the longitudinal direction of ELA irradiation.

Though there are the 16 types of combination with the example shown in FIG. 11A, regardless of whether the switching transistor to which a driving pulse is supplied is an n-type or p-type, the start timing and end timing of an operation period are stipulated depending on which transistor is turned on of the transistors 600P_1 and 600N_1 for the first driving pulse P1 (NP1), and which transistor is turned on of the transistors 600P_2 and 600N_2 for the second driving pulse P2 (NP2), whereby those types can be summarized in four layout patterns.

For example, with the relations as to FIG. 11A, let us say that the second driving pulse P2 (NP2) supplied to the second transistor (lower side in FIG. 11A) for stipulating the start timing of an operation period is first generated at the second driving pulse generating unit, and supplied to the p-type transistors 600P_2 and n-type transistor 600N_2 of the buffer transistor 600_2. Also, let us say that the first driving pulse P1 (NP1) supplied to the first transistor (upper side in FIG. 11A) for stipulating the end timing of an operation period is first generated at the first driving pulse generating unit, and supplied to the p-type transistors 600P_1 and n-type transistor 600N_1 of the buffer transistor 600_1.

In FIG. 13A, (A) is an layout example in a case wherein the start timing of an operation period is stipulated when the p-type transistor 600P_2 for the second pulse P2 (NP2) is turned on to output a high-level pulse, and also the end timing of the operation period is stipulated when the n-type transistor 600N_1 for the first pulse P1 (NP1) is turned on to output a low-level pulse, and the p-type transistor 600P_2 and n-type transistor 600N_1 are laid out in a column in the longitudinal direction of ELA irradiation. With the correspondence as to the examples shown in FIG. 11A, the cases of (A1), (B2), (C3), and (D4) in FIG. 11A correspond to the present example.

In FIG. 13A, (B) is a layout example in a case wherein the start timing of an operation period is stipulated when the n-type transistor 600N_2 for the second pulse P2 (NP2) is turned on to output a low-level pulse, and also the end timing of the operation period is stipulated when the n-type transistor 600N_1 for the first pulse P1 (NP1) is turned on to output a low-level pulse, and the n-type transistors 600N_2 and 600N_1 are laid out in a column in the longitudinal direction of ELA irradiation. With the correspondence as to the examples shown in FIG. 11A, the cases of (A2), (B1), (C4), and (D3) in FIG. 11A correspond to the present example.

In FIG. 13A, (C) is a layout example in a case wherein the start timing of an operation period is stipulated when the p-type transistor 600P_2 for the second pulse P2 (NP2) is turned on to output a high-level pulse, and also the end timing of the operation period is stipulated when the p-type transistor 600P_1 for the first pulse P1 (NP1) is turned on to output a high-level pulse, and the p-type transistors 600P_2 and 600P_1 are laid out in a column in the longitudinal direction of ELA irradiation. With the correspondence as to the examples shown in FIG. 11A, the cases of (A3), (B4), (C1), and (D2) in FIG. 11A correspond to the present example.

In FIG. 13A, (D) is an layout example in a case wherein the start timing of an operation period is stipulated when the n-type transistor 600N_2 for the second pulse P2 (NP2) is turned on to output a low-level pulse, and also the end timing of the operation period is stipulated when the p-type transistor 600P_1 for the first pulse P1 (NP1) is turned on to output a high-level pulse, and the n-type transistor 600N_2 and p-type transistor 600P_1 are laid out in a column in the longitudinal direction of ELA irradiation. With the correspondence as to the examples shown in FIG. 11A, the cases of (A4), (B3), (C2), and (D1) in FIG. 11A correspond to the present example.

In either case, the transition properties of the buffer transistor 600 can be set to the same at the start and end thereof, and as a result thereof, operation period irregularities for each row (stage) can be suppressed.

Improvement Technique

Second Basic Example

Figure 13B:
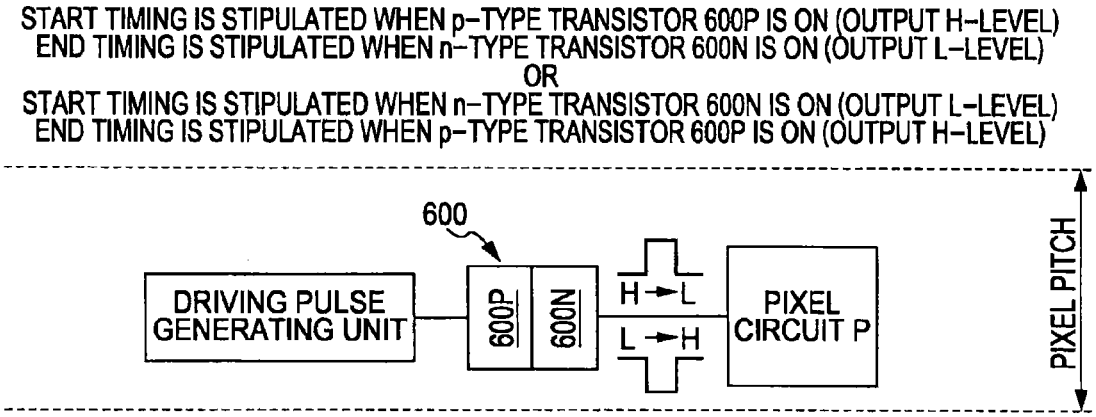
FIG. 13B is a diagram illustrating a second basic example of the driving circuit placement according to the present embodiment.

FIG. 13B is a diagram illustrating a second basic example as to the driving circuit placement (layout) according to the present embodiment whereby brightness irregularities on the display screen due to the irregularities cause at the time of the annealing processing can be alleviated. While the first basic example shown in FIG. 13A corresponds to FIG. 11A, and exemplifies a combination of the layout of the transistors 600P and 600N in the case of an operation period being determined with two transistors, the second basic example shown in FIG. 13B corresponds to FIG. 11B, and exemplifies a combination of the layout of the transistors 600P and 600N in the case of an operation period being determined with a single transistor alone.

Though there are the four types of combination with the example shown in FIG. 11B, regardless of whether the switching transistor to which a driving pulse is supplied is an n-type or p-type, the start timing and end timing of an operation period are stipulated depending on which transistor is turned on and off of the transistors 600P_1 and 600N_1 for a single driving pulse P1 (NP1), whereby those types can be summarized in one layout pattern.

For example, with the relations as to FIG. 11B, let us say that the driving pulse P1 (NP1) is first generated at the driving pulse generating unit, and supplied to the p-type transistor 600P and n-type transistor 600N of the buffer transistor 600. In either case of a case wherein the start timing of an operation period is stipulated when the p-type transistor 600P is turned on to output a high-level pulse, following which the end timing of the operation period is stipulated when the n-type transistor 600N is turned on to output a low-level pulse, or conversely, a case wherein the start timing of an operation period is stipulated when the n-type transistor 600N is turned on to output a low-level pulse, following which the end timing of the operation period is stipulated when the p-type transistor 600P is turned on to output a high-level pulse, it is desired to lay out the p-type transistor 600P and n-type transistor 600N in a column in the longitudinal direction of ELA irradiation. Thus, the p-type transistor 600P and n-type transistor 600N for determining an operation period is laid out so as to be irradiated with the same ELA pulse. The transition properties of the buffer transistor 600 can be set to the same at the start and end thereof, and consequently, operation period irregularities for each row (stage) can be suppressed.

Hereafter, layout examples of the respective transistors will be described in accordance with specific cases. Note that in the diagrams illustrating a layout example, layout overview is shown in (A), and layout details are shown in (B). All of the detailed layouts (B) are shown with a case employing a multi-finger configuration.

Improvement Technique

First Embodiment

Figure 14:
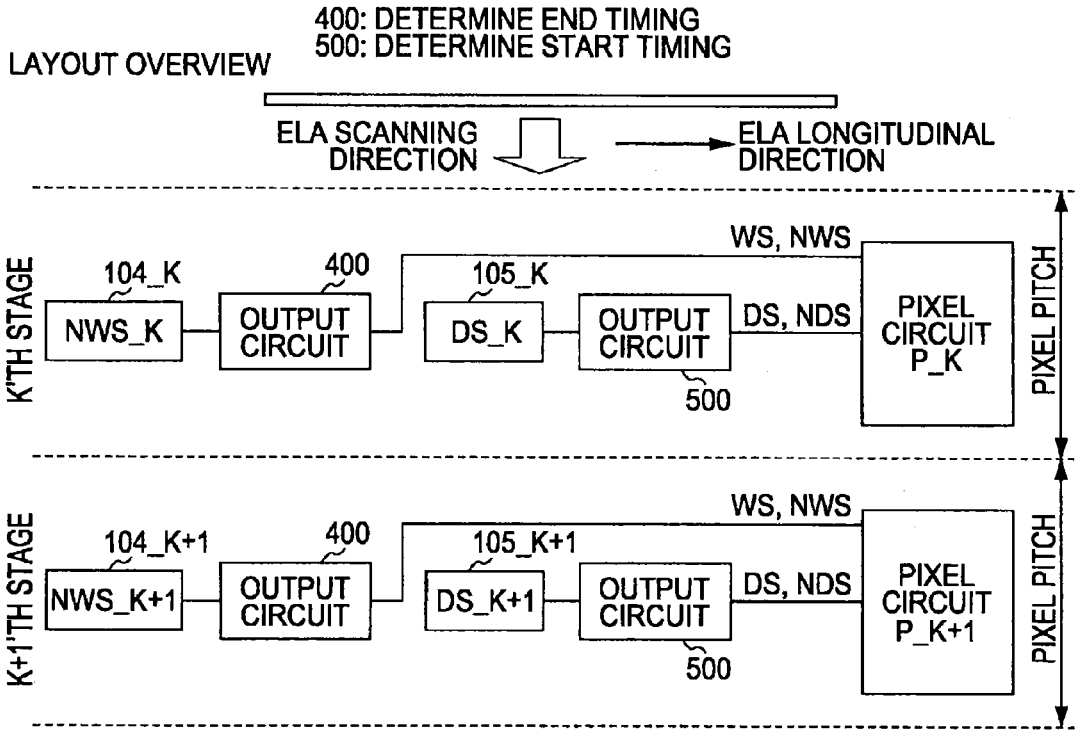
FIG. 14 is a diagram illustrating a first embodiment of the driving circuit placement.

FIG. 14 is a diagram illustrating a first embodiment of the driving circuit placement (layout) whereby brightness irregularities on the display screen due to the irregularities cause at the time of the annealing processing can be alleviated. FIG. 14 illustrates the relations between circuits 104_K, 104_K+1, 105_K, and 105_K+1 for outputting driving pulses (write driving pulses NWS_K and NWS_K+1 and scan driving pulses DS_K and DS_K+1) of the K'th and K+1'th stage of each of the write scanning unit 104 and drive scanning unit 105, output circuits 400_K, 400_K+1, 500_K, and 500_K+1 of each stage, and pixel circuits P_K and P_K+1, in the longitudinal direction of ELA irradiation. This can mostly be applied to later-described other embodiments.

A layout according to the first embodiment is an example wherein like the organic EL display device 1 according to the first embodiment, in the case of an operation period being determined with the ON period or OFF period of two transistors, the light-emitting control transistor 122 and sampling transistor 125 are included in the pixel circuit P as the two transistors. In this case, the output circuit 400 including a buffer transistor for outputting the active-high write driving pulse WS for driving the sampling transistor 125, and the output circuit 500 including a buffer transistor for outputting the active-low scan driving pulse NDS for driving the light-emitting control transistor 122 are disposed in a column in the longitudinal direction (also referred to as the ELA irradiation longitudinal direction) orthogonal to the scanning direction of ELA irradiation.

Here, in reality, the output circuits 400 and 500 are mostly configured as an inverter buffer wherein a p-type transistor and an n-type transistor are cascade-connected so as to have sufficient driving ability in either of when a pulse signal makes the transition from a low-level state to a high-level state, or conversely when a pulse signal makes the transition from a high-level state to a low-level state, and various types of modes can be taken regarding whether to dispose which transistors of the p-type transistors and n-type transistors within the output circuits 400 and 500 in a column in the ELA irradiation longitudinal direction. At this time, as described above, it is desirable to preferentially dispose the transistors for stipulating the transition direction for determining an operation period (e.g., threshold correction period, mobility correction period, etc.) in a column in the ELA irradiation longitudinal direction, and it is unnecessary to necessarily dispose the other transistors in a column in the ELA irradiation longitudinal direction. Hereafter, the write driving pulse WS (NWS) and scan driving pulse NDS (DS) will be described specifically.

Improvement Technique

Second Embodiment

Figure 15A:
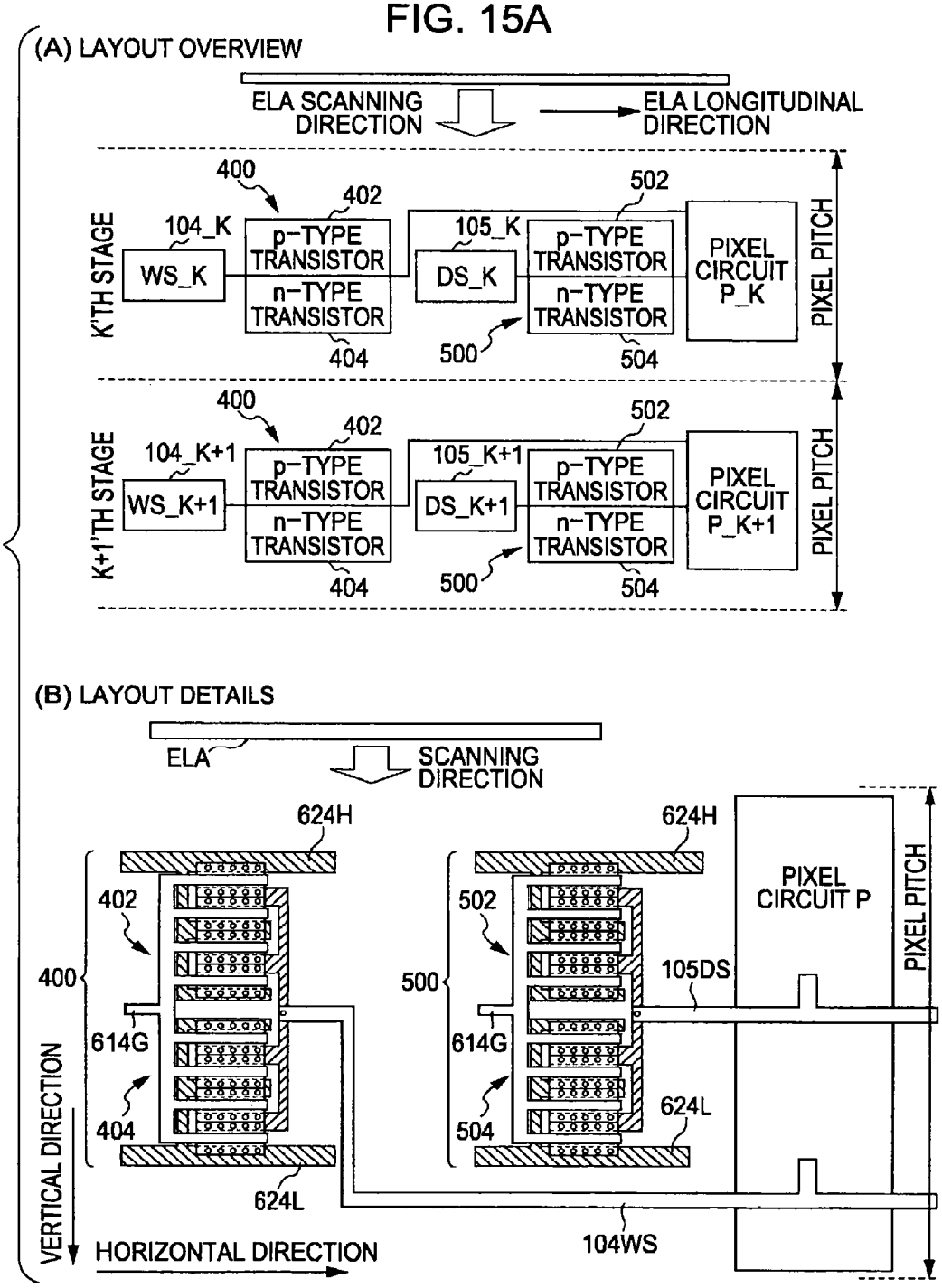
FIG. 15A is a diagram illustrating a second embodiment (first example) of the driving circuit placement.
Figure 15B:
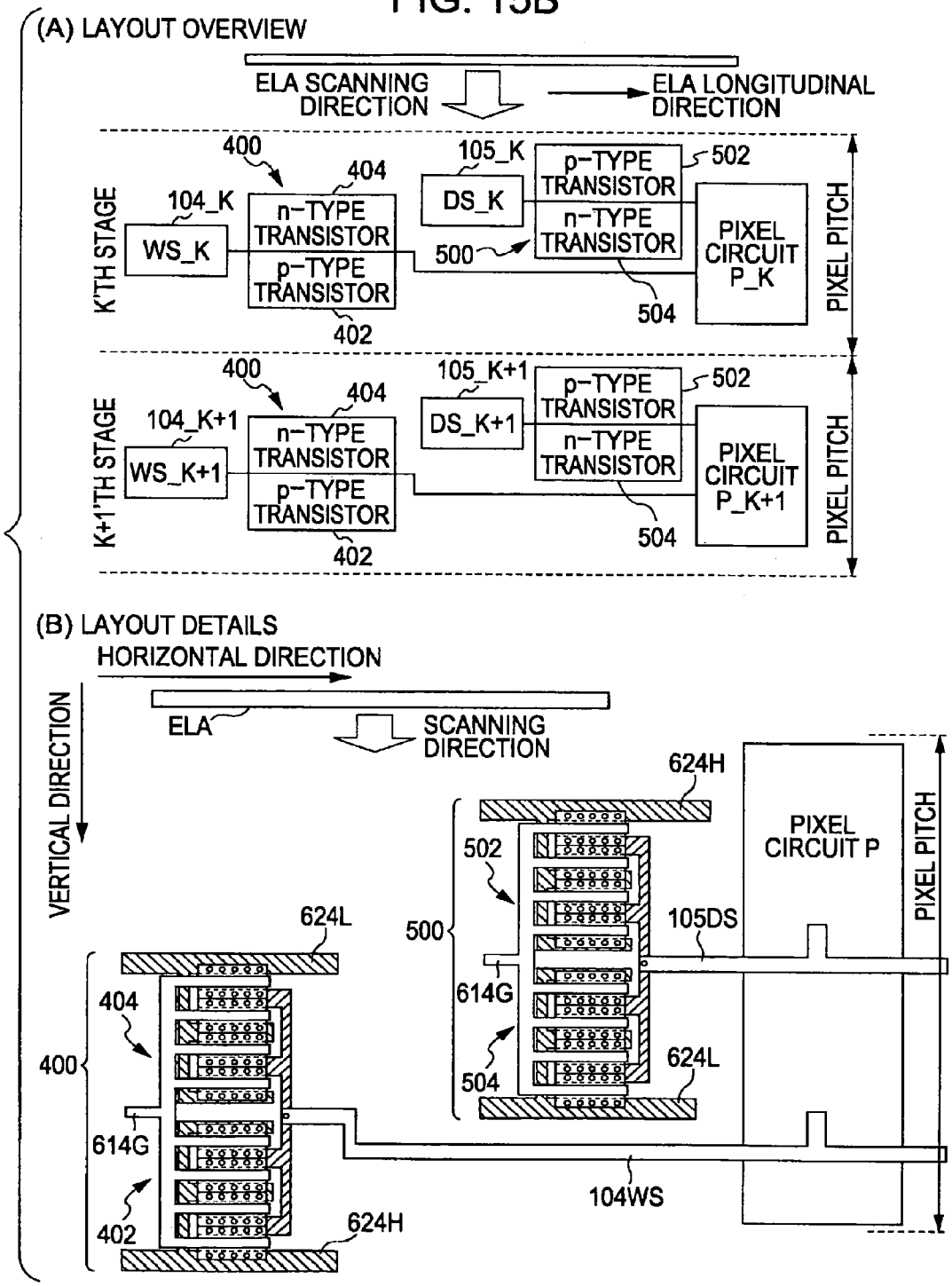
FIG. 15B is a diagram illustrating the second embodiment (second example) of the driving circuit placement.

FIGS. 15A and 15B are diagrams illustrating a second embodiment of the driving circuit placement (layout) whereby brightness irregularities on the display screen due to the irregularities cause at the time of the annealing processing can be alleviated.

A layout according to the second embodiment is an example wherein in the case of an operation period being determined with the ON period or OFF period of two transistors, the n-type light-emitting control transistor 122 and p-type sampling transistor 125 are included in the pixel circuit P as the two transistors. As for a driving timing example, as shown in FIG. 4, there is employed a case wherein upon the scan driving pulse NDS going to an active-low state during an active-high period of the write driving pulse WS, the mobility correction period starts, following which upon the write driving pulse WS going to an inactive-low state while the scan driving pulse NDS is kept in an active-low state, the mobility correction period ends.

The output circuit 400 is configured of the p-type transistor 402 and n-type transistor 404, and the output circuit 500 is configured of the p-type transistor 502 and n-type transistor 504, each of which serves as an inverter buffer. With the pixel circuit P and timing chart according to the first embodiment, when the scan driving pulse NDS turns into an active-low state, i.e., when the n-type transistor 504 of the output circuit 500 is turned on, the start timing of the mobility correction period is determined, and when the write driving pulse WS turns into an inactive-low state, i.e., when the n-type transistor 404 of the output circuit 400 is turned on, the end timing of the mobility correction period is determined. Focusing attention on this point, it is desirable to dispose at least the n-type transistors 404 and 504 in a column as to the ELA irradiation longitudinal direction (i.e., in the same column as the ELA irradiation longitudinal direction).

In this case, as with the first example shown in FIG. 15A, it can be conceived to dispose the same polarity pair (p-type transistors 402 and 502 or n-type transistors 404 and 504) in the same column as the ELA irradiation longitudinal direction. Also, it is desirable to dispose at least the n-type transistors 404 and 504 in the same column as the ELA irradiation longitudinal direction, so like the second example shown in FIG. 15B, an arrangement may be made wherein only the n-type transistors 404 and 504 are disposed in the same column as the ELA irradiation longitudinal direction, and the p-type transistors 402 and 502 are not disposed in the same column as the ELA irradiation longitudinal direction. That is to say, giving consideration to that only the n-type transistors 404 and 504 determine the mobility correction period, there is no need to dispose the p-type transistors 402 and 502 in the same column as the ELA irradiation longitudinal direction.

Pixel Circuit

Second Embodiment

Figure 16A:
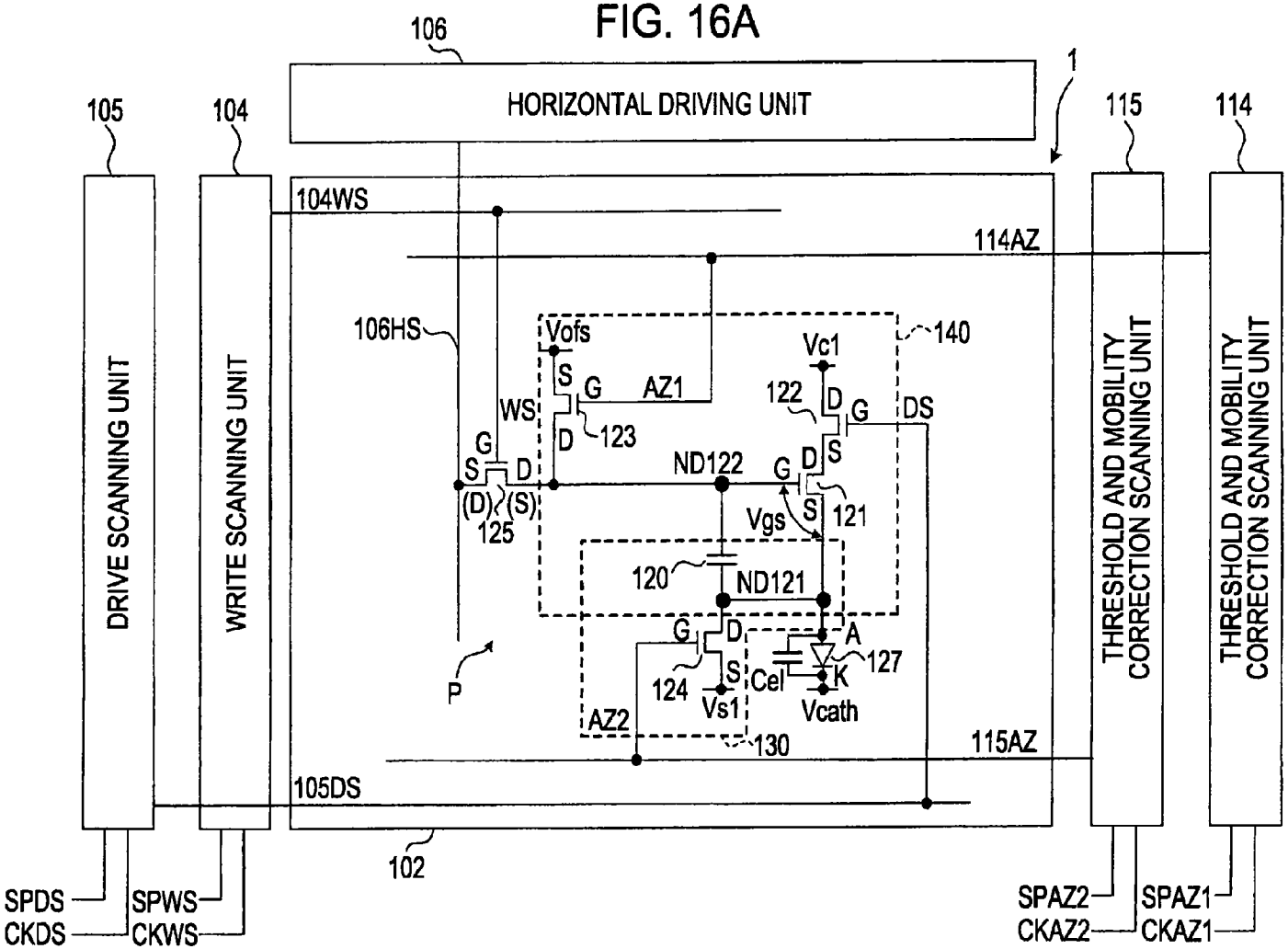
FIG. 16A is a diagram illustrating a second embodiment of a pixel circuit making up an organic EL display device.

FIG. 16A is a diagram illustrating a second embodiment of the pixel circuits P making up the organic EL display device 1 shown in FIGS. 1 and 1A. Note that FIG. 16A also illustrates the vertical driving unit 103 and horizontal driving unit 106 provided on the peripheral portion of the pixel circuits P on the substrate 101 of the display panel unit 100.

With the pixel circuit P according to the first embodiment, the p-channel type is employed as the light-emitting control transistor, but with the second embodiment, the n-channel type including the gate terminal G serving as the control input terminal to which an active-high driving pulse (scan driving pulse DS) is supplied is employed instead of the p-channel type. With the n-channel type light-emitting transistor 122, the drain terminal D is connected to the first power supply potential Vc1, and the source terminal S is connected to the drain terminal D of the driving transistor 121.

In this case, all the switching transistors can be configured of an n-channel type transistor, which enables an existing amorphous silicon (a-Si) process to be employed at the time of creating transistors. Thus, reduction in cost of the transistor substrate can be realized. In this point, the pixel circuit P according to the first embodiment employs the p-type as the light-emitting control transistor, which is disadvantageous.

Operation of Pixel Circuit

Second Embodiment

Figure 16B:
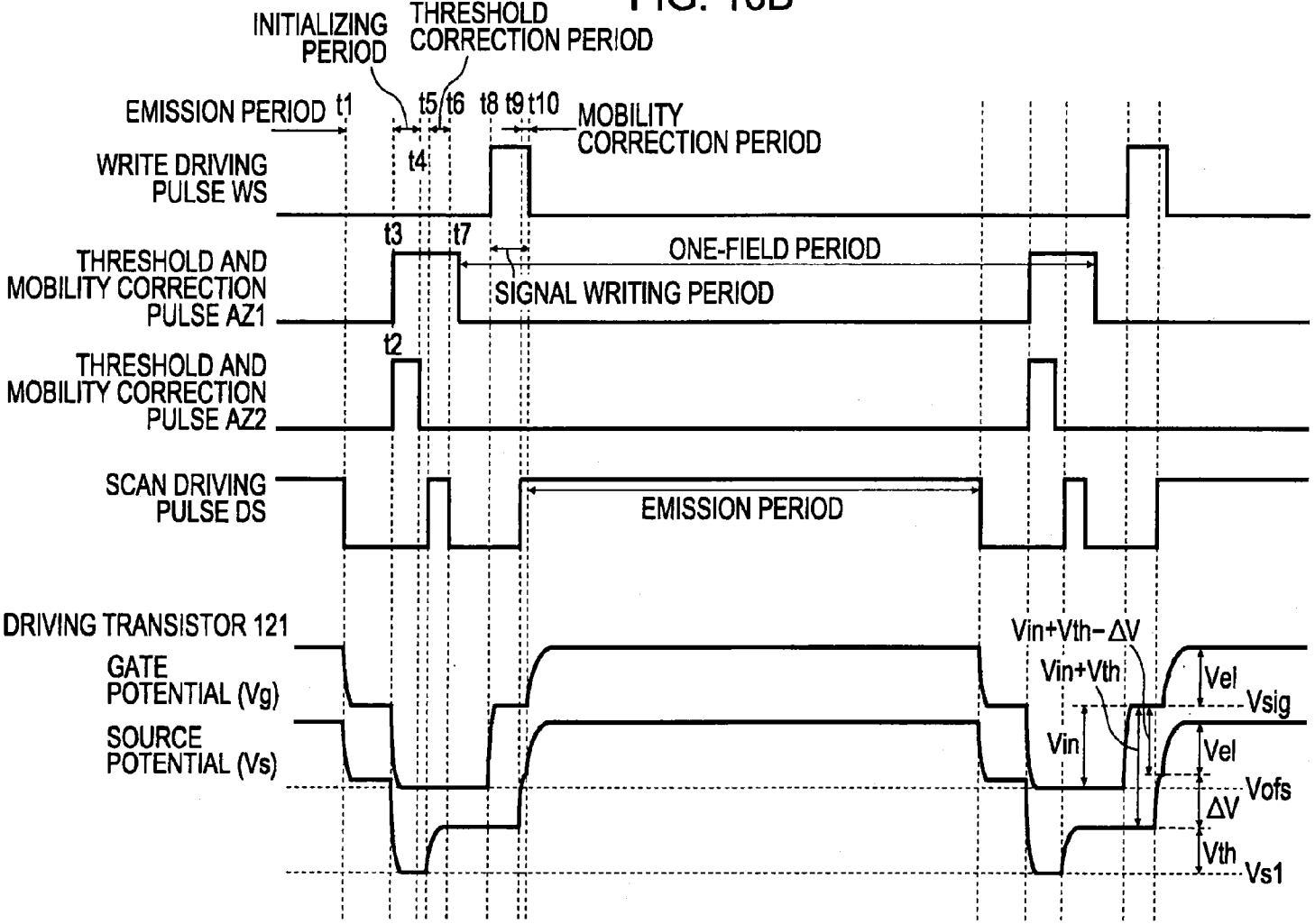
FIG. 16B is a timing chart describing the operation of a pixel circuit according to the second embodiment.

FIG. 16B is a timing chart describing the operation of the pixel circuit P according to the second embodiment. As to the timing chart according to the first embodiment shown in FIG. 4 of driving the pixel circuit P according to the first embodiment, except that modification is made so as to drive the light-emitting transistor 122 by the active-high scan driving pulse DS, the timing according to the second embodiment is the same as the timing according to the first embodiment shown in FIG. 4. The detailed description of the operation thereof will be omitted here.

Improvement Technique

Third Embodiment

Figure 17A:
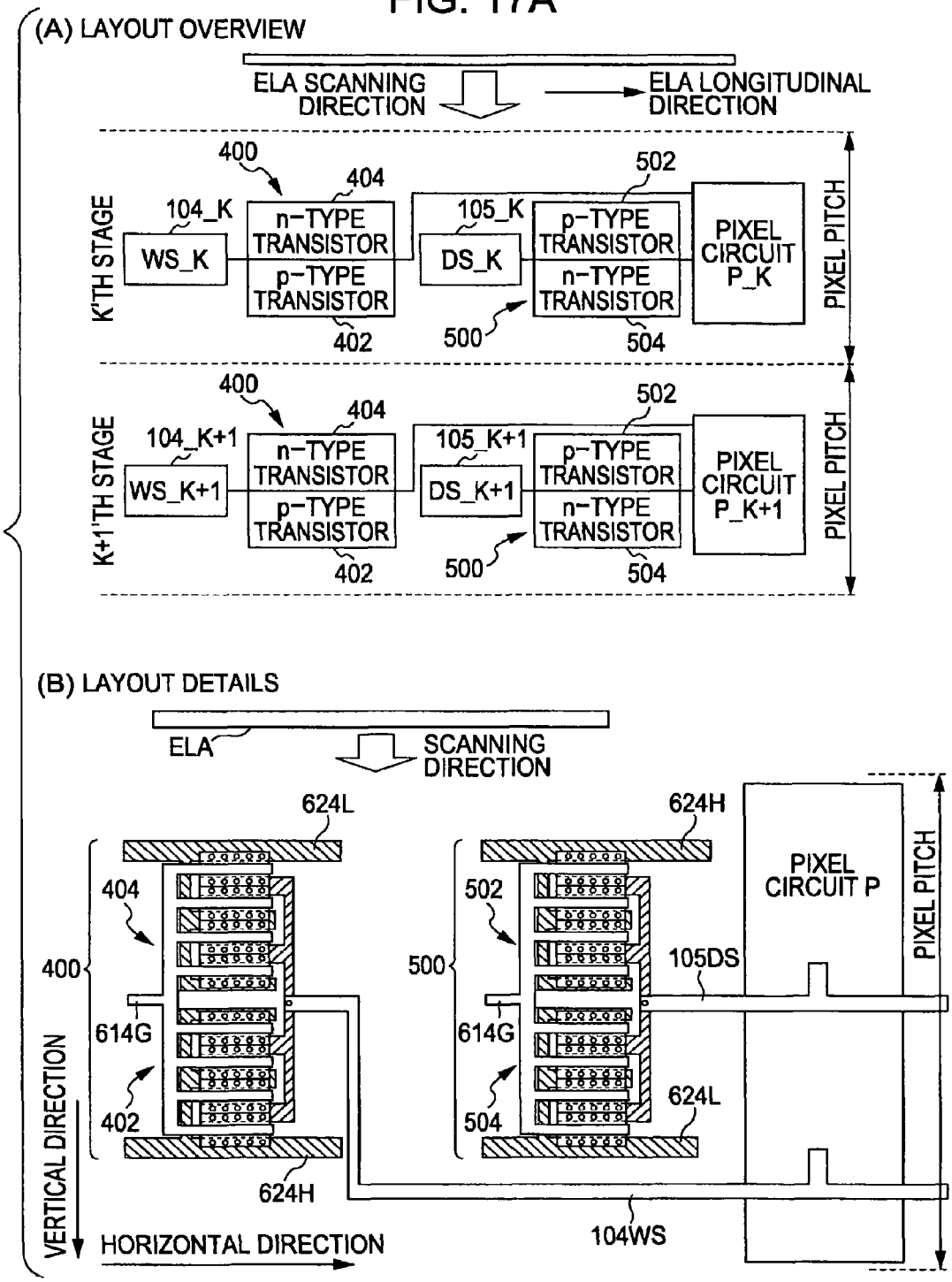
FIG. 17A is a diagram illustrating a third embodiment (first example) of the driving circuit placement.
Figure 17B:
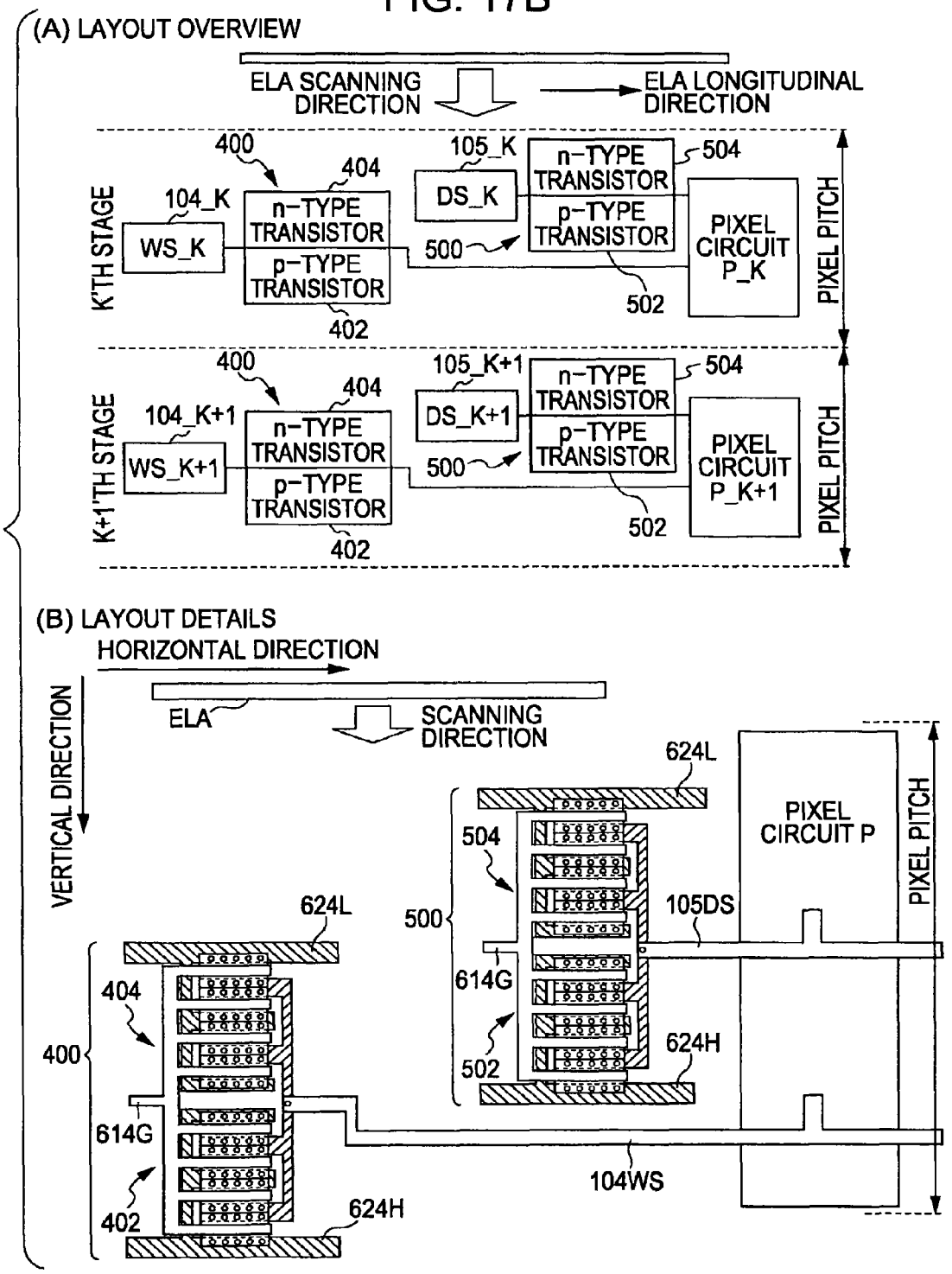
FIG. 17B is a diagram illustrating the third embodiment (second example) of the driving circuit placement.

FIGS. 17A and 17B are diagrams illustrating a third embodiment of the driving circuit placement (layout) whereby brightness irregularities on the display screen due to the irregularities cause at the time of the annealing processing can be alleviated.

A layout according to the third embodiment corresponds to timing for driving the pixel circuit P according to the second embodiment shown in FIG. 16A and the pixel circuit P according to the second embodiment shown in FIG. 16B. That is to say, as shown in FIG. 16B, as for a driving timing example, there is employed a case wherein upon the scan driving pulse DS going to an active-high state during an active-high period of the write driving pulse WS, the mobility correction period starts, following which, upon the write driving pulse WS going to an inactive-low state while the scan driving pulse DS is kept in an active-high state, the mobility correction period ends.

The output circuit 400 is configured of the p-type transistor 402 and n-type transistor 404, and the output circuit 500 is configured of the p-type transistor 502 and n-type transistor 504, each of which serves as an inverter buffer. With the pixel circuit P and timing chart according to the second embodiment, when the scan driving pulse DS turns into an active-high state, i.e., when the p-type transistor 502 of the output circuit 500 is turned on, the start timing of the mobility correction period is determined, and when the write driving pulse WS turns into an inactive-low state, i.e., when the n-type transistor 404 of the output circuit 400 is turned on, the end timing of the mobility correction period is determined. Focusing attention on this point, it is desirable to dispose at least the n-type transistor 404 and p-type transistor 502 in the same column as the ELA irradiation longitudinal direction.

In this case, as with the first example shown in FIG. 17A, it can be conceived to dispose the n-type transistor 404 and p-type transistor 502, and the p-type transistors 402 and n-type transistor 504 in the same column as the ELA irradiation longitudinal direction. Also, it is desirable to dispose at least the n-type transistor 404 and p-type transistor 502 in the same column as the ELA irradiation longitudinal direction, so like the second example shown in FIG. 13B, an arrangement may be made wherein only the n-type transistor 404 and p-type transistor 502 are disposed in the same column as the ELA irradiation longitudinal direction, and the p-type transistors 402 and n-type transistor 504 are not disposed in the same column as the ELA irradiation longitudinal direction. That is to say, giving consideration to that only the n-type transistor 404 and p-type transistor 502 determine the mobility correction period, there is no need to dispose the p-type transistor 402 and n-type transistor 504 in the same column as the ELA irradiation longitudinal direction.

<Modification>

Though not shown in the drawing, in a case wherein when the scan driving pulse DS turns into an active-high state, i.e., when the p-type transistor 502 of the output circuit 500 is turned on, the start timing of the mobility correction period is determined, and when the write driving pulse WS turns into an active-high state, i.e., when the p-type transistor 402 of the output circuit 400 is turned on, the end timing of the mobility correction period is determined, it is desirable to dispose at least the p-type transistor 402 and p-type transistor 502 in the same column as the ELA irradiation longitudinal direction. Also, in a case wherein when the scan driving pulse DS turns into an active-low state, i.e., when the n-type transistor 504 of the output circuit 500 is turned on, the start timing of the mobility correction period is determined, and when the write driving pulse WS turns into an active-high state, i.e., when the p-type transistor 402 of the output circuit 400 is turned on, the end timing of the mobility correction period is determined, it is desirable to dispose at least the p-type transistor 402 and n-type transistor 504 in the same column as the ELA irradiation longitudinal direction.

Also, as shown in FIG. 9, in a case wherein the transition state (change property) of the write driving pulse WS is inclined when turning off the sampling transistor 125, whereby the mobility correction period automatically follows the picture signal potential (the signal potential Vin of the picture signal Vsig), a function for inclining the transition state (change property) can be realized by gradually inactivating the transistor at the side for activating the write driving pulse WS of the output circuit 400.

Output Circuit of Vertical Scanning System

Modification as to First Example

Figure 18A:
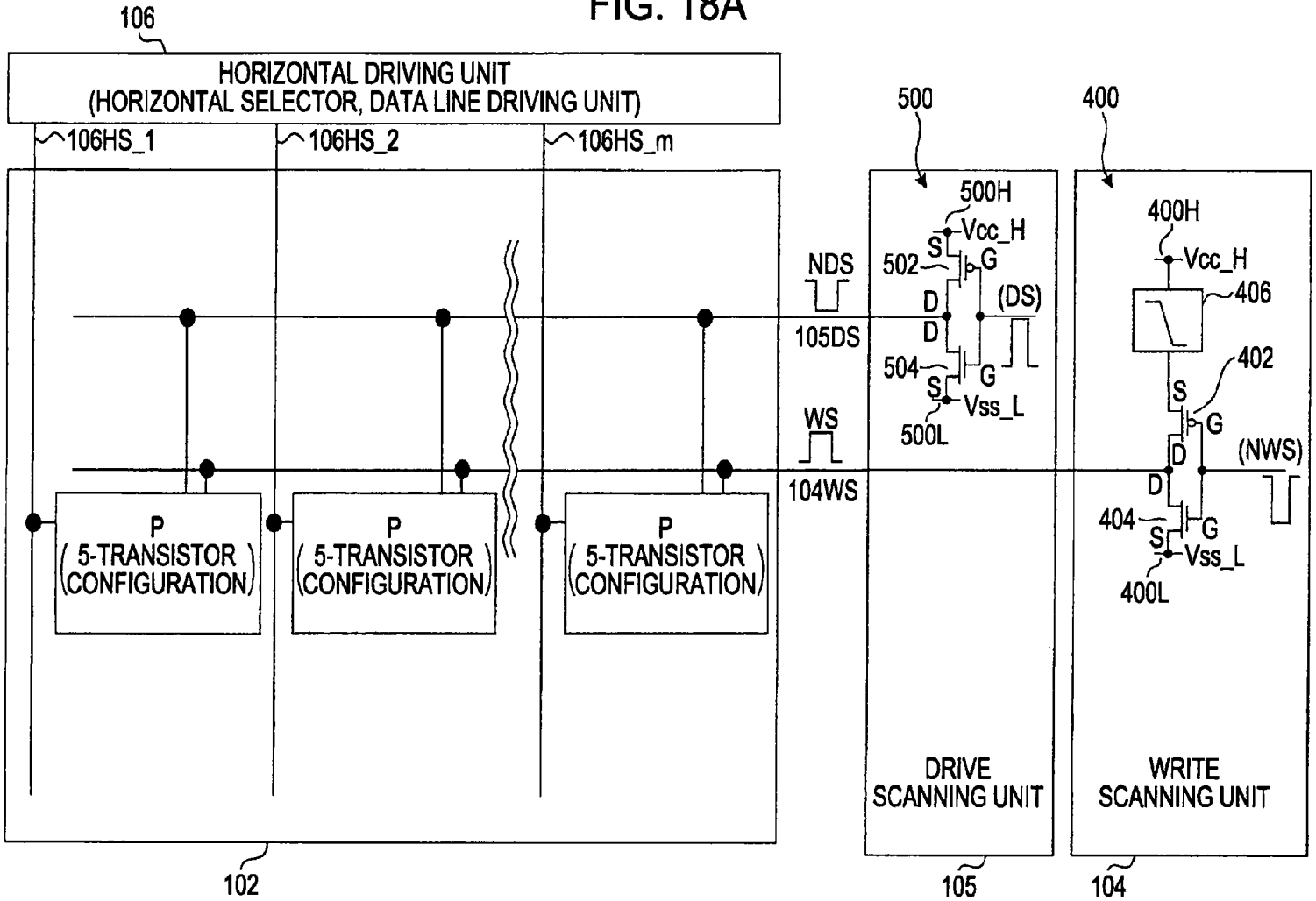
FIG. 18A is a diagram describing a modification as to the first example of the output circuits of a write scanning unit and a drive scanning unit.
Figure 18B:
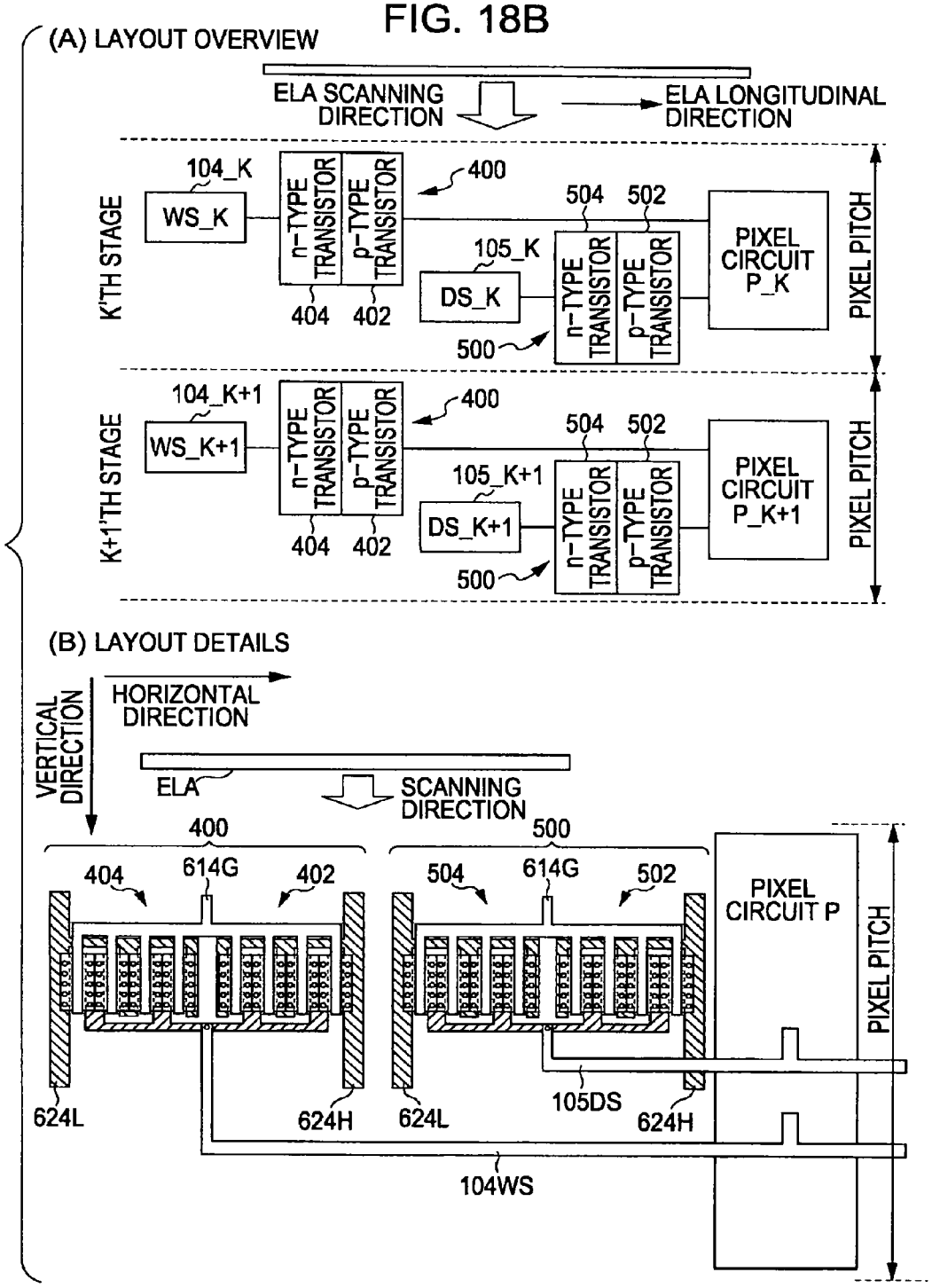
FIG. 18B is a diagram illustrating a fourth embodiment (first example) of the driving circuit placement.

FIG. 18A is a diagram describing a modification as to the first example of the output circuits of the write scanning unit 104 and drive scanning unit 105. With the first example, the output circuits 400 and 500 have the same configuration, but with this modification, as shown in FIG. 9, an arrangement is made wherein the transition state (change property) of the write driving pulse WS is inclined when turning off the sampling transistor 125, whereby the mobility correction period automatically follows the picture signal potential (the signal potential Vin of the picture signal Vsig).

In this case, a write driving pulse generating unit 406 for generating a write driving pulse WS having a inclination in the transition state (change property) at the time of OFF is provided between the supply terminal 400H for the first potential Vcc_H and the p-type transistor 402. Thus, an external power supply pulse is output via the p-type transistor 402.

Therefore, for example, with the pixel circuit P according to the first embodiment, in a case wherein when the scan driving pulse NDS turns into an active-low state, i.e., when the n-type transistor 504 of the output circuit 500 is turned on, the start timing of the mobility correction period is determined, and when the write driving pulse WS turns into an inactive-low state, i.e., when the p-type transistor 402 of the output circuit 400 is gradually turned off, the end timing of the mobility correction period is determined, it is desirable to dispose at least the p-type transistor 402 and n-type transistor 504 in the same column as the ELA irradiation longitudinal direction.

Also, with the pixel circuit P according to the first embodiment, when replacing the sampling transistor 125 with a p-type transistor driven by the active-low write driving pulse NWS, when the scan driving pulse NDS turns into an active-low state, i.e., when the n-type transistor 504 of the output circuit 500 is turned on, the start timing of the mobility correction period is determined, and when the write driving pulse NWS turns into an inactive-high state, i.e., when the n-type transistor 404 of the output circuit 400 is gradually turned off, the end timing of the mobility correction period is determined, it is desirable to dispose at least the n-type transistor 404 and n-type transistor 504 in a column as to the ELA irradiation longitudinal direction (i.e., in the same column as the ELA irradiation longitudinal direction).

Also, with the pixel circuit P according to the second embodiment, when the scan driving pulse DS turns into an active-high state, i.e., when the p-type transistor 502 of the output circuit 500 is turned on, the start timing of the mobility correction period is determined, and when the write driving pulse WS turns into an inactive-low state, i.e., when the p-type transistor 402 of the output circuit 400 is gradually turned off, the end timing of the mobility correction period is determined, it is desirable to dispose at least the p-type transistor 402 and p-type transistor 502 in the same column as the ELA irradiation longitudinal direction.

Also, with the pixel circuit P according to the second embodiment, when replacing the sampling transistor 125 with a p-type transistor driven by the active-low write driving pulse NWS, when the scan driving pulse DS turns into an active-high state, i.e., when the p-type transistor 502 of the output circuit 500 is turned on, the start timing of the mobility correction period is determined, and when the write driving pulse NWS turns into an inactive-high state, i.e., when the n-type transistor 404 of the output circuit 400 is gradually turned off, the end timing of the mobility correction period is determined, it is desirable to dispose at least the n-type transistor 404 and p-type transistor 502 in the same column as the ELA irradiation longitudinal direction.

Improvement Technique

Fourth Embodiment

FIGS. 18B through 18E are diagrams illustrating a fourth embodiment of the driving circuit placement (layout) whereby brightness irregularities on the display screen due to the irregularities cause at the time of the annealing processing can be alleviated.

A layout according to the fourth embodiment has features in that all of the p-type transistor 402 and n-type transistor 404 of the output circuit 400, and the p-type transistor 502 and n-type transistor 504 of the output circuit 500 are disposed in the same column as the ELA irradiation longitudinal direction.

Thus, regardless of whether the light-emitting control transistor 122 or sampling transistor 125 is a n-type or p-type, or whether to determine the start timing and end timing of an operation period (threshold correction period or mobility correction period) when the light-emitting control transistor 122 or sampling transistor 125 is turned on or off, the properties of the respective buffer transistors of the same stage for determining the start timing and end timing can be aligned. Thus, the transition properties of the respective driving pulses (write driving pulses WS and NWS, and scan driving pulses DS and NDS) can be set to the same at the start and end thereof, whereby operation period irregularities for each row (stage) can be suppressed.

It becomes unnecessary to perform such a case by case approach regarding the polarities (n-type/p-type) of the switching transistors 122 and 125, and the polarities (n-type/p-type) of the buffer transistors 400 and 500 for determining each timing of the start/end of an operation period. The bipolar buffer transistors of the output circuits 400 and 500 are disposed in the same column as the ELA irradiation longitudinal direction, whereby correction period irregularities can be suppressed even as to what kind of drive, and a more desirable layout can be provided.

Note that in the case of the layout according to the fourth embodiment, as long as the p-type transistors 402 and 502, and the n-type transistors 404 and 504 are disposed in the same column as the ELA irradiation longitudinal direction, the placement order thereof is arbitrary.

Accordingly, for example, as with the first example shown in FIG. 18A, in order of the n-type transistor 404, p-type transistor 402, n-type transistor 504, and p-type transistor 502 may be disposed so as to approach the pixel array unit 102 (pixel circuit P). Alternatively, as with the second example shown in FIG. 18B, in order of the p-type transistor 402, n-type transistor 404, p-type transistor 502, and n-type transistor 504 may be disposed so as to approach the pixel array unit 102 (pixel circuit P).

Figure 18C:
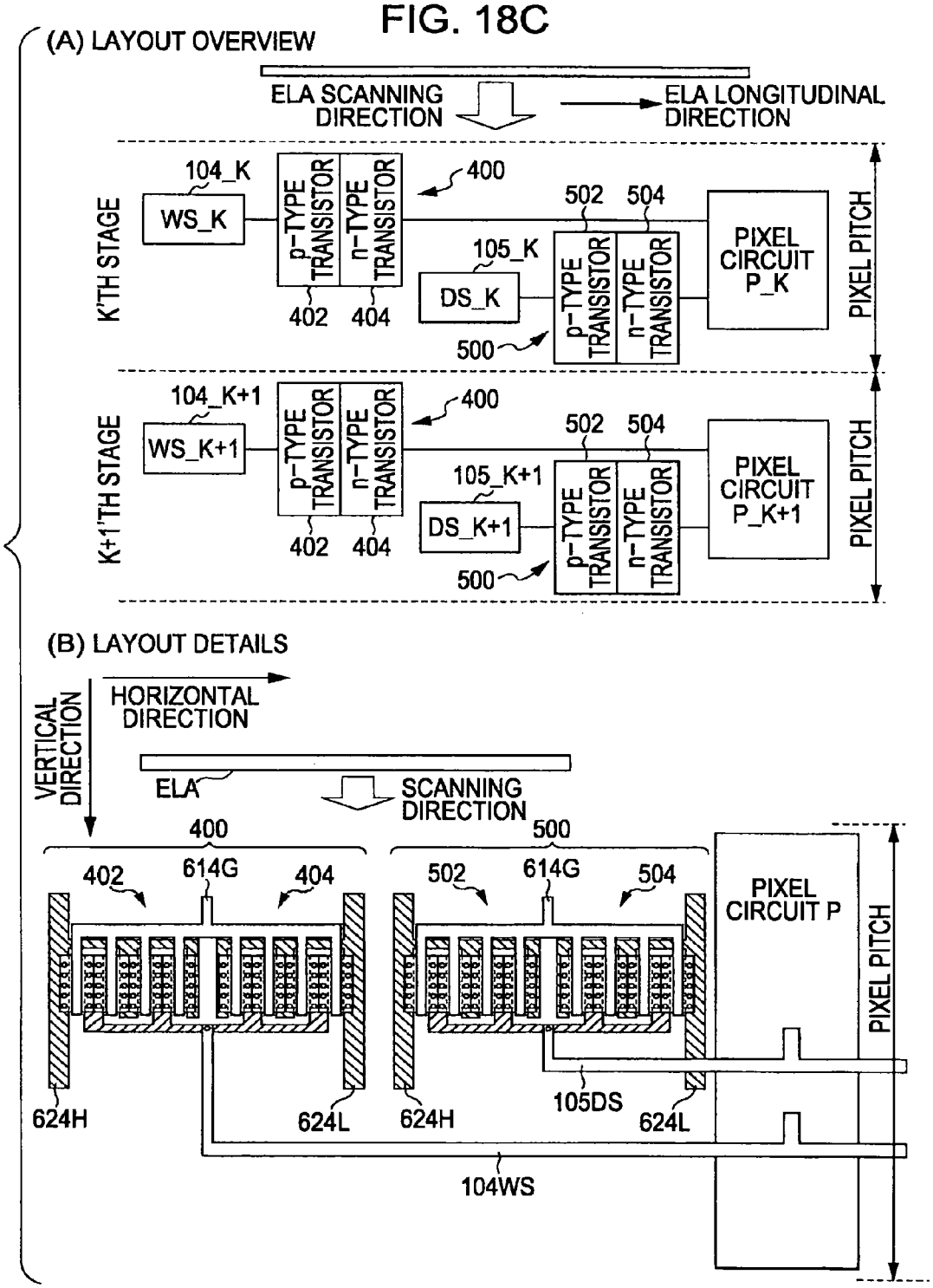
FIG. 18C is a diagram illustrating the fourth embodiment (second example) of the driving circuit placement.
Figure 18D:
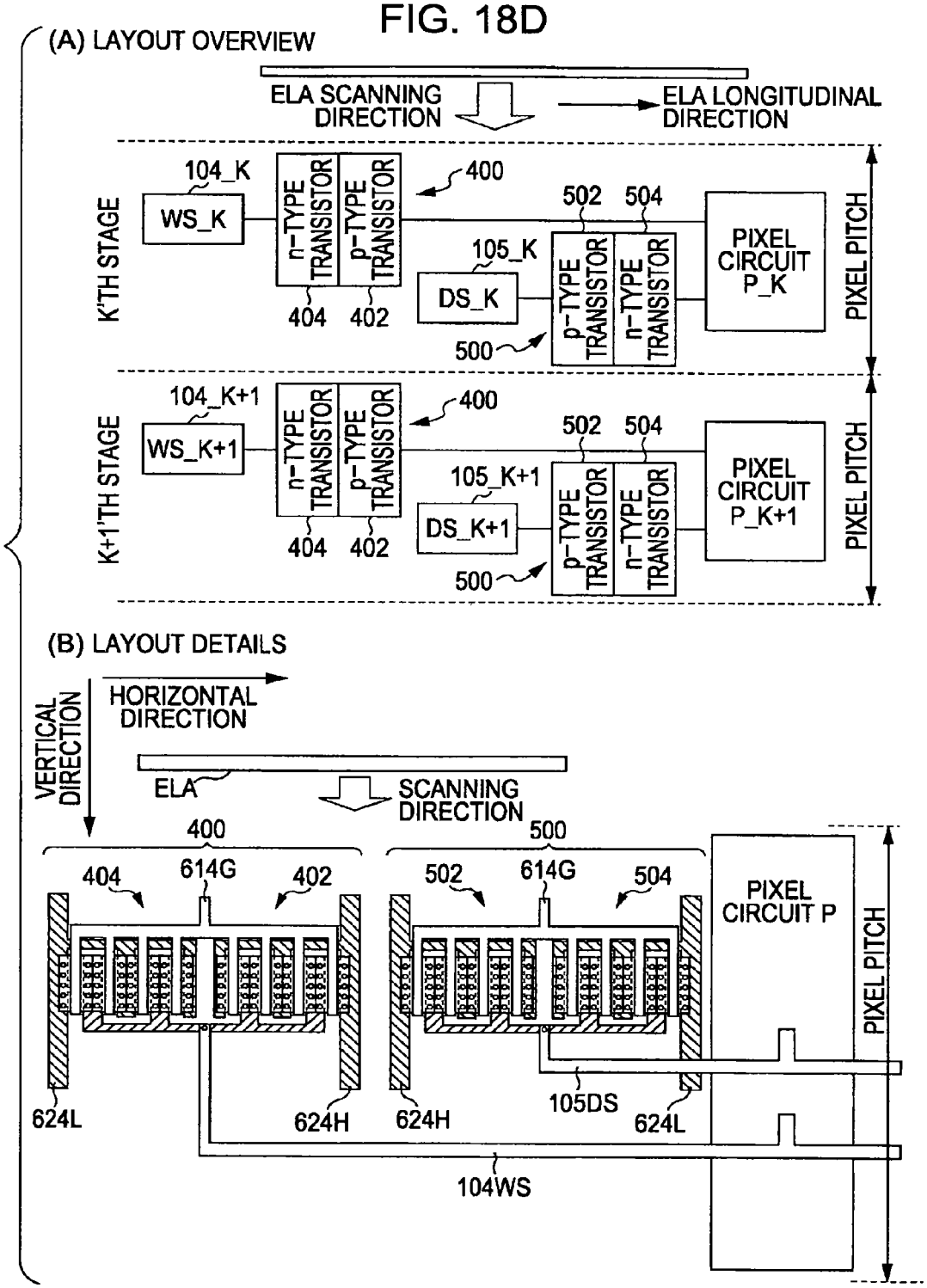
FIG. 18D is a diagram illustrating the fourth embodiment (third example) of the driving circuit placement.
Figure 18E:
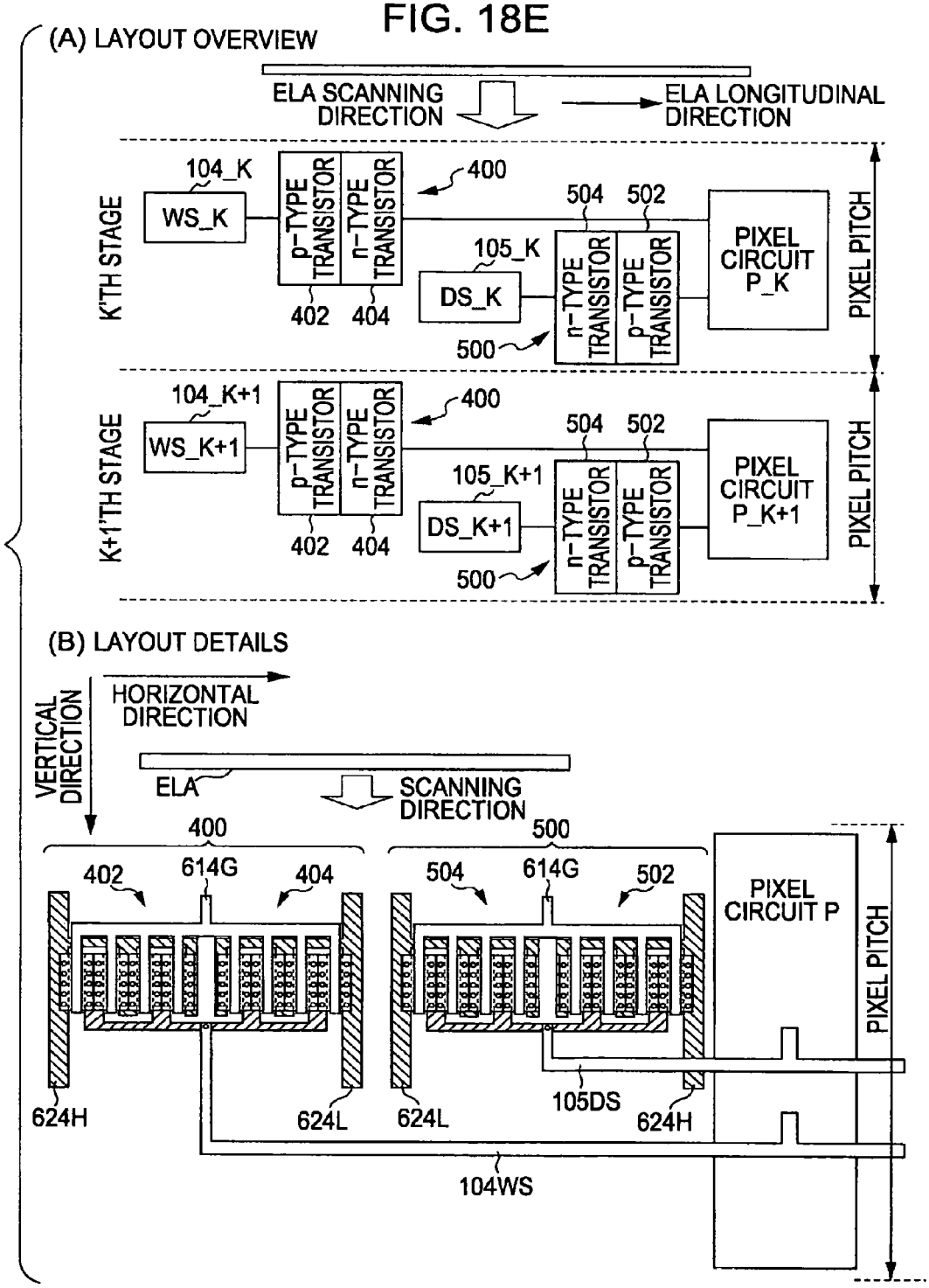
FIG. 18E is a diagram illustrating the fourth embodiment (fourth example) of the driving circuit placement.

Alternatively, as with the third example shown in FIG. 18C, in order of the N-type transistor 404, p-type transistor 402, p-type transistor 502, and n-type transistor 504 may be disposed so as to approach the pixel array unit 102 (pixel circuit P). Alternatively, as with the fourth example shown in FIG. 18D, in order of the p-type transistor 402, n-type transistor 404, n-type transistor 504, and p-type transistor 502 may be disposed so as to approach the pixel array unit 102 (pixel circuit P). Also, with the respective diagrams according to the fourth embodiment, the placement orders of the respective stages are all set to the same, but an arrangement may be made wherein any of the first example shown in FIG. 18A through the fourth example shown in FIG. 18D is switched for each stage.

Output Circuit of Vertical Scanning System

Second Example

Figure 19:
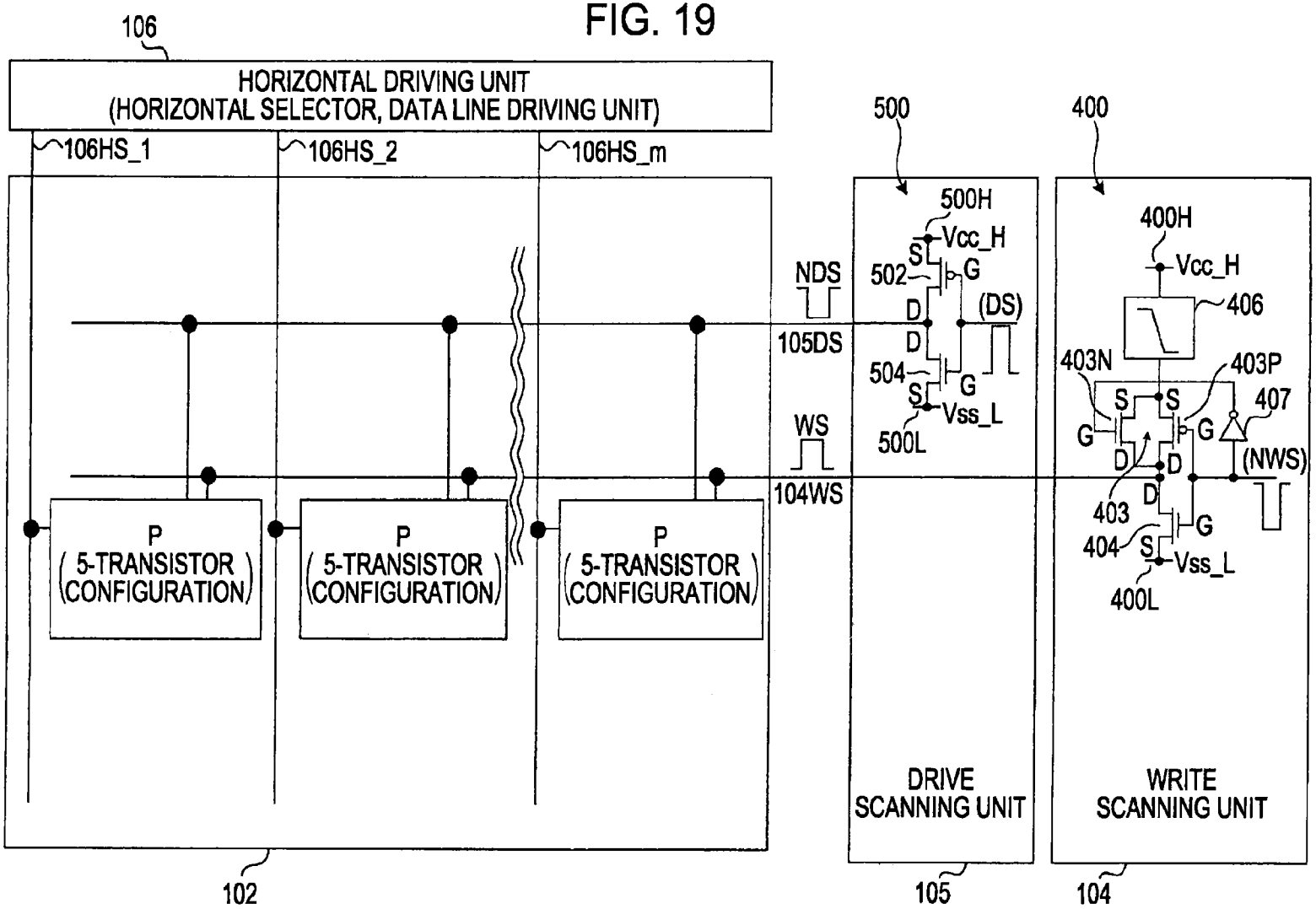
FIG. 19 is a diagram describing a second example of the output circuits of a write scanning unit and a drive scanning unit.

FIG. 19 is a diagram describing a second example of the output circuits of the write scanning unit 104 and drive scanning unit 105. With the first example, the output circuits 400 and 500 have the same configuration, but in the same way as with the modification as to the first example shown in FIG. 18A, as shown in FIG. 9, the second example has features in that the p-type transistor 402 is replaced with an analog switch having a transfer gate configuration in a case wherein the transition state (change property) of the write driving pulse WS is inclined when turning off the sampling transistor 125, whereby the mobility correction period automatically follows the picture signal potential (the signal potential Vin of the picture signal Vsig).

Specifically, instead of the p-type transistor 402, there is provided an analog switch 403 having a transfer gate configuration wherein with two CMOS SW transistors 403P and 403N each having a CMOS configuration and a different polarity which are formed by complementary circuit technology, the source terminals S are connected to each other, and the drain terminals D are connected to each other. Also, as shown in FIG. 9, there are provided a write driving pulse generating unit 406 for generating a write driving pulse WS having a inclination in the transition state (change property) at the time of the sampling transistor 125 being in an OFF state, and an inverter 407 for logic-inverting the write driving pulse NWS.

The input terminals (source terminals S side) of the SW transistors 403P and 403N making up the analog switch 403 are connected to the output side of the write driving pulse generating unit 406, and the output terminals (drain terminals D side) of the SW transistors 403P and 403N are connected to the write scanning line 104WS together with the drain terminal D of the n-type transistor 404. The write driving pulse NWS is supplied to the gate terminal G of the SW transistor 403P, and the write driving pulse WS logic-inverted at the inverter 407 is supplied to the gate terminal G of the SW transistor 403N.

As for the analog switch, in principle, there may be employed a switch made up of the n-channel type MOS transistor or p-channel type MOS transistor of any one alone of the SW transistors 403P and 403N, but this case has a threshold voltage problem, and accordingly, the second example of the output circuit 400 employs the CMOS switch employing a combination of both the n-channel type and p-channel type.

When turning off the sampling transistor 125, in the case of the p-type transistor 402 alone having a transfer gate configuration (the same as the SW transistor 403P alone) and not the analog switch 403, the write driving pulse NWS is set to a low-level state, and also in a state in which the n-type transistor 404 is OFF, and the p-type transistor 402 is ON, a driving signal which gradually makes the transition from a high-level state to a low-level state is supplied to the source terminal S of the p-type transistor 402, but upon the potential of the source terminal S approaching a low-level state, ON resistance increases, and also the p-type transistor 402 is turned off before the potential of the source terminal S completely goes to a low-level state, so it is difficult to set the inclination property of the transition state (change property) at the time of the sampling transistor 125 being in an OFF state to the same as that of the waveform output from the write driving pulse generating unit 406. This is because with the threshold voltage of the p-type transistor 402, there is influence from a different operation resistance.

On the other hand, if the p-type transistor 402 is with the analog switch 403 having a transfer gate configuration, when the output of the write driving pulse generating unit 406 is high voltage, the SW transistor 403P exhibits a large current (ON resistance is small) and the SW transistor 403N exhibits a small current (ON resistance is large), but on the other hand, when the output of the write driving pulse generating unit 406 is low voltage, the SW transistor 403N exhibits a large current (ON resistance is small) and the SW transistor 403P exhibits a small current (ON resistance is large), the parallel resistance of the SW transistors 403P and 403N is not influenced by the output voltage of the write driving pulse generating unit 406, and as a result thereof, influence due to different operation resistance can be eliminated according to the threshold voltage of the SW transistors 403P and 403N. Note that following the output of the write driving pulse generating unit 406 completely going to a low-level state, the write driving pulse NWS is set to an inactive-high state, the analog switch 403 is turned to off, and also the n-type transistor 404 is turned on.

Improvement Technique

Fifth Embodiment

Figure 20A:
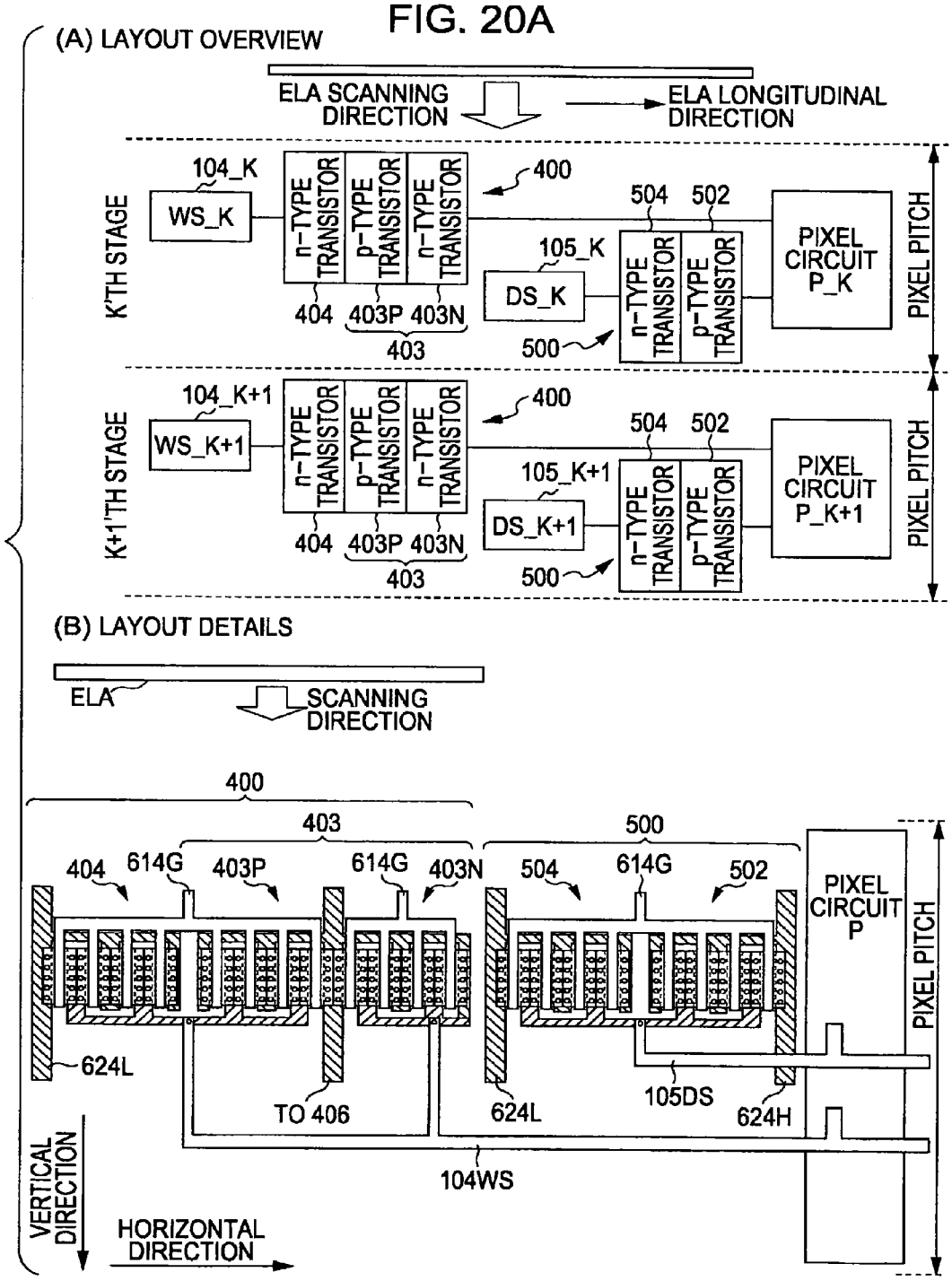
FIG. 20A is a diagram illustrating a fifth embodiment (first example) of the driving circuit placement.
Figure 20B:
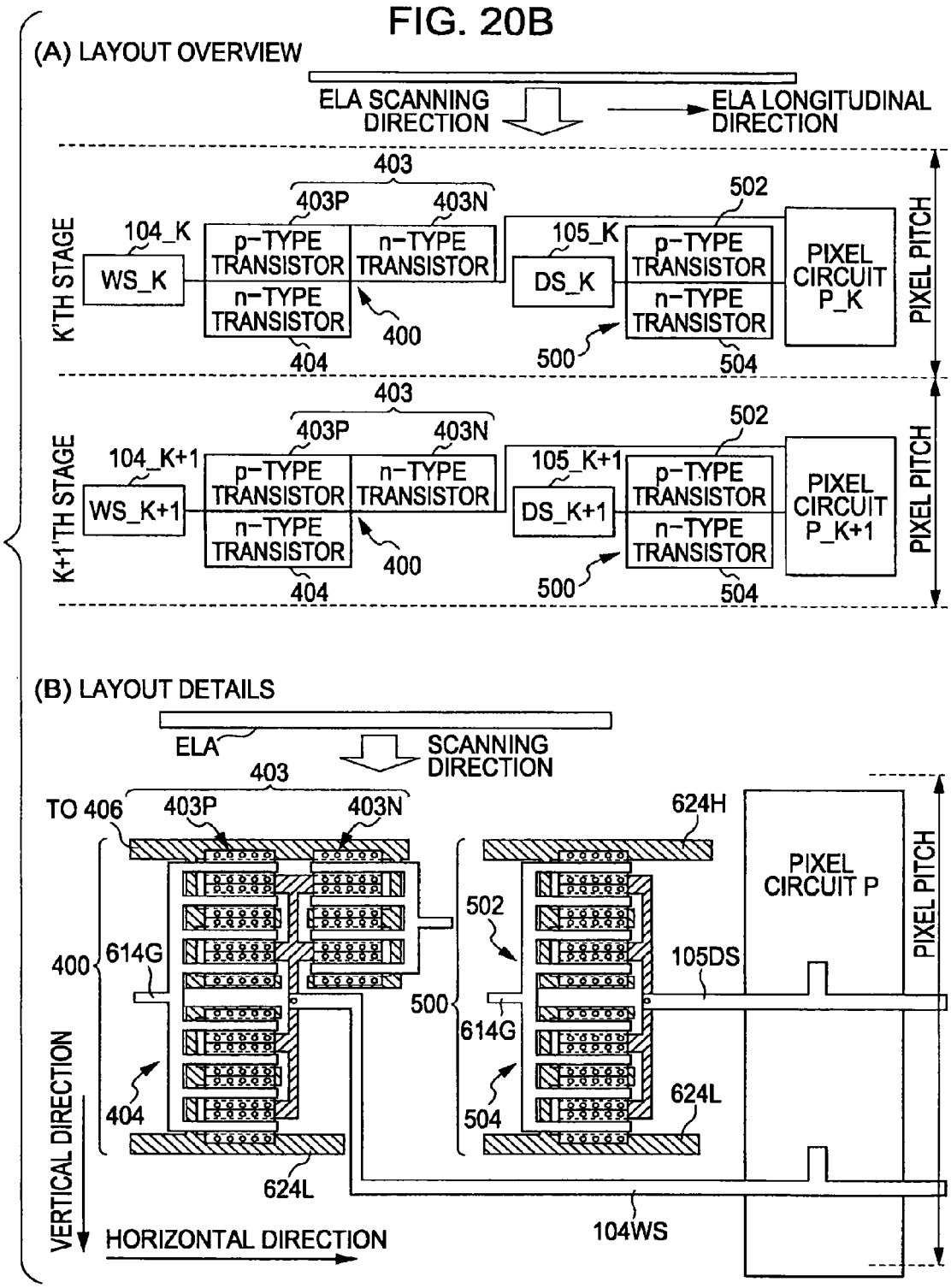
FIG. 20B is a diagram illustrating the fifth embodiment (second example) of the driving circuit placement.
Figure 20C:
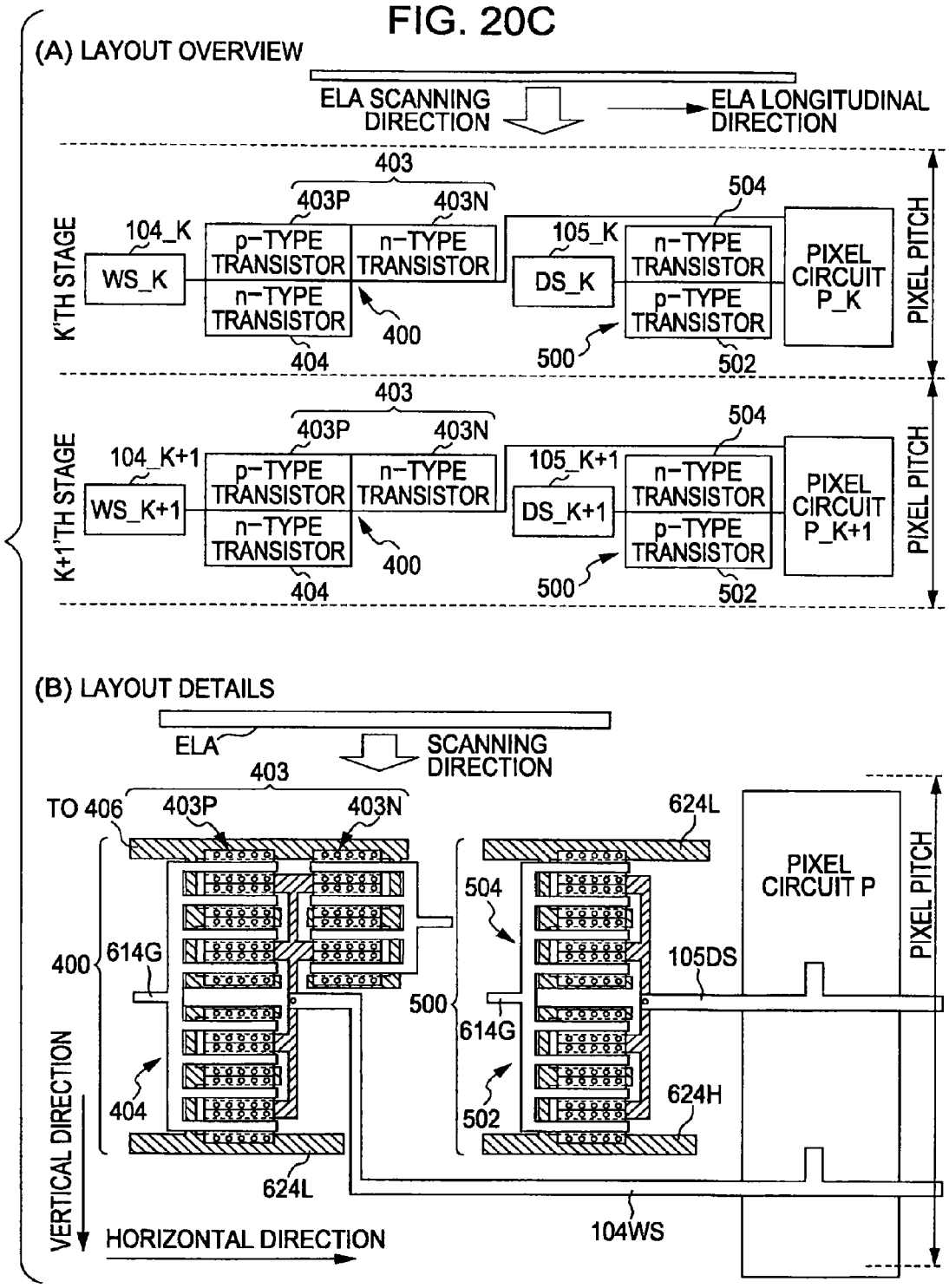
FIG. 20C is a diagram illustrating the fifth embodiment (third example) of the driving circuit placement.

FIGS. 20A through 20C are diagrams illustrating a fifth embodiment of the driving circuit placement (layout) whereby brightness irregularities on the display screen due to the irregularities cause at the time of the annealing processing can be alleviated. A layout according to the fifth embodiment is an application example in the case of the output circuit 400 being regarded as the second example shown in FIG. 19, and has features in that the analog switch 403 is disposed in the same column as the ELA irradiation longitudinal direction, which relates to a function for inclining the transition state (change property) of the write driving pulse WS when turning off the sampling transistor 125 which stipulates the start timing of the mobility correction period.

In reality, not only the SW transistors 403P and 403N making up the analog switch 403 for determining the end timing of the mobility correction period, but also whether which type of transistor turns on the light-emitting control transistor 122 for determining the start timing of the mobility correction period, i.e., the p-type or n-type of the output circuit 500, are also taken into consideration. That is to say, in the case of the layout according to the fifth embodiment, it is desirable to dispose at least any one of the p-type transistor 502 and n-type transistor 504 for turning on the light-emitting control transistor 122, and the SW transistors 403P and 403N making up the analog switch 403 in the same column as the ELA irradiation longitudinal direction. To this extent, the placement order thereof is arbitrary.

For example, in the case of a modification as to the pixel circuit P (FIG. 16A) and driving timing (FIG. 16B) according to the second embodiment, when the scan driving pulse NDS is set to an active-high state, i.e., when the p-type transistor 502 of the output circuit 500 is turned on, the start timing of the mobility correction period is determined, so it is desirable to dispose at least the p-type transistor 502, and the SW transistors 403P and 403N making up the analog switch 403 in the same column as the ELA irradiation longitudinal direction. To this extent, the placement order thereof is arbitrary.

Therefore, for example, as with the first example shown in FIG. 20A, in order of the n-type transistor 404, the SW transistors 403P and 403N making up the analog switch 403, n-type transistor 504, and p-type transistor 502 may be disposed so as to approach the pixel array unit 102 (pixel circuit P). Alternatively, as with the second example shown in FIG. 20B, while in order of the SW transistors 403P and 403N making up the analog switch 403, and p-type transistor 502 may be disposed so as to approach the pixel array unit 102 (pixel circuit P), with another row within the same pixel pitch, in order of the remaining n-type transistor 404, and n-type transistor 504 may be disposed so as to approach the pixel array unit 102 (pixel circuit P).

On the other hand, in the case of a modification as to the pixel circuit P (FIG. 2) and driving timing (FIG. 4) according to the first embodiment, when the scan driving pulse NDS is set to an active-low state, i.e., when the n-type transistor 504 of the output circuit 500 is turned on, the start timing of the mobility correction period is determined, so it is desirable to dispose at least the n-type transistor 504, and the SW transistors 403P and 403N making up the analog switch 403 in the same column as the ELA irradiation longitudinal direction. To this extent, the placement order thereof is arbitrary.

Therefore, for example, as with the first example shown in FIG. 20A, in order of the n-type transistor 404, the SW transistors 403P and 403N making up the analog switch 403, n-type transistor 504, and p-type transistor 502 may be disposed so as to approach the pixel array unit 102 (pixel circuit P). Alternatively, as with the third example shown in FIG. 20C, while in order of the SW transistors 403P and 403N making up the analog switch 403, and n-type transistor 504 may be disposed so as to approach the pixel array unit 102 (pixel circuit P), with another row within the same pixel pitch, in order of the remaining n-type transistor 404, and p-type transistor 502 may be disposed so as to approach the pixel array unit 102 (pixel circuit P).

Pixel Circuit

Third Embodiment

Figure 21A:
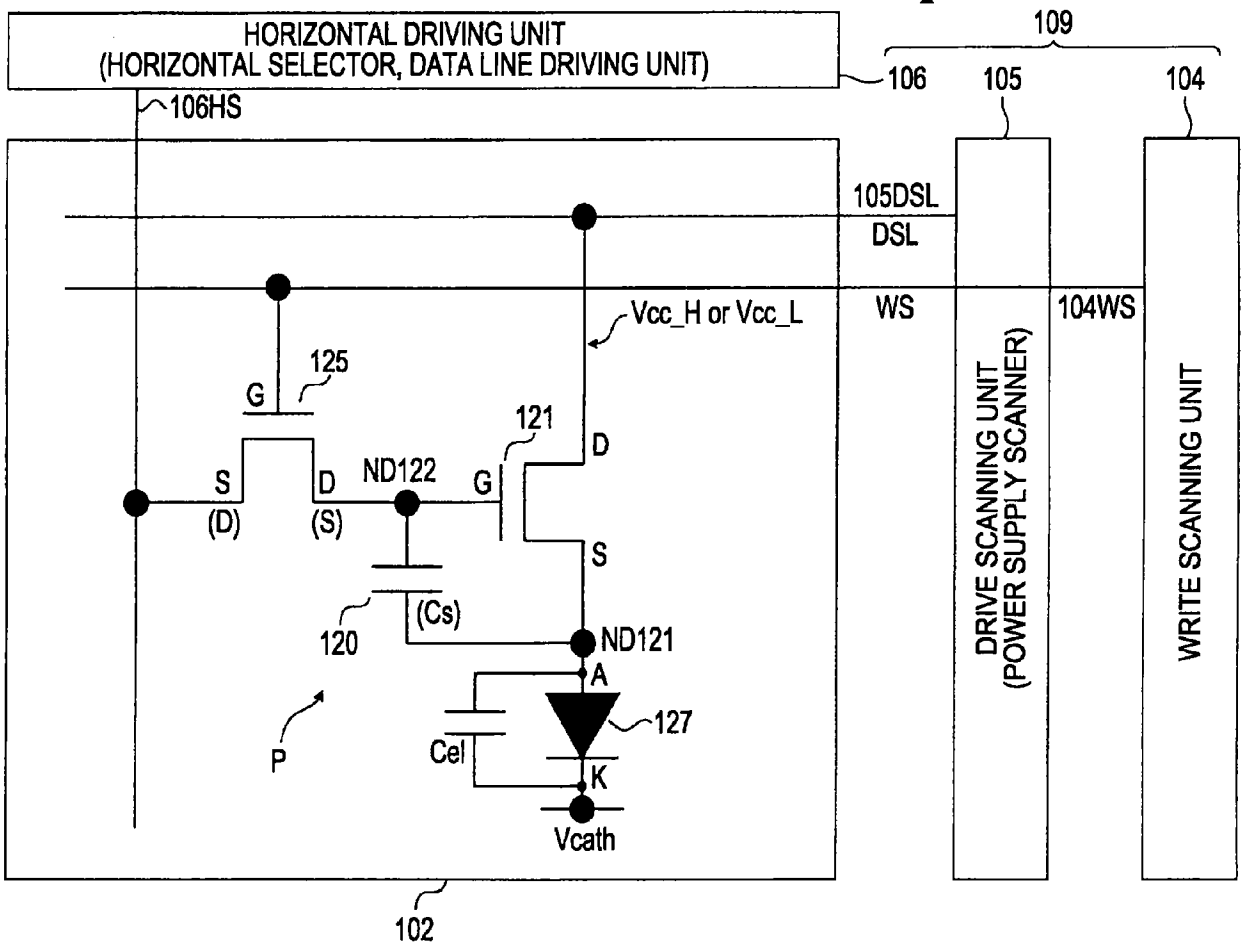
FIG. 21A is a diagram illustrating a third embodiment of the pixel circuit according to the present embodiment.

FIG. 21A is a diagram illustrating a third embodiment of the pixel circuits P of the present embodiment. Note that FIG. 21A also illustrates the vertical driving unit 103 and horizontal driving unit 106 provided on the peripheral portion of the pixel circuits P on the substrate 101 of the display panel unit 100.

The pixel circuit P according to the third embodiment has features in that a two-transistor driving configuration is employed, which uses another switching transistor for scanning (sampling transistor 125) as well as the driving transistor 121, and also according to the ON/OFF settings of the power supply driving pulse DSL for controlling the respective switching transistors and the write driving pulse WS, influence on the driving current Ids is prevented, which is caused due to deterioration over time of the organic EL element 127 or property fluctuation (e.g., irregularities or fluctuation of threshold voltage or mobility or the like) of the driving transistor 121. Also, with the two-transistor driving configuration, the number of devices and the number of wirings are small, whereby a highly fine configuration can be realized, and also sampling can be performed without deterioration in the picture signal Vsig, whereby good image quality can be obtained.

First, in the same way as with the first embodiment, the storage-capacitor 120 is connected between the gate and source of the driving transistor 121 to make up a bootstrap circuit which is an example of a driving signal stabilizing circuit as a circuit for preventing driving current fluctuation due to deterioration over time of the organic EL element 127. As for a method for suppressing influence on the driving current Ids, which is caused due to property fluctuation (e.g., irregularities or fluctuation of threshold voltage or mobility or the like) of the driving transistor 121, this can be handled by devising the driving timing of each of the transistors 121 and 125.

Specifically, the pixel circuit P according to the third embodiment includes the storage-capacitor 120, n-channel type driving transistor 121, n-channel type sampling transistor 125 to which the active-high write driving pulse WS is supplied, and organic EL element 127 which is an example of an electro-optic element (light-emitting element) which emits light by a current being applied thereto.

The storage-capacitor 120 is connected between the gate terminal G (node ND122) and source terminal S of the driving transistor 121, and the source terminal S of the driving transistor 121 is directly connected to the anode terminal A of the organic EL element 127. The cathode terminal K of the organic EL element 127 is assumed to be a cathode potential Vcath serving as a reference potential. The cathode potential Vcath is connected to a ground wiring Vcath (GND) common to all the pixels for supplying the reference potential.

The drain terminal D of the driving transistor 121 is connected to the power supply line 105DSL from the drive scanning unit 105 serving as a power supply scanner. The power supply line 105DSL has features in that the power supply line 105DSL itself has power supply ability as to the driving transistor 121. Specifically, the drive scanning unit 105 according to the third embodiment includes a power supply voltage switching circuit for switching the first potential Vcc_H at the high-voltage side and the second potential Vcc_L at the low-voltage side which are equivalent to power supply voltage to supply this to the drain terminal D of the driving transistor 121.

As for the second potential Vcc_L, potential sufficiently lower than the reference potential Vo of the picture signal Vsig in the picture signal line 106HS is employed. For example, the second potential Vcc_L which is the low potential side of the power supply line 105DSL is set such that the voltage Vgs between the gate and source (difference between the gate potential Vg and source potential Vs) of the driving transistor 121 is greater than the threshold voltage Vth of the driving transistor 121. Note that the reference potential Vo is also employed for an initializing operation prior to a threshold correction operation, and employed for pre-charging the picture signal line 106HS beforehand.

With the sampling transistor 125, the gate terminal G is connected to the write scanning line 104WS from the write scanning unit 104, the source terminal S is connected to the picture signal line 106HS, and the drain terminal D is connected to the gate terminal G (node ND122) of the driving transistor 121. The active-high write driving pulse WS from the write scanning unit 104 is supplied to the gate terminal G thereof. With the sampling transistor 125, a connection mode can also be employed wherein the source terminal S and drain terminal D are inverted.

Operation of Pixel Circuit

Third Embodiment

Figure 21B:
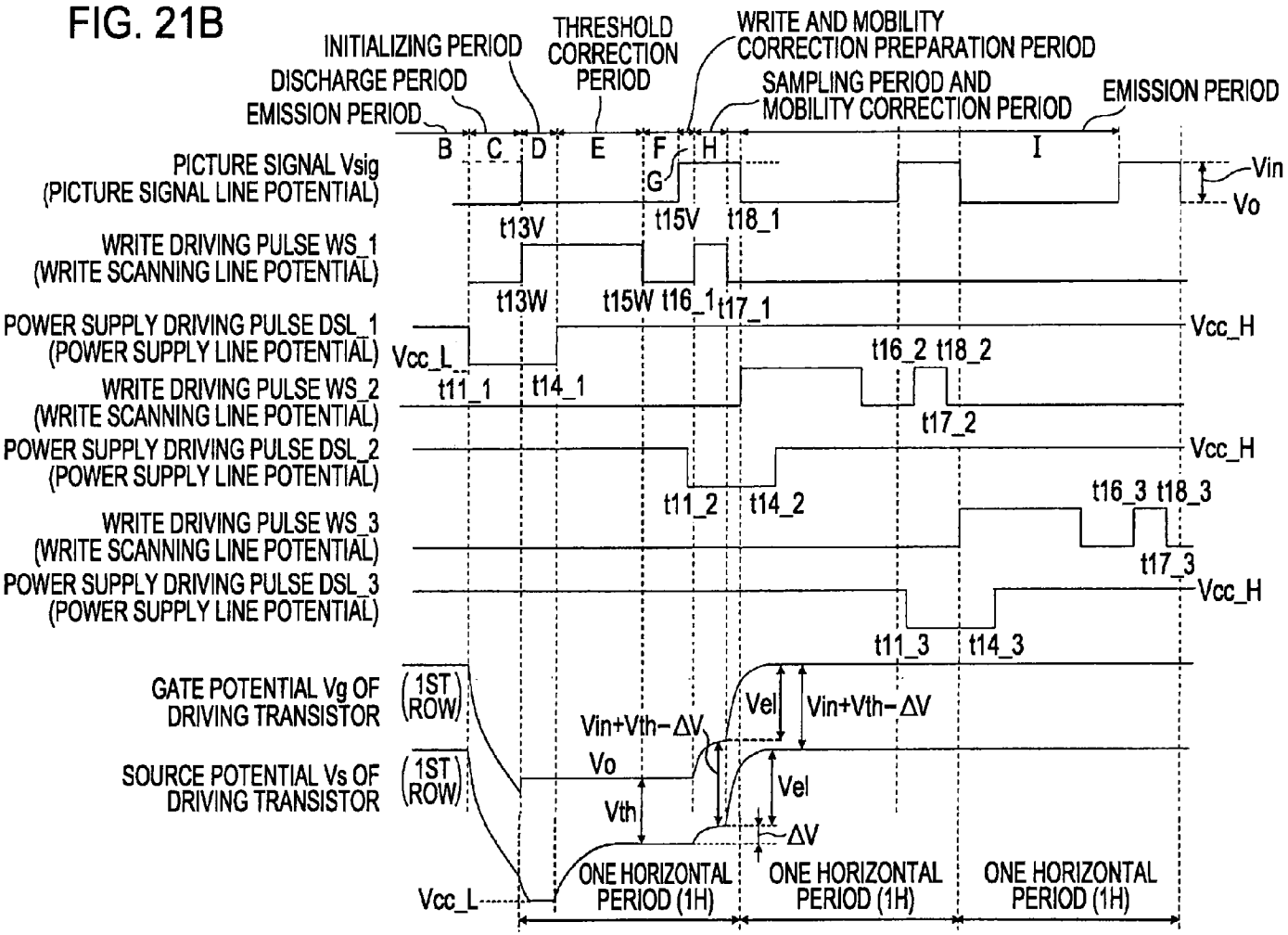
FIG. 21B is a timing chart describing the operation of the pixel circuit according to the third embodiment.

FIG. 21B is a timing chart describing an operation at the time of writing the information of the signal potential Vin in the storage-capacitor 120 using a line sequential system, as an example of driving timing relating to the pixel circuit P according to the third embodiment shown in FIG. 21A.

With the pixel circuit P according to the third embodiment, as for driving timing, first, the sampling transistor 125 is electrically conducted in response to the write driving pulse WS supplied from the write scanning line 104WS, samples the picture signal Vsig supplied from the picture signal line 106HS to hold this in the storage-capacitor 120. This point is basically the same as that in the case of driving the pixel circuit P according to the first embodiment. Note that with the driving timing according to the pixel circuit P according to the third embodiment, when writing the information of the signal potential Vin of the picture signal Vsig in the storage-capacitor 120, from the perspective of sequential scanning, line sequential driving is performed, which propagates one row worth of the picture signal to each column of the picture signal line 106HS simultaneously.

The driving transistor 121 flows the driving current Ids to the organic EL element 127 in accordance with the signal potential (potential corresponding to the potential of the valid period of the picture signal Vsig) which receives current supply from the power supply line 105DSL which is the first potential (high potential side) and held in the storage-capacitor 120.

The vertical driving unit 103 outputs the write driving pulse WS as a control signal for electrically conducting the sampling transistor 125 at a time zone wherein the power supply line 105DSL is at the first potential, and also the picture signal 106HS is at the reference potential Vo which is the invalid period of the picture signal Vsig, and holds the voltage equivalent to the threshold voltage Vth of the driving transistor 121 in the storage-capacitor 120. This operation realizes the threshold correction function. According to this threshold correction function, influence of the threshold voltage Vth of the driving transistor 121 which fluctuates for each pixel circuit P can be cancelled.

In particular, with the driving timing according to the pixel circuit P according to the third embodiment, the write driving pulse WS is activated within a time zone wherein the power supply line 105DSL is at the first potential which is the high potential side, and also the picture signal Vsig is in a valid period. That is to say, as a result thereof, the mobility correction period (and also sampling period) is determined with a range wherein the time width where the potential of the picture signal line 106HS is at the potential (signal line potential) of the valid period of the picture signal Vsig, and the active period of the write driving pulse WS are overlapped. Particularly, with the present embodiment, the active period width of the write driving pulse WS is set short so as to be included in the time width where the picture signal line 106HS is at the signal potential, and consequently, the mobility correction period is determined with the write driving pulse WS itself. More accurately, the mobility correction period (and also sampling period) is a period after the write driving pulse WS rises to turn on the sampling transistor 125 until the write driving pulse WS falls to turn off the sampling transistor 125.

Description will be made specifically below. First, basically, similar driving is performed with delay of one horizontal scanning period for each row of the write scanning line 104WS or power supply line 105DSL. Each timing and signal in FIG. 21B are shown with the same timing and signal as the timing and signal of the first row regardless of a row to be processed. When there is a need to distinguish rows during explanation, distinction is made by indicating a row to be processed using a reference identifier with an underbar.

With regard to a certain row (first row, here), at a light-emitting period B of the previous field before timing till, the write driving pulse WS is in an inactive-low state, and the sampling transistor 125 is in a non electroconductive state, but on the other hand, the power supply driving pulse DSL is at the first potential Vcc_H which is the power supply voltage side of a high potential. Accordingly, regardless of the potential of the picture signal line 106HS, the driving current Ids is supplied from the driving transistor 121 to the organic EL element 127 in accordance with the voltage-state (the voltage Vgs between the gate and source of the driving transistor 121) held in the storage-capacitor 120 according to the operation of the previous field, and applied to the ground wiring Vcath (GND) common to all the pixels, whereby the organic EL element 127 is in a light-emitting state.

Subsequently, the timing chart enters a new field for line sequential scanning, first, in a state in which the write driving pulse WS is in an inactive-low state, the drive scanning unit 105 switches the power supply driving pulse DSL_1 given to the power supply line 105DS_1 of the first row from the first potential Vcc_H which is the high potential side to the second potential Vcc_L which is the low potential side. This timing (t11_1) is assumed to be within a period wherein the picture signal Vsig is at the signal potential Vin of a valid period, with the arrangement shown in FIG. 21B. For example, the first row is in a range of timing t15V through t13V. Note however, this is not indispensable, the above-mentioned switching may be performed when the picture signal Vsig is at the reference potential Vo of an invalid period. The first row may be within a range of timing t13V through t15V.

Next, the write scanning unit 104 switches the write driving pulse WS to an active-high state, while keeping a state in which the power supply line 105DSL_1 is at the second potential Vcc_L (t13W). This timing (t13W) is set to the same timing (t13V) or a little later timing for the picture signal Vsig being switched from the signal potential Vin which is a valid period to the reference potential Vo which is an invalid period after the picture signal Vsig in the last horizontal period is switched from the reference potential Vo which is an invalid period to the signal potential Vin which is a valid period (t15V). Subsequently, the timing for switching the write driving pulse WS to an inactive-low state (t15W) is set to the same timing (t15V) or a little earlier timing for the picture signal Vsig being switched from the reference potential Vo which is an invalid period to the signal potential Vin which is a valid period.

That is to say, it is desirable that a period for keeping the write driving pulse WS in an active-high state (t13W through t15W) is within a time zone where the picture signal Vsig is at the reference potential Vo which is an invalid period (t13V through t15V). This is because when the power supply line DSL is at the first potential Vcc_H, and also the picture signal Vsig is at the signal potential Vin, if the write driving pulse WS is set to an active-high state, a sampling operation (signal potential writing operation) of the signal potential Vin to the storage-capacitor 120 is performed, and consequently, inconvenience is caused as an threshold correction operation.

During timing t11_1 through t13W (referred to as a discharge period), the potential of the power supply line 105DSL is discharged up to the second potential Vcc_L, and further, the source potential Vs of the driving transistor 121 makes the transition to the potential close to the second potential Vcc_L. Further, the storage-capacitor 120 is connected between the gate terminal G and source terminal S of the driving transistor 121, and according to the effects by the storage-capacitor 120 thereof, the gate potential Vg is linked with fluctuation of the source potential Vs of the driving transistor 121. It is desirable that in the case of the wiring capacity of the power supply line 105DSL being great, the power supply line 105DSL is switched from the high potential Vcc_H to the low potential Vcc_L at relatively earlier timing. Sufficiently securing this discharge period C (t11_1 through t13W) prevents influence of wiring capacity or the other pixel parasitic capacitance.

Upon the write driving pulse WS being switched to an active-high state while keeping the power supply driving pulse DSL at the second potential Vcc_L which is the low potential side (t13W), the sampling transistor 125 goes to an electroconductive state. At this time, the picture signal line 106HS is at the reference potential Vo. Accordingly, the gate potential Vg of the driving transistor 121 becomes the reference potential Vo of the picture signal line 106HS through the electroconductive sampling transistor 125. Simultaneously therewith, upon the driving transistor 121 being turned on, the source potential Vs of the driving transistor 121 is immediately fixed to the second potential Vcc_L which is the low potential side.

That is to say, the potential of the power supply line 105DSL is switched to the second potential Vcc_L which is sufficiently lower than the reference potential Vo of the picture signal line 106HS from the first potential Vcc_H which is the high potential side, whereby the source potential Vs of the driving transistor 121 is initialized (reset) to the second potential Vcc_L which is sufficiently lower than the reference potential Vo of the picture signal line 106HS. Thus, the gate potential Vg and source potential Vs of the driving transistor 121 are initialized, whereby the preparation for a threshold correction operation is completed. A period until the power supply driving pulse DSL is next switched to the first potential Vcc_H which is the high potential side (t13W through t14_1) becomes an initializing period D. Note that the conjunction of the discharge period C and initializing period D will also be referred to as a threshold correction preparation period for initializing the gate potential Vg and source potential Vs of the driving transistor 121.

Next, the power supply driving pulse DSL given to the power supply line 105DSL is switched to the first potential Vcc_H while keeping the write driving pulse WS in an active-high state (t14_1). Thereafter, the drive scanning unit 105 keeps the potential of the power supply line 105DSL at the first potential Vcc_H until the next frame (or field) processing. Thus, the timing chart enters a threshold correction period E wherein the drain current flows to the storage-capacitor 120, and the threshold voltage Vth of the driving transistor 121 is corrected (canceled). This threshold correction period E continues until timing for the write driving pulse WS being set to an inactive-low state (t15W).

With the threshold correction period E at timing (t14_1) and thereafter, the potential of the power supply line 105DSL makes the transition from the second potential Vcc_L which is the low potential side to the first potential Vcc_H which is the high potential side, whereby the source potential Vs of the driving transistor 121 starts to increase. That is to say, the gate terminal G of the driving transistor 121 is held at the reference potential Vo of the picture signal Vsig, and the drain current attempts to flow until the driving transistor 121 is cut off by the potential Vs of the source terminal S increasing. Upon being cut off, the source potential Vs of the driving transistor 121 becomes "Vo−Vth".

Note that at the threshold correction period E, in order to entirely apply the drain current to the storage-capacitor 120 side (at the time of Cs<<Cel), and prevent the drain current from flowing to the organic EL element 127 side, the potential Vcath of the common ground wiring cath is set such that the organic EL element 127 is cut off. The equivalent circuit of the organic EL element 127 is represented with a parallel circuit of a diode and the parasitic capacitor Cel, so as long as "Vel.ltoreq.Vcath+VthEL" holds, i.e., as long as the leak current of the organic EL element 127 is considerably smaller than the current to the driving transistor 121, the current of the driving transistor 121 is employed for charging the storage-capacitor 120 and parasitic capacitor Cel.

As a result thereof, upon the current path of the drain current flowing to the driving transistor 121 being cut off, the voltage Vel of the anode terminal A of the organic EL element 127, i.e., the potential of the node ND121 increases over time. Subsequently, upon the potential difference between the potential (source potential Vs) of the node ND121 and the voltage (gate potential Vg) of the node ND122 becoming just the threshold voltage Vth, the driving transistor 121 makes the transition to an OFF state from an ON state, the drain current is prevented from flowing, and the threshold correction period ends. That is to say, after a certain period of time, the voltage Vgs between the gate and source of the driving transistor 121 takes the value of the threshold voltage Vth.

Here, in reality, the voltage equivalent to the threshold voltage Vth is written in the storage-capacitor 120 connected between the gate terminal G and source terminal S of the driving transistor 121. Note however, the threshold correction period E is from timing wherein the write driving pulse WS is set to an active-high state (t13W) (specifically, subsequently, time point t14 wherein the power supply driving pulse DSL is returned to the first potential Vcc_H) to timing wherein the write driving pulse WS is returned to an inactive-low state (t15W), and when this period is not secured sufficiently, the threshold correction operation ends before then. In order to eliminate this problem, it is desirable to repeat the threshold correction operation multiple times. The drawings omit the timing thereof.

Next, the drive scanning unit 105 switches the write driving pulse WS to an inactive-low state at a later portion of one horizontal cycle (t15W), and further, the horizontal driving unit 106 switches the potential of the picture signal line 106HS from the reference potential Vo to the signal potential Vin (t15V). Thus, at the timing t15W through tl5V, in a state in which the picture signal line 106HS is at the reference potential Vo, the potential of the write scanning line WS (write driving pulse WS) goes to a low-level state. Subsequently, the period wherein the signal potential Vin of the picture signal Vsig is actually supplied to the picture signal line 106HS by the horizontal driving unit 106 to set the write driving pulse WS to an active-high state is taken as the writing period (also referred to as the sampling period) of the signal potential Vin to the storage-capacitor 120. This signal potential Vin is held in the form of being added to the threshold voltage Vth of the driving transistor 121.

As a result thereof, fluctuation of the threshold voltage Vth of the driving transistor 121 is constantly cancelled out, which is equivalent to performing threshold correction. According to this threshold correction, the voltage Vgs between the gate and source held in the storage-capacitor 120 becomes "Vsig+Vth"="Vin+Vth". Also, simultaneously, at this sampling period mobility correction is carried out. That is to say, at the driving timing at the pixel circuit P according to the third embodiment, the sampling period also serves as the mobility correction period.

Specifically, first, following the write driving pulse WS being switched to an inactive-low state (t15W), the horizontal driving unit 106 further switches the potential of the picture signal line 106HS from the reference potential Vo to the signal potential Vin (t15V). Thus, in a state in which the sampling transistor 125 is set to a non-electroconductive (OFF) state, the preparation for the next sampling operation and mobility correction operation is completed. The period until the timing wherein the write driving pulse WS is next set to an active-high state (t16_1) is referred to as a write and mobility correction preparation period G.

Next, while the potential of the power supply line 105DSL is kept at the first potent Vcc_H, and also the potential of the picture signal line 106HS is kept at the signal potential Vin, the write scanning unit 104 switches the write driving pulse WS to an active-high state (t16_1), and switches the write driving pulse WS to an inactive-low state at suitable timing until the timing wherein the horizontal driving unit 106 switches the potential of the picture signal line 106HS from the signal potential Vin to the reference potential Vo (t18_1), i.e., at the suitable time within a time zone where the picture signal line 106HS is at the signal potential Vin (t17_1). The period wherein the write driving pulse WS is in an active-high state (t16_1 through t17_1) is referred to as a sampling period and mobility correction period H. Thus, in a state in which the gate potential Vg of the driving transistor 121 is at the signal potential Vin, the sampling transistor 125 goes to an electroconductive (ON) state. Accordingly, at the sampling period and mobility correction period H, in a state in which the gate terminal G of the driving transistor 121 is fixed to the signal potential Vin of the picture signal Vsig, the driving current Ids flows to the driving transistor 121.

Here, when the threshold voltage of the organic EL element 127 is taken as VthEL, upon setting to "Vo-Vth<VthEL", the organic EL element 127 is set to a reverse bias state, and is in a cutoff state (high-impedance state), so emits no light, and also exhibits not diode property but simple capacity property. Accordingly, the drain current (driving current Ids) flowing to the driving transistor 121 is written in the capacitor "C=Cs+Cel" wherein both of the capacity value Cs of the storage-capacitor 120 and the capacity value Cel of the parasitic capacitor (equivalent capacitor) Cel of the organic EL element 127 are combined. Thus, the drain current of the driving transistor 121 flows into the parasitic capacitor Cel, and charge is started. As a result thereof, the source potential Vs of the driving transistor 121 rises.

With the timing chart in FIG. 21B, this rise is represented with ΔV. This rise, i.e., negative feedback amount ΔV which is a mobility correction parameter, is to be subtracted from the voltage between the gate and source "Vgs=Vin+Vth" held in the storage-capacitor 120 by threshold correction, and consequently, "Vgs=Vin−ΔV+Vth" is to be held, which is equivalent to subjecting thereto negative feedback. At this time, the source potential Vs of the driving transistor 121 becomes the value "−Vth+ΔV" obtained by subtracting "Vgs=Vin−ΔV+Vth" held in the storage-capacitor from the gate potential Vg (=Vin).

Thus, with the driving timing according to the pixel circuit P according to the third embodiment, at the sampling period and mobility correction period H (t16 through t17), sampling of the signal potential Vin, and adjustment of the negative feedback amount ΔV for correcting the irregularities of the mobility μ are simultaneously performed. The write scanning unit 104 can adjust the time width of the sampling period and mobility correction period H by adjusting the ON/OFF period of the write driving pulse WS, and also can add a inclination to the change property of the picture signal Vsig, and accordingly, can optimize the negative feedback amount of the driving current Ids as to the storage-capacitor 120.

Next, in a state in which the potential of the picture signal line 106HS is at the signal potential Vin, the write scanning unit 104 switches the write driving pulse WS to an inactive-low state (t17_1). Thus, the sampling transistor 125 goes to a non-electroconductive (OFF) state, the timing chart proceeds to a light-emitting period I. The horizontal driving unit 106 stops supply of the signal potential Vin of the picture signal Vsig to the picture signal line 106HS at a suitable time point thereafter, and returns the picture signal line 106HS to the reference potential Vo (t18_1). Subsequently, the stage proceeds to the next frame (or field), where the threshold correction preparation operation, threshold correction operation, mobility correction operation, and light-emitting operation are repeated again.

As a result thereof, the gate terminal G of the driving transistor 121 is isolated from the picture signal line 106HS. Applying of the signal potential Vin to the gate terminal G of the driving transistor 121 is cancelled, so the gate potential Vg of the driving transistor 121 can increase. At this time, the driving current Ids flowing to the driving transistor 121 flows to the organic EL element 127, and the anode potential of the organic EL element 127 increases according to the driving current Ids. This increase is assumed to be Vel. Eventually, the reverse bias state of the organic EL element 127 is cancelled along with increase of the source potential Vs, so the organic EL element 127 actually starts emitting of light according to inflow of the driving current Ids. The increase of the anode potential of the organic EL element 127 at this time (Vel) is exactly increase of the source potential Vs of the driving transistor 121, and the source potential Vs of the driving transistor 121 goes to "−Vth+ΔV+Vel".

The relations between the driving current Ids and the gate voltage Vgs can be represented such as shown in the above-mentioned Expression (2), the term of the threshold voltage Vth is cancelled, and the driving current Ids supplied to the organic EL element 127 does not depend on the threshold voltage Vth of the driving transistor 121. The driving current Ids is basically determined with the signal potential Vin of the signal voltage Vsig. In other words, the organic EL element 127 emits light with the brightness corresponding to the signal potential Vin.

At this time, the signal potential Vin is corrected with the feedback amount ΔV. This correction amount ΔV serves so as to cancel the effects of the mobility μ positioned at the coefficient portion of Expression (2). Accordingly, the driving current Ids substantially depends on the signal potential Vin alone. The driving current Ids does not depend on the threshold voltage Vth, so even if the threshold voltage Vth changes due to manufacturing process, the driving current Ids between the drain and source does not fluctuate, and the light-emitting brightness of the organic EL element 127 does not fluctuate.

Also, the storage-capacitor 120 is connected between the gate terminal G and source terminal S of the driving transistor 121, the bootstrap operation is performed at the beginning of the light-emitting period due to the effects by the storage-capacitor 120 thereof, while the voltage Vgs between the gate and source of the driving transistor 121 is kept steady, the gate potential Vg and source potential Vs of the driving transistor 121 increase. The driving transistor 121 operates as a constant current source, so the I-V property of the organic EL element 127 changes over time, and even if the source potential Vs of the driving transistor 121 changes along therewith, the potential Vgs between the gate and source of the driving transistor 121 is kept steady (generally equal to Vin−ΔV+Vth) by the storage-capacitor 120, so the current flowing to the organic EL element 127 does not change, and accordingly, the light-emitting brightness of the organic EL element 127 is also kept steady. According to the bootstrap operation, even if the I-V property of the organic EL element 127 changes over time, image display having no brightness deterioration accompanied therewith can be realized.

Improvement Technique

Sixth Embodiment

Figure 22:
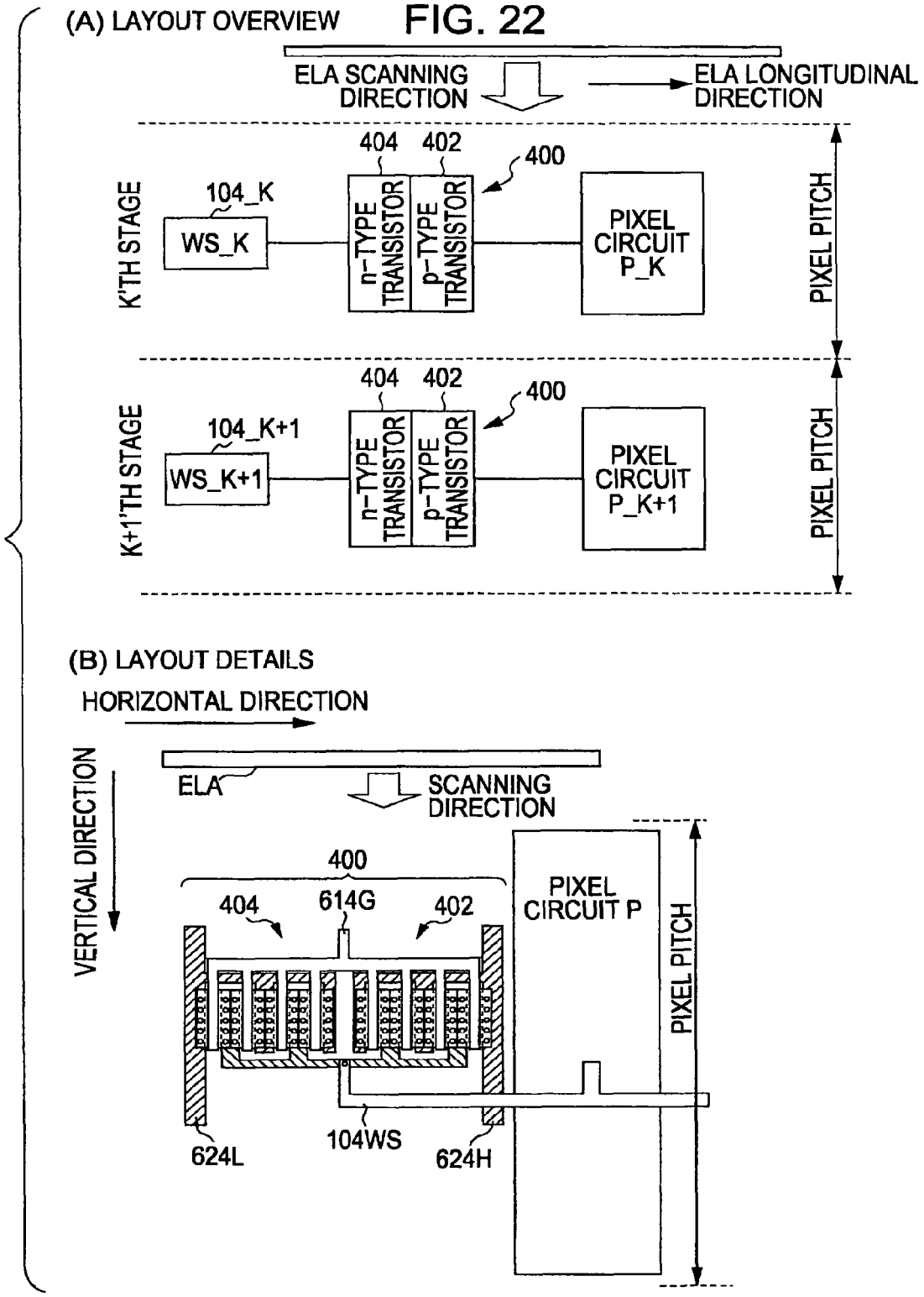
FIG. 22 is a diagram illustrating a sixth embodiment of the driving circuit placement.

FIG. 22 is a diagram illustrating a sixth embodiment of the driving circuit placement (layout) whereby brightness irregularities on the display screen due to the irregularities cause at the time of the annealing processing can be alleviated. A layout according to the sixth embodiment is an application example with the pixel circuit P according to the third embodiment, and has features in that the output circuit 400 for determining the start timing and end timing of the mobility correction period is disposed in the same column as the ELA irradiation longitudinal direction.

Now, as can be understood from the above description, with the timing for driving the pixel circuit P according to the third embodiment, the active-high period of the write driving pulse WS serves as not only the sampling period of the picture signal Vsig (signal potential Vin) but also the mobility correction period. The irregularities of the active-high period thereof cause the irregularities of threshold correction effects and mobility correction effects similar to the pixel circuit P according to the first or second embodiment. Accordingly, similar to the pixel circuit P according to the first or second embodiment, in order to prevent the waveform blunting of the write driving pulse WS supplied from the output circuit 400 of the write scanning unit 104 from fluctuating for each row, it is desirable to apply the same concept as one of the above-mentioned first through fifth embodiments of the improvement technique to the layout of the buffer transistors of the output circuit 400.

Now, in the case of driving the pixel circuit P according to the third embodiment, regardless of whether which type of the sampling transistor 125 to which the write driving pulse WS (or NWS) is supplied, of n-type or p-type, the start timing and end timing of an operation period is stipulated depending on whether which of the p-type transistors 402 and 404 for the write driving pulse WS (or NWS) is turned on and turned off, and accordingly, the layout suitable for the driving pulse pattern shown in FIG. 13B is applied to the layout of the buffer transistors of the output circuit 400.

In the case of the output circuit 400 being configured of an inverter configuration of the p-type transistor 402 and the n-type transistor 404, in reality, regardless of whether the sampling transistor 125 is a n-type or p-type, or whether the start timing and end timing of an operation period (mobility correction period) is determined when the sampling transistor 125 is turned on or when the sampling transistor 125 is turned off, the p-type transistor 402 and n-type transistor 404 are disposed in the same column as the ELA irradiation longitudinal direction. Thus, the transition property of the write driving pulse WS (NWS) can be set to the same at the time of the start and end of the operation period, the irregularities of the mobility correction period for each row (stage) can be suppressed. It becomes unnecessary to perform a case-by-case approach regarding the polarities (n-type/p-type) of the sampling transistor 125, and the polarities (n-type/p-type) of the buffer transistors of the output circuit 400 for determining each timing of the start and end of the mobility correction period.

In the case of the layout according to the sixth embodiment, as long as the p-type transistors 402 and n-type transistor 504 are disposed in the same column as the ELA irradiation longitudinal direction, the placement order thereof is arbitrary. Accordingly, for example, as with the first example shown in FIG. 22, in order of the n-type transistor 504, and p-type transistor 402 may be disposed so as to approach the pixel array unit 102 (pixel circuit P), alternatively, as with the second example not shown in the drawing, in order of the p-type transistor 402, and n-type transistor 504 may be disposed so as to approach the pixel array unit 102 (pixel circuit P). Also, in FIG. 22 the placement orders of the respective stages are all set to the same, but an arrangement may be made wherein any of the first example shown in FIG. 22 and the unshown second example is switched arbitrarily for each stage.

Note that with the pixel circuit P having a two-transistor configuration according to the third embodiment shown in FIG. 21A also, the mobility correction period is caused to automatically follow the magnitude of the picture line signal potential, whereby the optimization thereof can be realized. In this case, though not shown in the drawing, it is desirable to provide a write driving pulse generating unit for generating a write driving pulse WS having a inclination in the transition state (change property) at the time of ON or OFF, and employ an analog switch having a transfer gate configuration as the output circuit 400. Subsequently, it is desirable to dispose p-type and n-type SW transistors making up the analog switch having a transfer gate configuration thereof in the same column as the ELA irradiation longitudinal direction.

Description has been made so far regarding the present invention by way of embodiments, but the technical scope of the present invention is not restricted to the scope described in the above-mentioned embodiments. Various types of modification or improvement can be added to the above-mentioned embodiments without departing the scope of the present invention, and embodiments to which such modifications or improvements have been added are also encompassed in the technical scope of the present invention.

Also, the claimed invention is not restricted to the above-mentioned embodiments, and not all of the combinations of the features described in the embodiments are necessarily indispensable to carrying out the present invention. The invention encompasses the above-mentioned embodiments in various stages, and various manifestations of the invention can be extracted with an appropriate combination of disclosed multiple components. Even if several components are eliminated from all the components shown in the embodiments, an arrangement from which the several components have been eliminated can be extracted as being within the scope of the invention, as long as an advantage thereof can be obtained.

For example, with the above-mentioned embodiments, in the driving timing example shown in FIG. 4, by taking into consideration the fact that the mobility correction period determined with the phase difference between the write driving pulse WS and scan driving pulse NDS is absolutely short, and the irregularities of the pulse timing thereof (ON/OFF timing or change property) greatly affect the property of the mobility correction, layout examples have been described whereby the property irregularities of the output circuits 400 and 500 for outputting the write driving pulse WS and scan driving pulse NDS to be supplied to each of the scanning lines 104WS and 105DS can be reduced, but the same concept can be applied to driving pulses employed for other function purposes.

Also, with the above-mentioned embodiments, description has been made specifically regarding layout examples of the buffer transistors in the case of the driving system for realizing threshold correction and mobility correction using the respective pixel circuits having a five-transistor configuration or two-transistor configuration, but as for other pixel circuits to which the driving system for realizing threshold correction and mobility correction can be applied, in addition to those, pixel circuits can be conceived, which have a four-transistor configuration or three-transistor configuration which are positioned between the five-transistor through two-transistor. In these cases as well, the arrangement can also be applied wherein buffer transistors for determining each start and end timing of an operation period are, such as the above-mentioned embodiments, disposed in the same column as the ELA irradiation longitudinal direction.

Also, with the above-mentioned layout example wherein the buffer transistors are disposed in a column in the longitudinal direction of laser beam irradiation, the buffer transistors to be processed have been transistors for the vertical scanning system according to threshold correction and mobility correction, but may be transistors for the horizontal scanning system. In either event, of the buffer transistors for outputting a pulse signal for sampling an input video signal to each signal line, it is desirable to select buffer transistors necessary for aligning the levels of the property irregularities of driving pulse waveforms.

It should be understood by those skilled in the art that various modifications, combinations, sub-combinations and alterations may occur depending on design requirements and other factors insofar as they are within the scope of the appended claims or the equivalents thereof.

The invention claimed is:

1. A display device comprising:

a pixel array unit including a plurality of pixel circuits disposed in a matrix having a row direction and a column direction, at least one of said pixel circuits comprising a driving transistor configured to control a driving current, a storage capacitor configured to store a signal corresponding to a signal potential of an image signal supplied via an image signal line and a sampling transistor, and an electro-optic element configured to emit light in accordance with the driving current, the driving current being based on the signal stored in said storage capacitor and being received through the driving transistor and a first switching transistor; and a control unit having an output stage that includes a first buffer transistor and a second buffer transistor configured to output a pulse signal for driving said pixel array unit, wherein the first buffer circuit is configured to output a first pulse signal to the sampling transistor and the second buffer circuit is configured to output a second pulse signal to the first switching transistor, the first buffer comprises a first transistor and a second transistor configured to be switched complementally, and the second buffer comprises a third transistor and a fourth transistor configured to be switched complementally, a gate electrode of the first transistor and a gate electrode of the third transistor are arranged along the row direction, each of a channel of the first transistor and second transistor are arranged along the column direction, each of a channel of the third transistor and fourth transistor are arranged along the column direction, and the first buffer and the second buffer are connected to the same pixel circuit.

2. The display device according to claim 1, wherein the first buffer circuit and the second buffer circuit are disposed by being arrayed in a column in the longitudinal direction of a laser beam irradiation.

3. The display device according to claim 1, wherein the pixel circuit further comprising a second switching transistor connected between a gate of the driving transistor and a first reference potential, and a third switching transistor connected between an anode of the electro-optic element of and a second reference potential.

4. The display device according to claim 3, wherein the sampling transistor is configured to sample the signal potential to the storage capacitor in a sampling period, wherein the second switching transistor is configured to supply the first reference potential to the gate of the driving transistor in a first initializing period prior to the sampling period, and wherein the third switching transistor is configured to supply the second reference potential to the anode of the electro-optic element in a second initializing period prior to the sampling period.

5. The display device according to claim 1, wherein the first transistor is p-type transistor, and wherein the second transistor is n-type transistor.

6. The display device according to claim 1, wherein the third transistor is p-type transistor, and wherein the fourth transistor is n-type transistor.

7. The display device according to claim 1, wherein the first transistor and the second transistor are cascade-connected.

8. The display device according to claim 1, wherein the third transistor and the fourth transistor are cascade-connected.

9. A display device comprising:

a pixel array unit including a plurality of pixel circuits disposed in a matrix having a row direction and a column direction, at least one of said pixel circuits comprising a driving transistor, a sampling transistor, a first switching transistor, a second switching transistor, a third switching transistor, a capacitor, and electro-optic element; and a control unit having an output stage that includes a first buffer transistor and a second buffer transistor configured to output a pulse signal for driving said pixel array unit, wherein the first buffer circuit is configured to output a first pulse signal to the sampling transistor and the second buffer circuit is configured to output a second pulse signal to the first switching transistor, the first buffer comprises a first transistor and a second transistor configured to be switched complementally, and the second buffer comprises a third transistor and a fourth transistor configured to be switched complementally, a gate electrode of the first transistor and a gate electrode of the third transistor are arranged along the row direction, each of a channel of the first transistor and second transistor are arranged along the column direction, each of a channel of the third transistor and fourth transistor are arranged along the column direction, and the first buffer and the second buffer are connected to the same pixel circuit.

10. The display device according to claim 9, wherein the first transistor is p-type transistor, and wherein the second transistor is n-type transistor.

11. The display device according to claim 9, wherein the third transistor is p-type transistor, and wherein the fourth transistor is n-type transistor.

12. The display device according to claim 9, wherein the first transistor and the second transistor are cascade-connected.

13. The display device according to claim 9, wherein the third transistor and the fourth transistor are cascade-connected.

* * * * *